US012285146B2

(12) United States Patent
Gadini et al.

(10) Patent No.: US 12,285,146 B2
(45) Date of Patent: Apr. 29, 2025

(54) WASHING AGENT DISPENSER FOR DISHWASHING MACHINES

(71) Applicant: ELTEK S.P.A., Casale Monferrato (IT)

(72) Inventors: Costanzo Gadini, Casale Monferrato (IT); Alberto Sciutto, Casale Monferrato (IT); Daniele Cerruti, Casale Monferrato (IT); Paolo Savini, Casale Monferrato (IT); Marco Pizzi, Casale Monferrato (IT); Paolo Begnamino, Casale Monferrato (IT); Stefano Allera, Casale Monferrato (IT); Massimo Zanin, Casale Monferrato (IT)

(73) Assignee: ELTEC S.p.A., Casale Monferrato (IT)

( * ) Notice: Subject to any disclaimer, the term of this patent is extended or adjusted under 35 U.S.C. 154(b) by 181 days.

(21) Appl. No.: 18/007,964

(22) PCT Filed: Jun. 4, 2021

(86) PCT No.: PCT/IB2021/054909
§ 371 (c)(1),
(2) Date: Dec. 2, 2022

(87) PCT Pub. No.: WO2021/245612
PCT Pub. Date: Dec. 9, 2021

(65) Prior Publication Data

US 2023/0240507 A1 Aug. 3, 2023

(30) Foreign Application Priority Data

Jun. 5, 2020 (IT) ..... 102020000013432

(51) Int. Cl.
*A47L 15/44* (2006.01)
*F04B 43/12* (2006.01)

(52) U.S. Cl.
CPC ..... *A47L 15/4463* (2013.01); *A47L 15/4418* (2013.01); *A47L 15/4436* (2013.01);
(Continued)

(58) Field of Classification Search
CPC ..... A47L 15/4463; A47L 15/4418; A47L 15/4436; A47L 15/4445; A47L 2401/023; F04B 43/12
See application file for complete search history.

(56) References Cited

U.S. PATENT DOCUMENTS 10,939,798 B2 * 3/2021 Cerruti ..... A47L 15/4409
2002/0088502 A1 * 7/2002 Van Rompuy ..... D06F 39/024 141/1
2011/0247663 A1 * 10/2011 Gadini ..... A47L 15/4454 222/173

FOREIGN PATENT DOCUMENTS

DE 38 12 109 10/1989
DE 38 33 961 4/1990
(Continued)

OTHER PUBLICATIONS

International Search Report for PCT/IB2021/054909, mailed Aug. 30, 2021, 4 pages.
(Continued)

*Primary Examiner* — Frederick C Nicolas
(74) *Attorney, Agent, or Firm* — Nixon & Vanderhye P.C.

(57) ABSTRACT

A dispenser of washing agents for washing machines has a first tank, to contain a first washing agent, and a first dispensing arrangement, to dispense first dosed amounts of the first washing agent. The first dispensing arrangement has a peristaltic pump, which is configured to be driven in a first direction of rotation to cause delivery of the first dosed amounts of the first washing agent. The dispenser has a second tank, to contain a second washing agent, and a second dispensing arrangement, to dispense second dosed
(Continued)

amounts of the second washing agent. The peristaltic pump has a command arrangement of the second dispensing arrangement, and is configured to be driven in a second direction of rotation, to drive the command arrangement so as to cause dispensing of the second dosed amounts of the second washing agent.

20 Claims, 40 Drawing Sheets

(52) U.S. Cl.
CPC ..... *A47L 15/4445* (2013.01); *F04B 43/12* (2013.01); *A47L 2401/023* (2013.01)

(56) References Cited

FOREIGN PATENT DOCUMENTS

| | | |
|---|---|---|
| DE | 20 2004 003 633 | 5/2004 |
| WO | 2015/022622 | 2/2015 |

OTHER PUBLICATIONS

Written Opinion of the ISA for PCT/IB/2021/054909, mailed Aug. 30, 2021, 8 pages.

* cited by examiner

Fig. 1
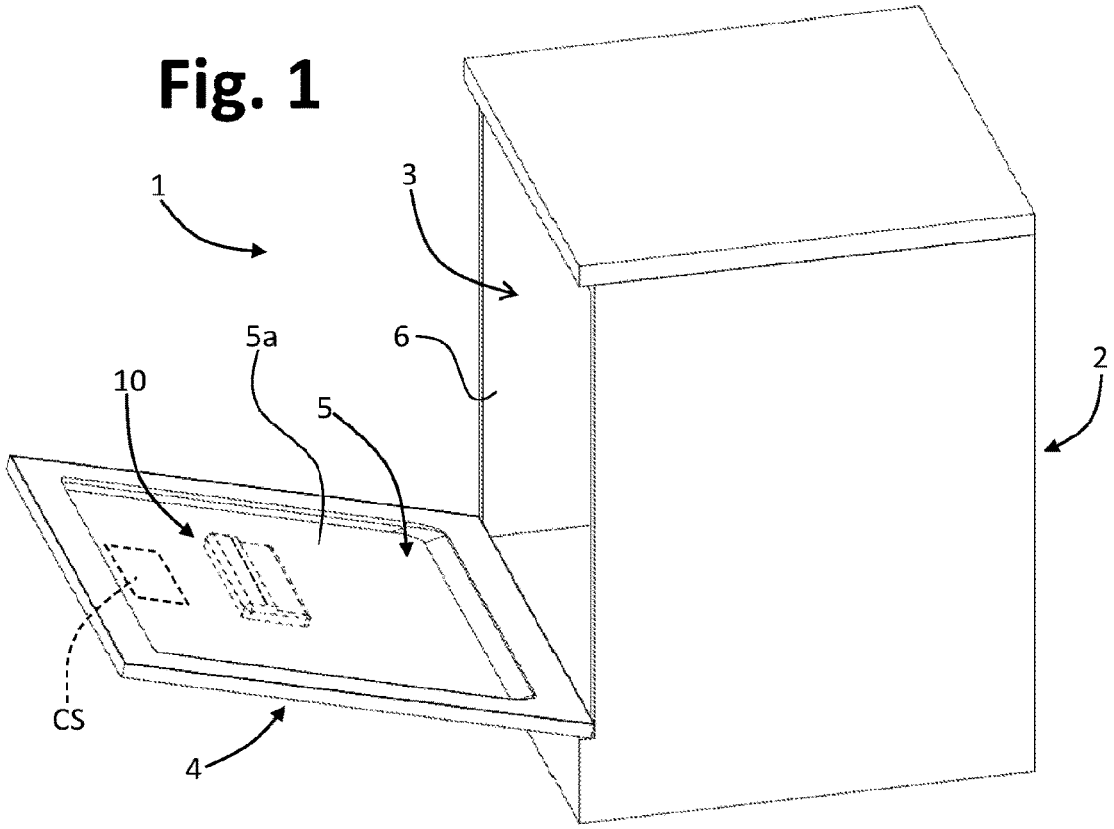
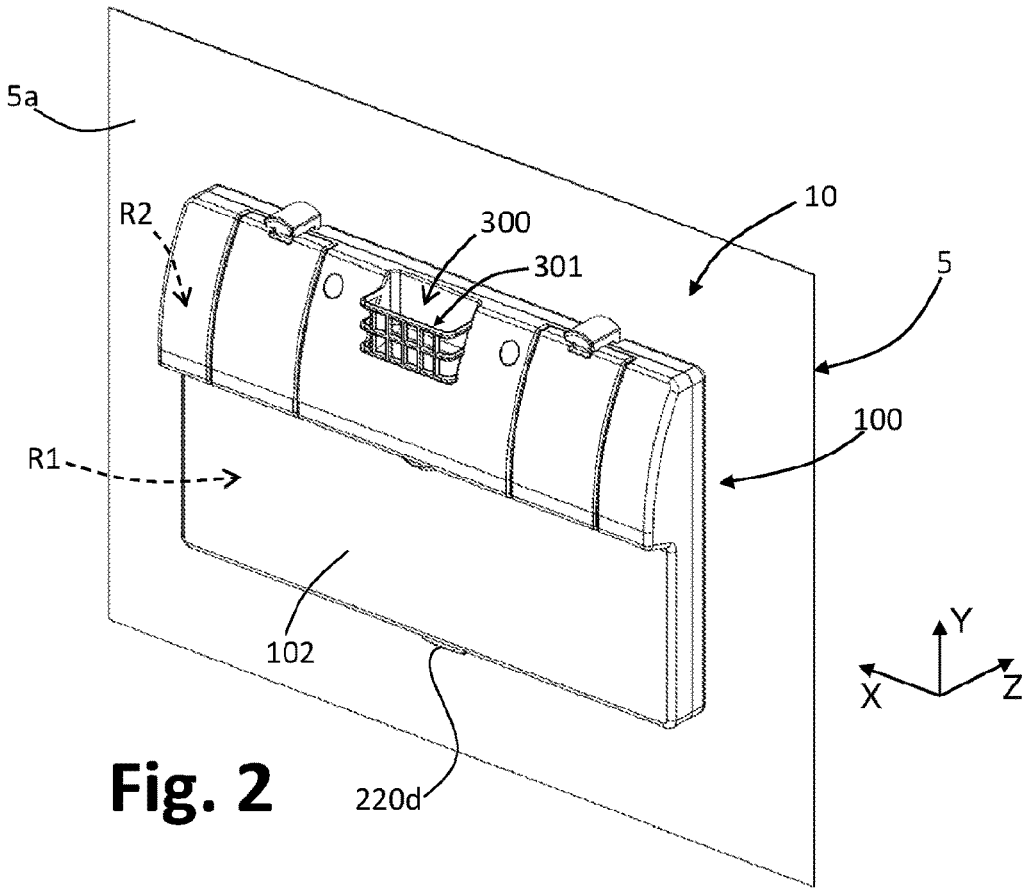
Fig. 2

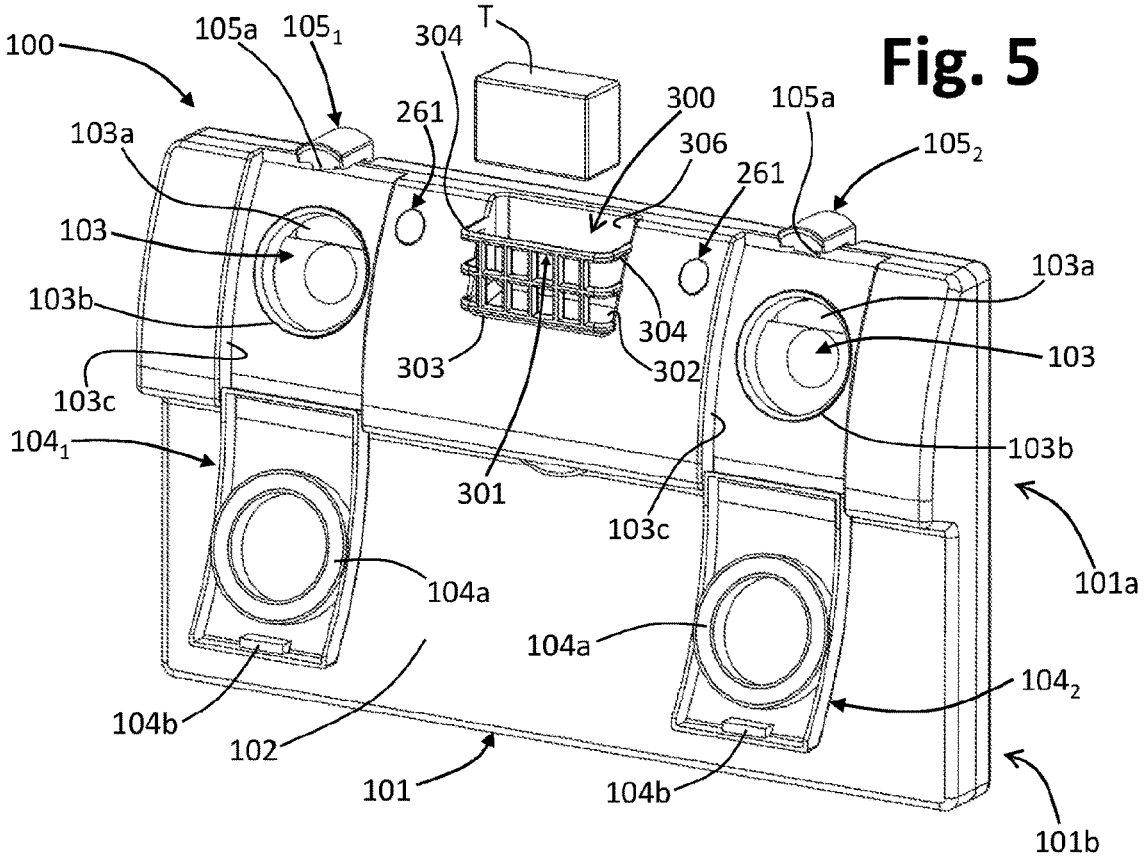
Fig. 5
Fig. 6
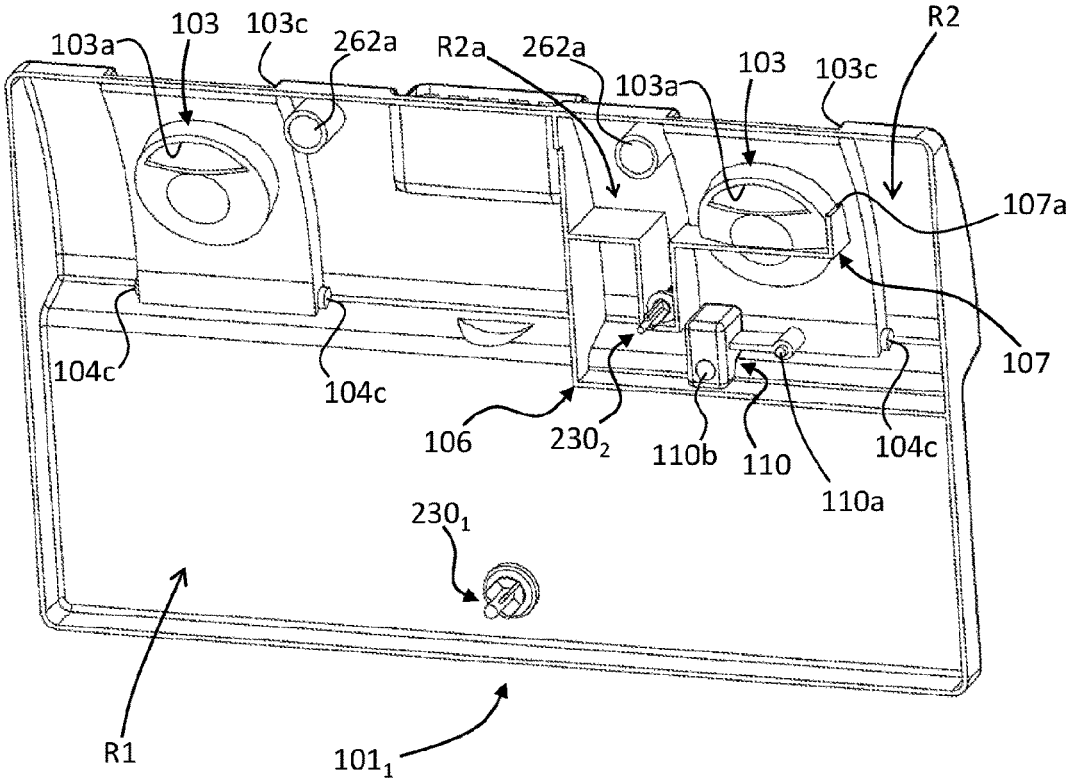

Fig. 37
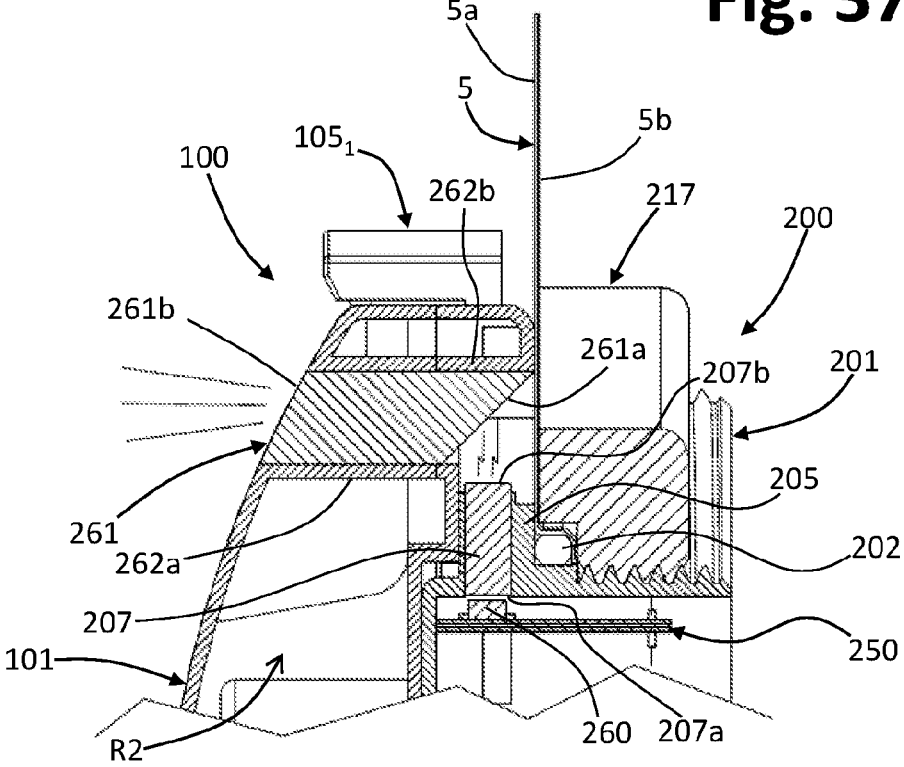
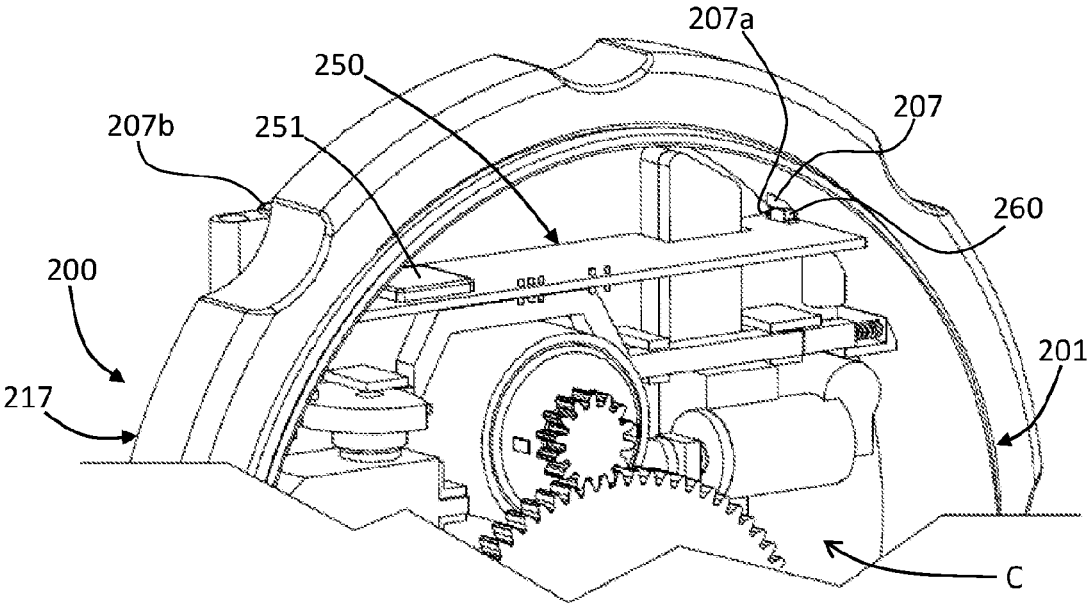
Fig. 38

Fig. 39
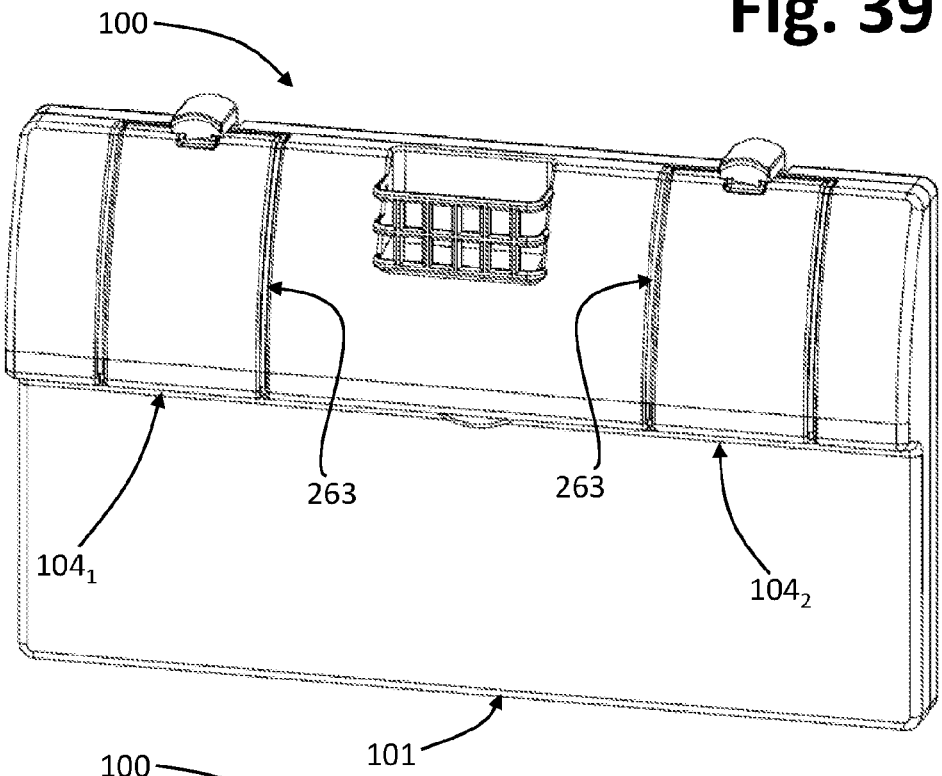
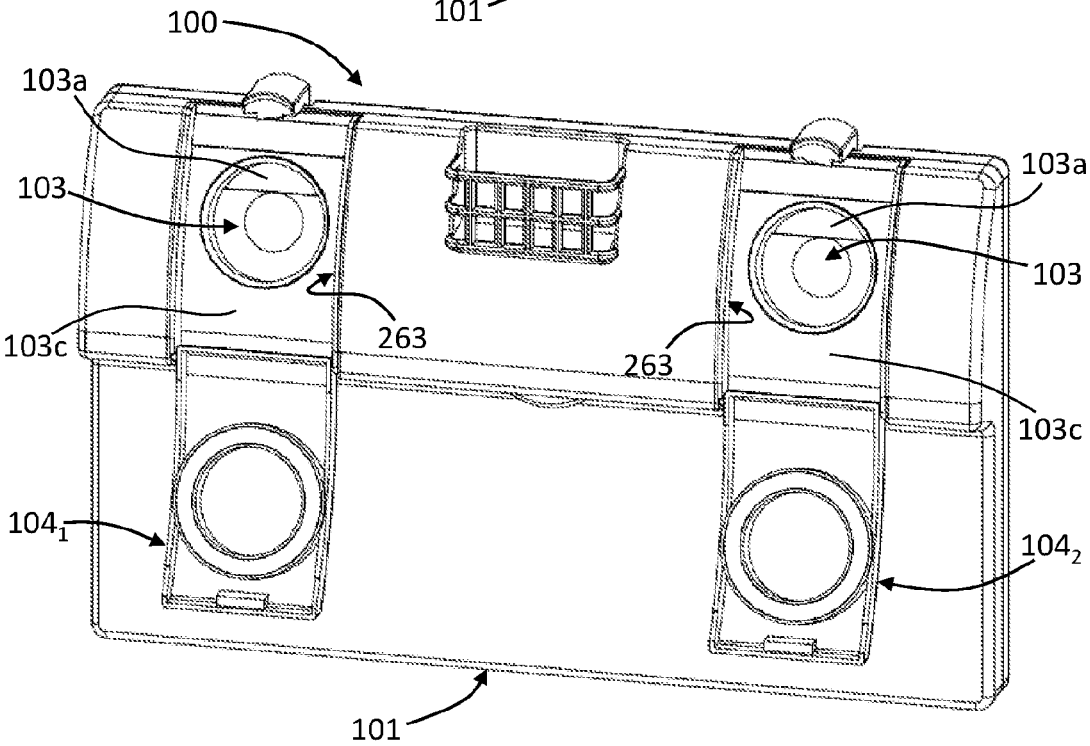
Fig. 40

Fig. 57
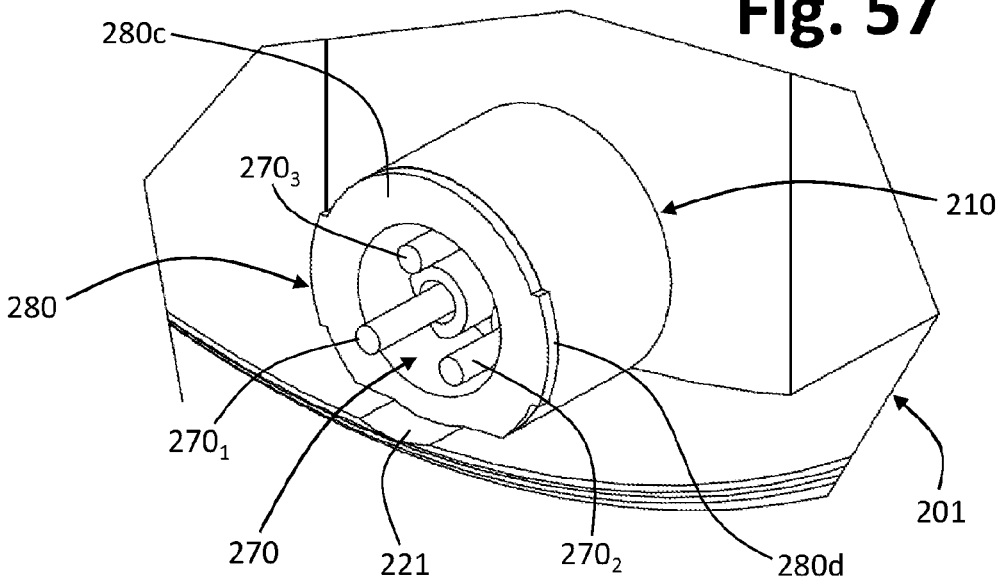
Fig. 58
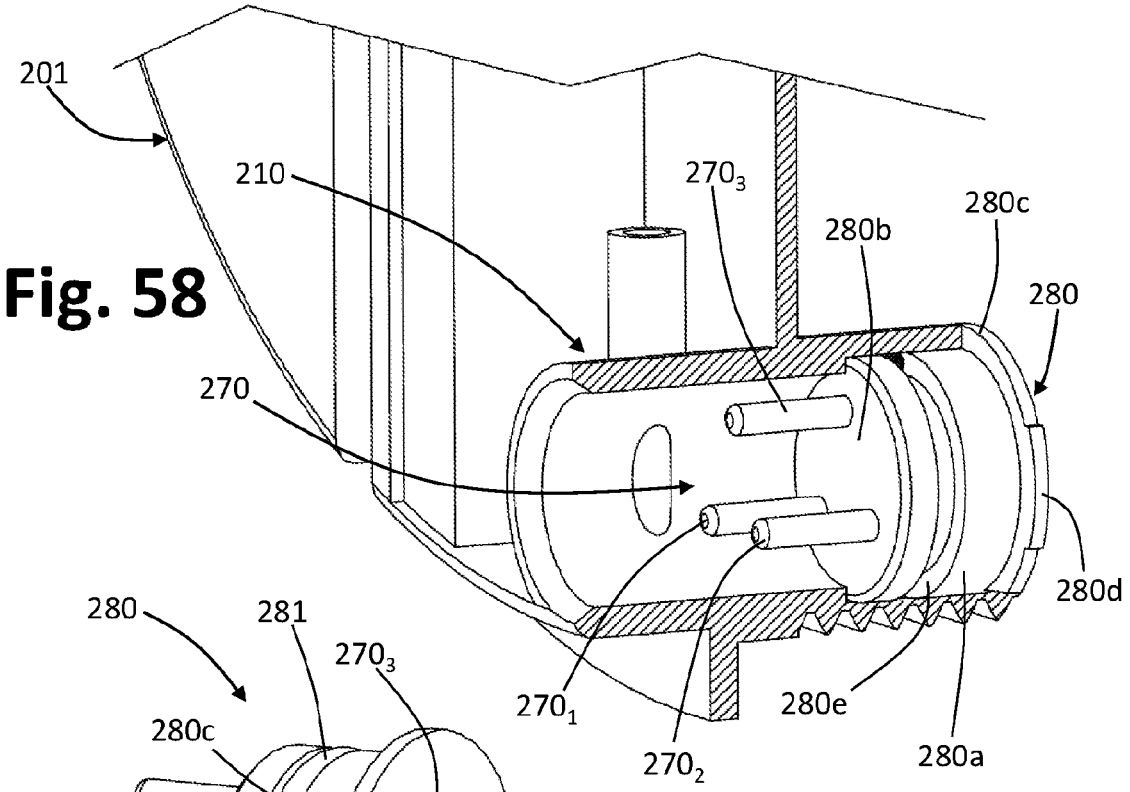
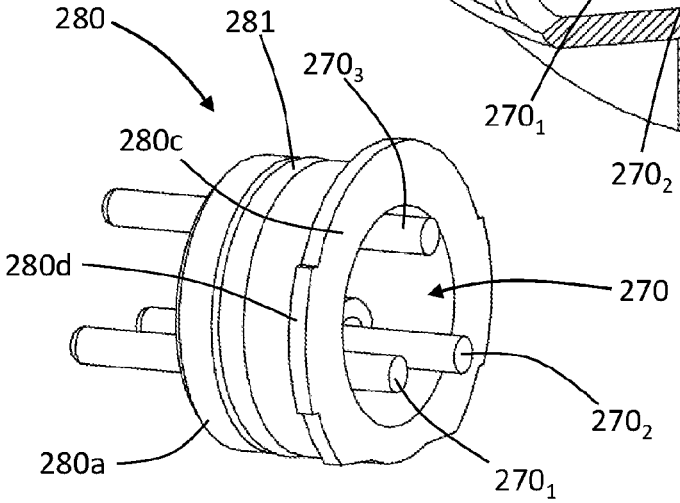
Fig. 59

WASHING AGENT DISPENSER FOR DISHWASHING MACHINES

This application is the U.S. national phase of International Application No. PCT/IB2021/054909 filed Jun. 4, 2021, which designated the U.S. and claims priority to IT patent application No. 102020000013432 filed Jun. 5, 2020, the entire contents of each of which are hereby incorporated by reference.

FIELD OF THE INVENTION

The present invention relates to dispensers of washing agents for washing machines, in particular household dish-washing machines, and more in particular to dispensers that are designed to be mounted on one of the walls that define a washing chamber of a dish-washing machine. The invention has been developed with particular reference to multi-dose dispensers of at least one washing agent in liquid form or semisolid (gel) form, i.e., provided with a rechargeable tank, which is able to contain an amount of the aforesaid washing agent sufficient to execute a plurality of washing programs by the dish-washer.

PRIOR ART

US2006157086 A1 discloses a dispenser device for a dish-washing machine, which comprises a multi-dose tank for a liquid washing agent and a pump housed within the door of the dish-washing machine. Extending through the wall of the door of the dish-washing machine that faces the inside of the corresponding washing chamber are a passage for recharging the tank and a nozzle for delivery of the liquid detergent, with the delivery nozzle that is connected in fluid communication with the tank and with the pump via a duct. In one embodiment, the pump is of a reversible type in order to enable flushing of the duct and prevent any possible clogging thereof.

The above solution proves complicated, far from efficient, and inconvenient to use for a user.

U.S. Pat. No. 7,845,361 B1 discloses a dispenser system for a dish-washing machine, comprising a multi-dose tank for a liquid washing agent and a piston dispensing pump that defines a dosing chamber, which is designed to receive from the tank a pre-set amount of the liquid additive, to be delivered in the course of an operating program of the dish-washing machine. The tank and the dispensing pump are mounted in a front recess of the wall of the door of the dish-washing machine that faces the inside of the corresponding washing chamber, and are coupled in a separable way via respective fluidic attachments to enable removal of the tank for the purposes of recharging. In one embodiment, housed in the front recess of the wall of the door of the dish-washing machine are two distinct tanks of the type referred to, each of which associated in a separable way to a respective piston pump of the type mentioned, where each piston pump can be driven by a corresponding solenoid actuator.

Also this solution proves complicated, far from efficient, and inconvenient to use for a user, also in view of risks of undesired exit of a washing agent from the corresponding tank, when the latter is handled.

EP 2138088 A1 discloses a dispenser device for dish-washing machines having a dispenser body, defined in the front of which is a compartment that is able to contain a tablet of a washing agent. The compartment is provided with a sliding hatch, via which the compartment itself can be closed after the tablet has been inserted. Operatively associated to the hatch is an electrically controlled release system to bring about opening of the hatch in the course of a washing program. The hatch has a substantially grid-shaped lateral extension so that, when the hatch slides into its open position, the lateral extension comes to be located in front of the compartment, to withhold the tablet inside it during continuation of the washing program.

Also this solution proves complicated, far from efficient, and inconvenient to use for a user, also in view of risks of undesired exit of a washing agent from the corresponding tank, when the latter is handled.

EP0691101 A1 discloses an integrated dispenser device for a dish-washing machine, having a dispenser body, which is to be partially inserted into an opening of the inner side of a tiltable door of the dish-washing machine, i.e., the side that is to face the inside of the corresponding washing chamber. The dispenser body defines at the front a housing, hinged in which is a multi-dose containing tank for a powder detergent, mounted for being displaceable between an inclined position of partial extraction, which enables filling of the containing tank, and an insertion position, where the front of the containing tank is substantially aligned with the front of the dispenser body. The containing tank is provided at the front with a transparent window, which enables a visual check on the amount of powder detergent present.

With solutions of this sort, checking of the content of the tank is awkward, both on account of possible steaming-up of the transparent window and on account of the fact that, since the dispenser is mounted on a tiltable door, visual check on the level can be carried out practically only with the door open, and hence substantially set horizontal: with such a plane of lie of the dispenser, however, the information that can be gleaned through the window may not be significant.

In addition, more in general, in solutions where a removable or displaceable tank is provided (for example, as described in the aforementioned U.S. Pat. No. 7,845,361 B1 and EP0691101), level checking is entrusted entirely to the user, who is thus altogether responsible for carrying out a visual check on the amount of washing agent contained in the tank.

Furthermore, in solutions of the type described in the aforementioned document U.S. Pat. No. 7,845,361 B1, possible errors of loading or topping-up, with a liquid washing agent, of the corresponding tank are not infrequent; in particular, it may happen that detergent is put into a tank that should contain a rinsing additive, or conversely a rinsing additive is put into a tank that should contain a washing detergent. Such errors, in particular those of the second type referred to, may have consequences such as to jeopardise operation of the dispenser or of the entire dish-washer.

Aim and Summary of the Invention

In its general terms, the present invention is aimed at overcoming at least one or more of the drawbacks referred to above. This and other aims still, which will emerge more clearly hereinafter, are achieved according to the present invention by a dispenser of washing agents having the characteristics specified in the annexed claims. The claims form an integral part of the technical teaching provided herein in relation to the invention.

According to a first inventive aspect, the present invention is aimed at providing a dispenser of washing agents for washing machines, in particular dish-washing machines, that is convenient to use for a user and in which check on delivery of a number of washing agents in liquid or semi-solid form is both efficient and inexpensive.

According to a second inventive aspect, the present invention is aimed at providing a dispenser of washing agents for washing machines, in particular dish-washing machines, in which the risks of dispersion in the environment of a liquid or semisolid washing agent, following upon actions performed by a user on the dispenser itself, is reduced or prevented.

According to a third inventive aspect, the present invention is aimed at providing a dispenser of washing agents for washing machines, in particular dish-washing machines, in which use of detergent in tablet form is convenient for a user, and production of the dispenser is economically advantageous.

According to a fourth inventive aspect, the present invention is aimed at providing a dispenser of washing agents for washing machines, in particular dish-washing machines, in which, even in the presence of displaceable parts that are designed to contain washing agents, a user is provided with clear and efficient indications regarding the content of these movable parts, and more in general, regarding conditions that pertain to operation of the dispenser, in a simple and safe way.

According to a fifth inventive aspect, the present invention is aimed at providing a dispenser of washing agents for washing machines, in particular dish-washing machines, in which, in a simple and efficient way, the risks of error by a user in use of the dispenser are limited, in particular as regards operations of charging of washing agents.

According to a sixth inventive aspect, the present invention is aimed at providing a dispenser of washing agents for washing machines, in particular dish-washing machines, in which, even in the presence of displaceable parts that are to contain washing agents, it is possible to make available in a simple and safe way precise information regarding the content of the dispenser and/or of the aforesaid movable parts.

According to a seventh inventive aspect, the present invention is aimed at providing a dispenser of washing agents for washing machines, in particular dish-washing machines, in which, in a simple and safe way, it is possible to prevent or, if necessary, correct any malfunctioning due to errors of a user regarding use of a washing agent, and/or a to enable more efficient check on a treatment program carried out by the dish-washer on which the dispenser is installed.

BRIEF DESCRIPTION OF THE DRAWINGS

Further aims, characteristics, and advantages of the invention will emerge clearly from the ensuing detailed description, with reference to the annexed drawings, which are provided purely by way of non-limiting example and in which:

FIG. 1 is a schematic perspective view of a dish-washing machine, with a front door in the open position, the dish-washing machine being provided with a dispenser according to possible embodiments of the invention;

FIG. 2 is a schematic perspective view of a part of a tub wall of a dish-washing machine, mounted on which is a dispenser according to possible embodiments;

FIG. 5 is a schematic perspective view of a removable part of a dispenser according to possible embodiments;

FIG. 6 is a schematic perspective view of the inner side of a portion of a hollow body belonging to a removable part of a dispenser according to possible embodiments;

FIG. 37 is a schematic partial cross-sectional view of a dispenser according to possible embodiments;

FIG. 38 is a partial schematic perspective view of a fixed part of a dispenser according to possible embodiments;

FIGS. 39-40 are schematic perspective views of a dispenser according to possible embodiments;

FIGS. 57 and 58 are schematic perspective views of a bottom area of a part of a dispenser, equipped with a sensor device according to possible embodiments, FIG. 58 being in partial cross section;

FIG. 59 is a schematic perspective view of a body of a sensor device that equips the dispenser of FIGS. 57-58;

DESCRIPTION OF PREFERRED EMBODIMENTS

Figure 3:
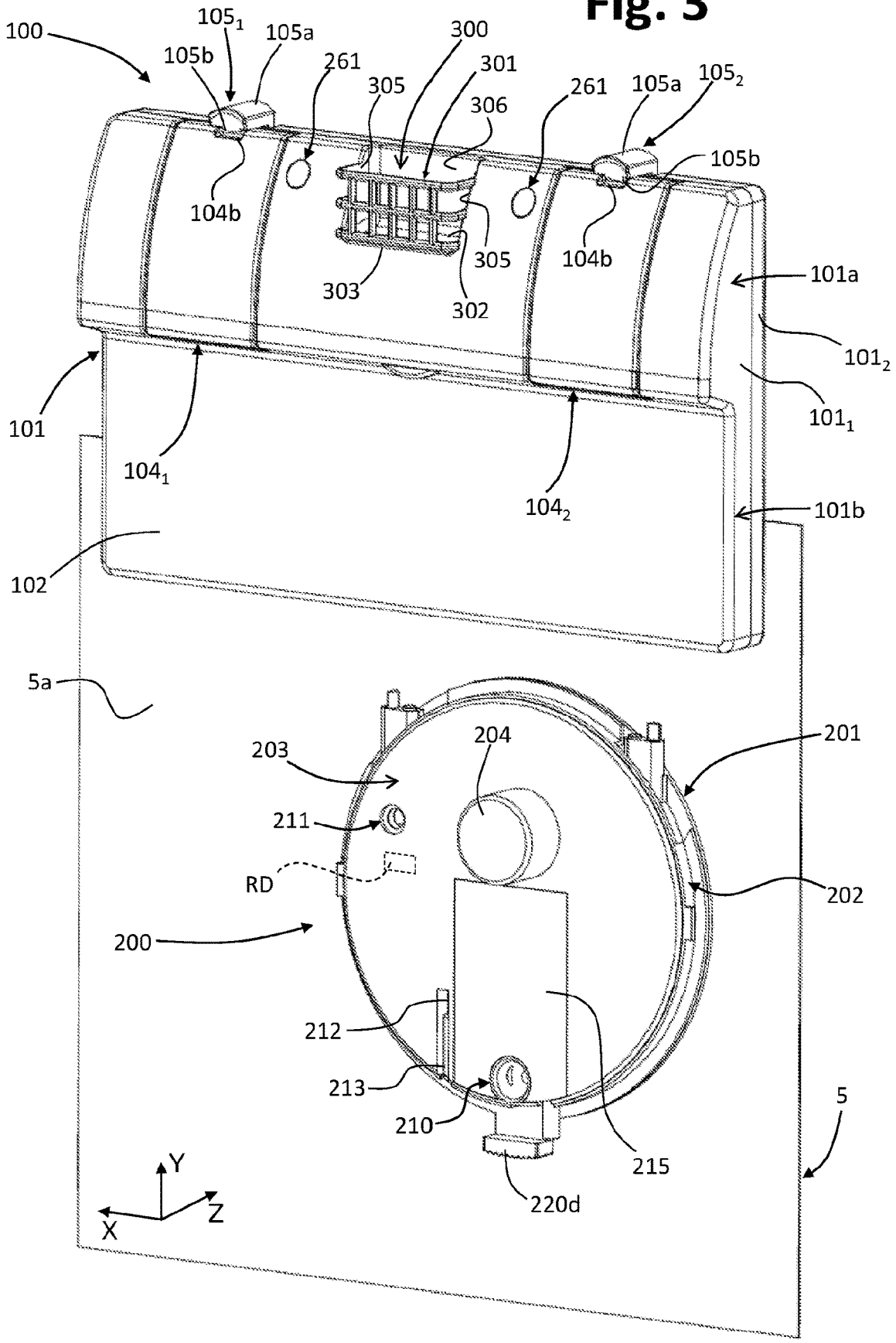
FIGS. 3 and 4 are schematic perspective views of two parts of a dispenser according to possible embodiments, corresponding, respectively, to an outer side and an inner side of the tub wall illustrated in FIG. 2.

Reference to "an embodiment" or "one embodiment" in the framework of the present description is intended to indicate that a particular configuration, structure, or characteristic described with reference to the embodiment is comprised in at least one embodiment. Hence, phrases such as "in an embodiment", "in one embodiment", "in various embodiments", and the like that may be present in various points of this description, do not necessarily refer to one and the same embodiment. Moreover, particular conformations, structures, or characteristics defined in the framework of the present description may be combined in any adequate way in one or more embodiments, even different from the ones represented. The reference numbers and spatial references (such as "upper", "lower", "top", "bottom", etc.) used herein are provided merely for convenience and hence do not define the sphere of protection or the scope of the embodiments. Where not otherwise specified, in the description and in the ensuing claims, the term "detergent" is intended to designate a detergent substance to be used during washing steps in a strict sense of an operating program of a dishwashing machine, i.e., steps aimed mainly at removal of dirt from the dishes, whereas the term "additive" is intended to designate an accessory liquid or semisolid substance, used in steps different from the washing steps or in purposely provided programs, such as a rinsing additive (or brightener), or a perfuming substance, or a water-softening substance, or a hygienizing substance; the term "washing agent" is intended to designate indifferently the detergent substance or the accessory substance. Where not otherwise specified, the term "liquid", when associated to terms such as "detergent", "additive", "washing agent" (single and plural), is intended in any case to designate—in addition to a liquid substance—also a semiliquid/semisolid substance, such as a gel.

In the figures, the same reference numbers are used to designate elements that are similar or technically equivalent to one another. In various figures, the representation of some components is omitted, when these are not necessary for understanding specific characteristics described with reference to the aforesaid figures; for this reason, for example, in various figures connection leads that belong to electrical parts of the dispenser, in particular to its sensors and actuators, are not represented.

Shown schematically in FIG. 1 is a household dishwasher, designated as a whole by 1, equipped with a dispenser of at least one washing agent, which is obtained according to possible embodiments. In the case exemplified, the machine 1 is intended for washing dishes so that in what follows reference will be made for simplicity to a dishwashing machine, without prejudice to the fact that the invention may be applied also to other types of washing machines, such as laundry washing machines and washerdryers, in which case the dispenser could be located differently according to the type of machine (top-loading or front-loading machine).

The dish-washing machine 1 has a cabinet or structure 2 defining inside it a washtub or washing chamber 3. Designated as a whole by 4 is a front door of the dish-washing machine 1, associated to the cabinet 2 so that it can be moved between an open position and a closed position. In various embodiments, such as the one exemplified, the door 4 can be moved angularly between the aforesaid positions, preferably but not necessarily about a substantially horizontal axis. The dish-washing machine 1 could, however, be of some other type, for example, with at least one door that can translate or slide on purposely provided guides, for example, as in FR-A-2.674.426 A, or else with a rack for containing the dishes configured as a sliding tray, the front wall of which forms a door of the machine, for example, as in WO9833426 A.

The inner face of the door 4 includes a movable tub wall 5 (also known as "counter-door"), having an outer side 5*a* that constitutes the front surface of the tub 3. The tub 3 is also delimited by a plurality of fixed tub walls, one of which designated by 6, which typically comprise two side walls, a rear wall, an upper wall or roof, and a lower wall or bottom. In various embodiments, the walls that delimit the tub 1 are plate-like walls, made at least in part of sheet metal, such as stainless steel. Not excluded, however, from the scope of the invention is the case of walls made at least in part of plastic material, for example, via injection moulding of a thermoplastic material.

In various embodiments, mounted on one of the walls that delimit the tub 3—here the wall 5—is a dispenser of washing agents, designated as a whole by 10 and represented only schematically in FIG. 1, obtained according to possible embodiments of the invention. Preferentially, the dispenser 10 is mounted at at least one through opening defined in the mounting wall 5. The dish-washing machine 1 comprises all the elements normally known for its operation, which are irrelevant for the purposes of the invention and will hence not be described herein, amongst which a hydraulic circuit including a sprinkling system, at least one dish rack in the tub, and a control system that superintends operation of the machine. In the case of FIG. 1, the control system is only represented schematically and designated by CS, and comprises, for example, a controller or control card, preferably including an electronic microcontroller, which can be located inside the door 1.

Installation of the dispenser 10 on the wall 5 of the door 4 is to be understood as being provided merely by way of example in so far as, in other embodiments, the dispenser 10 can be installed on any of the walls of the tub 3, including a stationary wall, such as the side wall designated by 6. Consequently, what is described hereinafter regarding installation of the dispenser 10 on the wall 5 is to be understood as exemplifying also installation of the dispenser 10 on any other wall of the tub 3, in particular a fixed vertical wall thereof. The side 5*a* defined herein as "outer" side of the mounting wall 5 of the dispenser 10 (whether this is a movable wall or a fixed wall) indicates the surface of the wall that faces the inside of the tub 3, whereas the side defined herein as "inner" side (hereinafter designated by 5*b*) indicates the surface of the wall itself opposite to the outer side 5*a*, for example, corresponding to the inner side of a gap of a wall of the machine.

In various embodiments, the dispenser, i.e., its body as a whole, comprises at least two main functional parts, amongst which at least one first removable part that is configured so that it can be coupled in a releasable way to at least one second part, which is fixed on the mounting wall 5, in particular at the aforesaid through opening. Each of the two main parts of the dispenser body in turn comprises a number of elements, described hereinafter. In FIG. 2 the dispenser 10 is illustrated in an assembled operating condition with respect to the wall 5, with the removable dispenser part coupled on the fixed dispenser part. The dispenser body as a whole has a width dimension X, a height dimension Y, and a depth dimension Z, the latter dimension being identified by a front and a back of the body of the dispenser 10, its front being the one that is designed to be exposed or faces the inside of the tub 3 of the dish-washing machine.

Figure 4:
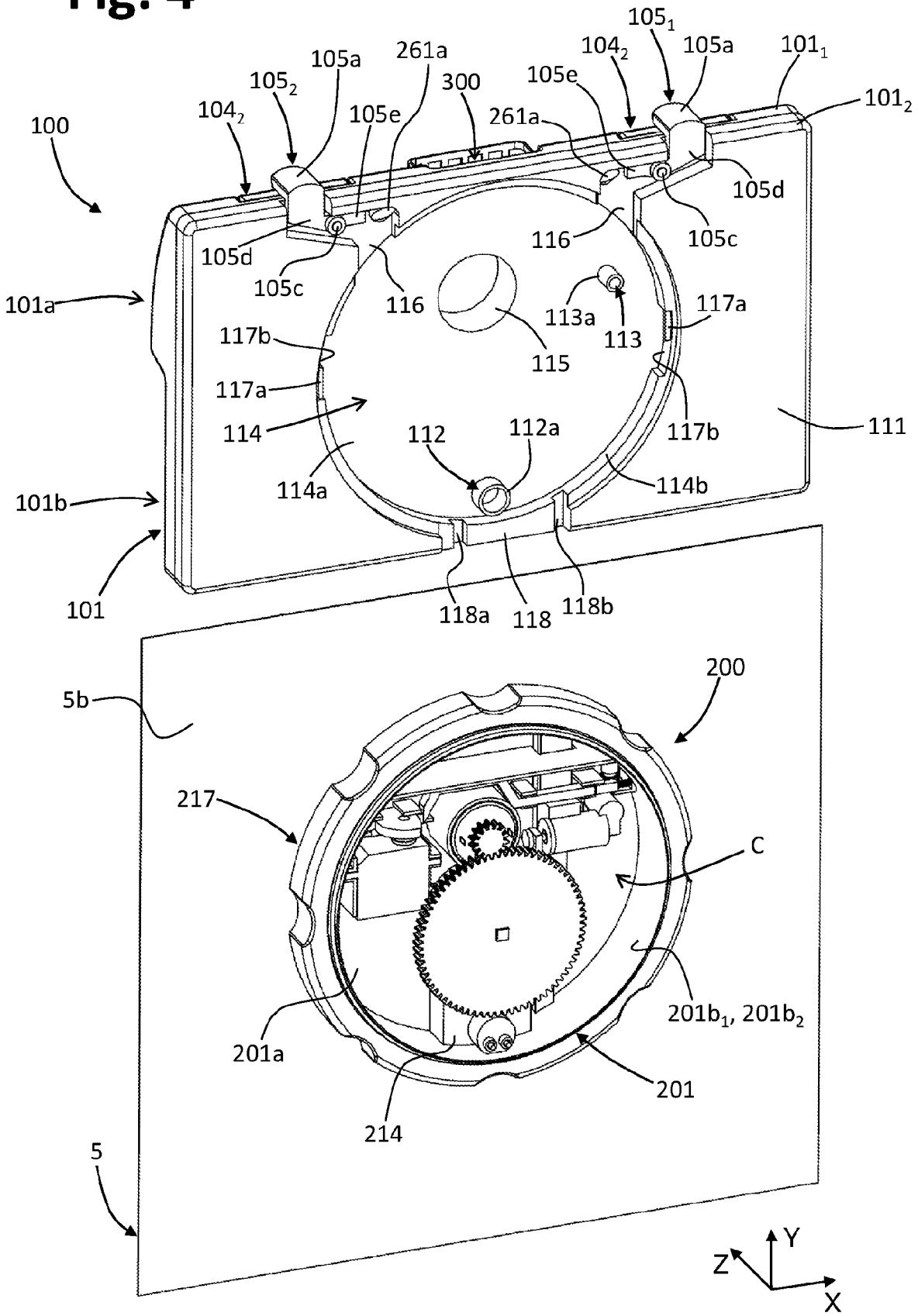

The removable dispenser part and the fixed dispenser part, which form as a whole the dispenser body, are designated, respectively, by 100 and 200 in FIGS. 3 and 4, where they are illustrated in a condition where they are uncoupled with respect to the outer side 5*a* and the inner side 5*b* of the wall 5, respectively. The parts 100 and 200 are visible in isolation in FIGS. 5 and 11, in front perspective view.

With reference in particular to FIGS. 3 and 5, the removable dispenser part 100 comprises a hollow body 101 that mainly performs functions of tank for at least one washing agent in liquid or semisolid form (i.e., in the form of gel). In various preferential embodiments, the hollow body 101 defines inside it at least two tanks, designated as a whole in FIG. 2 by R1 and R2, each for a respective washing agent of the type referred to. In what follows, it is assumed that the tank R1, of greater capacity, is designed to contain a washing detergent, whereas the tank R2 is designed to contain a rinsing additive, in particular a brightener. The tank R2 could on the other hand be designed to contain a different accessory substance, for example, a perfuming substance, or a water-softening substance, or a hygienizing substance. It should in any case be noted that the removable dispenser part 100 could include a single tank, or else three or more tanks, for further washing agents. The at least one tank R1 and/or R2 is preferably of a multi-dose type, i.e., one that is able to contain an amount of the corresponding washing agent sufficient for executing a plurality of operating programs of the dish-washing machine 1.

It should be noted that the terms "removable part" or "tank", when referred to the component designated as a whole by 100, are understood to designate a rechargeable component that stably equips the dispenser, constituting an essential part thereof, and that is provided with at least one loading passage provided with a respective removable closing means to enable a user to top it up periodically. The body part 100 does not hence represent a disposable component, such as a cartridge previously filled with the washing agent in the production stage and marketed in this ready-to-use version, which typically presupposes perforation or tearing of its body for the purposes of use, and then disposal thereof when it is empty.

The hollow body 101 is preferentially made of plastic material, for example, a thermoplastic material. In various embodiments, the body 101 is made up of at least two pieces or parts sealed together, for example, a front piece $\mathbf{101}_1$ and a rear piece $\mathbf{101}_2$. The body pieces $\mathbf{101}_1$ and $\mathbf{101}_2$ may, for example, be moulded using thermoplastic material and sealed together at corresponding interface surfaces, for example, welded using a hot-blade system.

In various embodiments, identified in the hollow body 101 are an upper portion 101*a*, that is as a whole deeper (dimension Z) and shorter (dimension Y), and a lower portion 101*b*, that is as a whole thinner (dimension Z) and taller (dimension Y). The two portions 101*a* and 101*b* may have the same width (dimension X). The fact that the portion of the hollow body 101 having a larger surface (i.e., the lower portion 101*b*) is thinner enables limitation of the front dimensions of the dispenser 10, in particular when it is on the door 4 of the dish-washing machine. In this way, for example, the dispenser 10 can advantageously be mounted in a position of the tub wall 5 such that—with the door closed—only the lower portion 101*b* will come to be located in front of a dish rack housed in the tub 3, thus preventing the need to provide shorter racks and hence ones that have a smaller loading capacity. The presence of a deeper upper portion 101*a* may prove convenient to facilitate definition of a loading passage for topping-up of the corresponding tank with the washing agent, with a corresponding closing element that is operable by a user, such as a plug or a hatch.

Both of the portions 101*a* and 101*b* are hollow, at least for a substantial part thereof. Preferentially, the maximum depth (dimension Z) of the hollow body 101 in each area thereof is smaller than its width (dimension X) and its height (dimension Y). Once again preferentially, the height (dimension Y) of the hollow body 101 is smaller than its width (dimension X). Obviously, these relative dimensions could be different, for example, according to the loading requirements and/or the position of installation of the dispenser.

As has been said, in various embodiments, the at least one tank R1 and/or R2 of the removable dispenser part 100 has a respective loading passage, i.e., a respective passage for filling the respective tank, associated to which is a suitable closing element that can be opened and closed by a user, such as a plug or, as in the examples illustrated, a hatch. It is possible to provide also a plug in an area subtended by a movable hatch.

With reference in particular to FIG. 5, in the non-limiting example illustrated, both of the tanks R1, R2 have a respective loading passage, designated as a whole by 103, which includes a through opening 103*a* in the front wall 102 of the hollow body 101. In the example, the opening 103*a* is defined at a bottom of the passage 103, preferably shaped as a substantially cylindrical recess.

Once again with reference to the example of FIG. 5, associated to each loading passage 103 is a corresponding closing element, here constituted by a hatch $\mathbf{104}_1$, $\mathbf{104}_2$, for example, made of moulded plastic material. In the example, each hatch $\mathbf{104}_1$, $\mathbf{104}_2$ is hinged to the hollow body 101 in order to be able to move angularly between an open position (FIG. 5), to enable access to the corresponding loading passage 103 for the purposes of topping-up of the corresponding tank R1 or R2 with the washing agent, and a closed position (FIG. 3), where the corresponding loading passage 103 is closed by the hatch. As has been said, there could also be associated to the passage 103 a plug, in addition to the hatch.

In the example, each hatch $\mathbf{104}_1$, $\mathbf{104}_2$ is hinged, in a lower region thereof (with reference to the dimension Y), to the hollow body 101, but this does not constitute an essential characteristic: at least one hatch could be hinged in a side region thereof, or else it could be a hatch of a type that slides in a direction transverse to the corresponding loading passage, according to known technique in the field of dispensers for dish-washing machines. Designated by 104*c* in FIG. 6 are parts of the hinging means of the hatches $\mathbf{104}_1$, $\mathbf{104}_2$.

Preferentially, when the hatch operates directly as closing element, between the hatch itself and the corresponding loading passage sealing means are provided, which are able to co-operate when the hatch is in the closed position. In the example of FIG. 5, each loading passage 103 has an edge in relief 103*b*, preferably having a circular profile, upon which a corresponding gasket 104*a* made of elastomer can bear at the front in order to obtain a seal. Preferentially, the gasket 104*a* is mounted in a corresponding seat defined in the inner side of the corresponding hatch $\mathbf{104}_1$, $\mathbf{104}_2$.

Once again preferentially, defined in the front of the hollow body 101 is a receiving seat, designated by 103*c* in FIG. 5, in particular in the form of a recess of the aforesaid front, in which the loading passage 103 is located. The seat 103*c* is configured to be occupied at least partially by the corresponding hatch $\mathbf{104}_1$, $\mathbf{104}_2$, when the latter is in the respective closed position.

In various embodiments, the dispenser is mounted on a tiltable door of the dish-washing machine, and associated to the at least one tank is a system for taking in the respective washing agent that bases its own operation on the movements of the door. Such an intake system is preferably associated to the tank of smaller capacity R2, which is in any case able to contain an amount of washing agent sufficient for execution of a number of treatment programs performed by the dish-washing machine 1. In this perspective, in various embodiments defined in the tank R2 is a sub-chamber or intake volume, which is able to contain at least one amount of the washing agent sufficient to execute a single treatment program. The intake system comprises, or has associated to it, valve means, which include, in particular, an open/close element operating at the corresponding outlet passage of the washing agent. The aforesaid valve means can be controlled to enable outflow of at least one dose of washing agent coming from the intake volume towards the inside of the washtub 3 of the dish-washing machine 1, through the outlet passage referred to previously. In various embodiments, the intake system is devised so that, when the door 4 of the dish-washing machine 1 is brought into the substantially horizontal open position, the intake volume is filled by a corresponding part of the content of the tank R2, and when the door 4 is subsequently brought into the substantially vertical closed position, the intake volume is able to withhold the corresponding content, at least until activation of the aforesaid valve means.

Partially represented in FIG. 6 is a possible internal structure of the hollow body 101, in particular of its front body piece $\mathbf{101}_1$, where some of the elements belonging to the aforesaid intake system are visible.

Defined within the hollow body 101 is a first set of walls, designated as a whole by 106 (see also FIGS. 16-17), arranged so as to delimit the tank R2 within the internal volume of the hollow body 101, in fluid communication with the opening 103*a* of the corresponding loading passage 103: in the example illustrated, the remaining part of the internal volume of the hollow body 101 substantially forms the tank R1 of greater capacity. Visible in FIG. 6 is just part of the set of walls 106 defined integrally in the front body piece $\mathbf{101}_1$, but of course also the rear body piece $\mathbf{101}_2$ can define a respective part of said set of walls.

Likewise defined within the hollow body 101 is a second set of walls, designated as a whole by 107 (see also FIGS. 16-17), arranged so as to delimit, within the tank R2, an intake volume designated by R2*a*. The intake volume R2*a* is defined higher up than the bottom of the tank R2 (with reference to the height dimension Y) and is in fluid communication with a discharge outlet of the tank itself (in FIG. 6 the aforesaid outlet is not visible, but it is in a position corresponding to the valve member designated by $\mathbf{230}_2$, described hereinafter). The volume R2*a* is sized—in particular via an upper edge 107*a* thereof—so as to be able to contain a fraction of the washing agent contained in the tank R2, this fraction being preferably greater than a single deliverable dose of the aforesaid washing agent. FIG. 6 shows only part of the set of walls 107 defined integrally in the front body piece $\mathbf{101}_1$, but of course also the rear body piece $\mathbf{101}_2$ can define a respective part of the aforesaid set of walls.

The volume R2*a* is configured for being filled with the aforesaid fraction of the washing agent of the tank R2 when the plane of lie of the dispenser 10 is substantially horizontal (i.e., when the door 4 of the dish-washing machine 1 is open) and withholding the fraction itself when the plane of lie of the dispenser 10 is substantially vertical (i.e., when the door 4 of the dish-washing machine is closed), for the purposes of subsequent delivery, as described hereinafter. As has been mentioned, in the example represented, the level of filling of the intake volume is defined by an upper edge 107*a* of the second set of walls, which functions as overflow.

Figure 7:
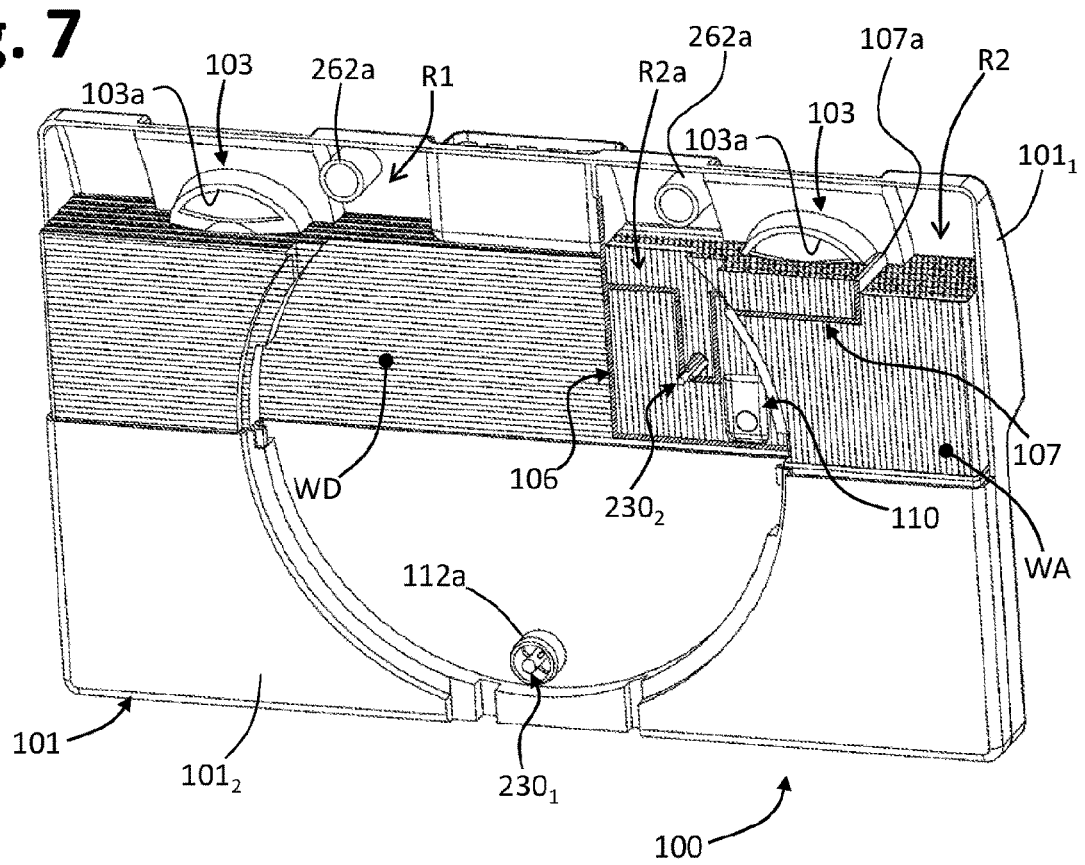
FIG. 7 is a partially sectioned perspective view of a hollow body belonging to a removable part of a dispenser according to possible embodiments, with possible levels of two different washing agents highlighted.

In the subsequent FIG. 7 the removable dispenser part 100, i.e., the hollow body 101, is illustrated partially sectioned, in the presence of a maximum level of the washing agents WD and WA contained in the tanks R1 and R2 (as has been said, the agent WD may be a washing detergent, whereas the agent WA may be a rinsing additive). From the aforesaid figure it may be noted how, after closing the door 4 of the dish-washing machine 1, i.e., when the hollow body 101 is moved from the horizontal position to the vertical position, the intake volume R2*a* is filled substantially up to the level determined by the upper edge 107*a* of the second set of walls 107.

Figure 8:
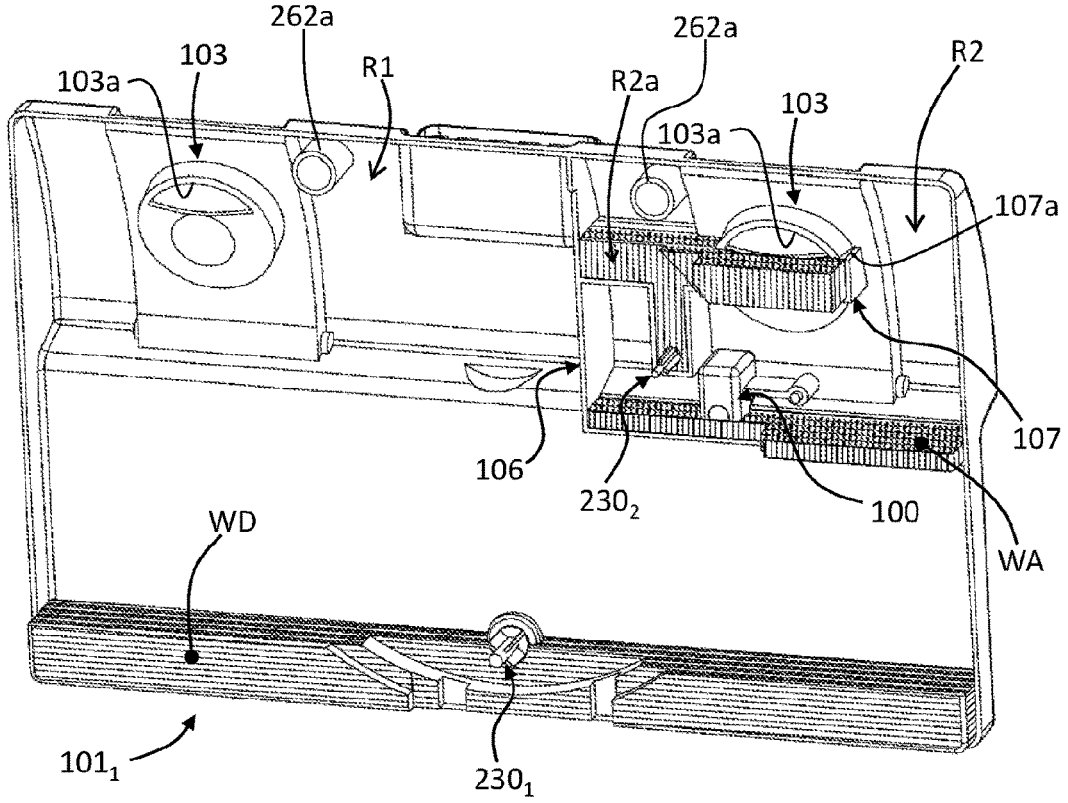
FIG. 8 is a view similar to that of FIG. 6, with possible levels of two different washing agents highlighted.

The next FIG. 8 shows just the front piece $\mathbf{101}_1$ of the hollow body 101, in the presence of a minimum level of the washing agents WD and WA contained in the tanks R1 and R2 (the representation of the washing agents WD and WA is here merely illustrative, aimed only at exemplifying the condition discussed). As may be appreciated, albeit in the presence of a minimum level of the washing agent WA, also in the case represented, displacement of the door 4 from the horizontal opening position to the vertical closing position brings about filling of the intake volume R2*a* substantially up to the level of overflow defined by the upper edge 107*a* of the second set of walls 107. In this way, a constant filling of the intake volume R2*a* is guaranteed, substantially up to the level of overflow, both in the case minimum level and in the case of maximum or intermediate level of the washing agent WA in the respective tank R2.

Also visible in FIGS. 6-8 is part of a sensor, which, in various embodiments, it can be used for signalling the possible drop in the level of the washing agent WA below a pre-set minimum value.

With reference in particular to FIG. 6, the sensor comprises a floating body 110 constrained within the tank R2 so as to carry out displacements that are a function of the level of the liquid agent WA. In the example, the floating body 110 is hinged to a pin 110*a*, for example, defined integrally by the front piece $\mathbf{101}_1$ of the hollow body 101, so as to be able to oscillate between a raised position, represented in the figures, and a lowered position. Of course, the floating body 100 could be constrained in some other way, for example, for being linearly slidable in the direction of height of the dispenser (dimension Y), for example, via purposely provided lateral guides defined in the hollow body 101.

There may be associated to the floating body 110 an element 110*b* for excitation of an electrical detector, set on the outside of the hollow body 101, in particular mounted on the fixed dispenser part 200 in a position to which the floating body 110 will come to correspond when the removable dispenser part 100 is mounted on the fixed dispenser part 200. Such a detector is designated by RD only in FIG. 3 and is represented in a position set behind a wall of the front of the fixed dispenser part 200. In the example, it may be assumed that the excitation element 110*b* is a magnetic element, and that the corresponding detector RD on the outside of the hollow body 101 is a detector of magnetic field, in particular a Hall-effect detector, or a contact or magnetic switch, for example, of a reed type. Of course, for such a case the walls of the hollow body 101 and of the front of the fixed dispenser part 200 that are set between the floating body 110 and the detector RD are made of a material permeable to the magnetic field generated by the excitation element 110*b*.

When an amount of washing agent WA higher than a pre-set minimum level is present in the tank R2, the floating body 101 remains in its raised position, consequently exciting (or not exciting) the corresponding external electrical detector RD. Instead, when the amount of the washing agent WA drops below the aforesaid pre-set minimum level, the floating body 110 is brought to assume the corresponding lowered position, consequently no longer exciting (or starting to excite) the corresponding external electrical detector RD. The information on the level thus generated by the level sensor 110-RD may, for example, be used for activating a warning system, aimed at alerting a user of the dish-washing machine 1 to the need for topping-up of the tank R2 with the washing agent WA. After such a topping-up, of course, the floating body 110 will return to the respective raised position, thus causing the warning signal to cease.

Of course, the principle of detection of the displacement of the floating body 110 may be different from the one based upon detection of a magnetic field; for example, it may be a detection of an inductive or optical type (for example, the wall of the hollow body 101 that separates the floating body 110 from the corresponding external electrical detector may be transparent to optical radiation, at least in an area corresponding to the floating body, and the wall of the front of the fixed dispenser part 200 located behind which is a detector RD of an optical type is likewise transparent or has a transparent window, at least in an area corresponding to the detector).

It is clear that a floating system of the above sort can be used also for the tank R1. Measurement of the level in the tank R1 and/or R2 could be made using other detection techniques, such as a system based upon the use of an optoelectronic sensor, including a light emitter and a light receiver. In the case of a dispenser according to possible embodiments of the invention, such an optoelectronic sensor can be set on the fixed dispenser part 200 (for example, in a position corresponding to a transparent window provided in the front of the part 200) so that, when the removable dispenser part 100 is in the respective operating position, the optoelectronic sensor is in a position facing an optical prism defined by a transparent wall of the hollow body 101 (for example, its rear wall) that delimits a side of the corresponding tank R1 and/or R2. For instance, when the prism is immersed in the liquid washing agent, the light beam emitted by the emitter is in part reflected and in part refracted at the inclined walls of the prism immersed in the liquid, not reaching the receiver, or reaching it with limited intensity: in this way, the presence of the liquid washing agent at a level corresponding to the position of the sensor can be inferred. Instead, in the case where the prism is not immersed in the liquid washing agent, the light beam will be substantially completely reflected at the inclined walls of the prism, reaching the receiver, or reaching it with high intensity: in this way, the absence of the liquid washing agent at a level corresponding to the position of the sensor can be inferred.

In various embodiments, in which the removable dispenser part is provided with at least one hatch, the dispenser comprises at least one corresponding latching/releasing device, which can be switched manually between a latching position and releasing position, to enable displacement of the hatch itself between the closed position and the open position. For this purpose, there may also be a spring or similar elastic element associated to the hatch, according to a technique in itself known, operative for urging the hatch itself towards the respective open position.

In the example of FIGS. 3 and 5, associated to each hatch $\mathbf{104}_1$, $\mathbf{104}_2$ is a corresponding latching/releasing device $\mathbf{105}_1$, $\mathbf{105}_2$, respectively. The two devices designated by $\mathbf{105}_1$, $\mathbf{105}_2$ preferentially have a similar structure and are mounted in a substantially specular way with respect to one another.

In various embodiments, as in the example of FIGS. 3 and 5, the at least one latching/releasing device $\mathbf{105}_1$, $\mathbf{105}_2$ is mounted on the hollow body 101, in particular so as to have an accessible portion, designated by 105*a*, which is manually operable, for example, displaceable with an angular movement. In the example, the portion that is operable projects beyond the upper edge (with reference to the dimension Y) of the hollow body 101, and the device $\mathbf{105}_1$, $\mathbf{105}_2$ is mounted at the back of the hollow body 101.

Preferentially, the operable portion 105*a* defines, or has associated to it, a latching element 105*b*, which is able to co-operate with the corresponding hatch in order to keep it in the closed position. In the example illustrated, for this purpose, the body of the hatch $\mathbf{104}_1$ and/or $\mathbf{104}_2$ defines a seat 104*b*, in an area thereof opposite to the hinging side, where the engagement element 105*b* engages when the corresponding hatch is closed (see FIG. 3).

In various embodiments, the at least one latching/releasing device $\mathbf{105}_1$ and/or $\mathbf{105}_2$ basically consists of a lever element, which is hinged to turn about a respective axis that substantially extends in the depth direction (dimension Z) of the dispenser 10. As may be seen, for example, in FIG. 4, the axis of rotation can be defined by a pin 105*c* defined or associated to the back of the hollow body 101, and the lever element $\mathbf{105}_1$ and/or $\mathbf{105}_2$ comprises a lever arm 105*d* that defines or has associated thereto the operable portion 105*a*, with the corresponding latching element 105*b* (FIGS. 3, 5). There can also be associated to the lever element $\mathbf{105}_1$ and/or $\mathbf{105}_2$ a spring or similar elastic element, according to a technique in itself known, operative for urging the element itself towards the respective latching position relative to the corresponding hatch $\mathbf{104}_1$ and/or $\mathbf{104}_2$.

In various embodiments, the lever element $\mathbf{105}_1$ and/or $\mathbf{105}_2$ is substantially in the form of a first-class lever, and hence also has another lever arm 105*e*, which extends at the part generally opposite to the lever arm 105*d*. The function of this possible further lever arm 105*e* will be explained hereinafter in relation to a locking/unlocking arrangement that can equip the dispenser according to various embodiments.

In various embodiments, defined in the front of the dispenser body is a housing, configured to receive a tablet including one or more washing agents, and hence also tablets of the type known as "two-in-one" or "three-in-one". The term "tablet" is intended to designate both tablets in solid form and tablets—also known as "tabs" or "pods"—of the type in which one or more washing agents in liquid or semisolid form are enclosed in a casing consisting of a water-soluble film (typically a polymer, such as polyvinyl acetate—PVA).

The housing referred to is directly exposed as a whole, at the front of the dispenser, i.e., without hatches or similar movable closing elements. The housing has a front containment portion that is directly exposed at the front of the dispenser body, and has a bottom that extends in a direction transverse to the height dimension Y and that has at least one drainage passage. Preferentially, the at least one drainage passage is defined between the front containment portion and the bottom of the housing. Once again preferentially, the front containment portion has a perforated structure, i.e., defining one or more openings, for example, a grid structure.

In various embodiments, the containment portion defines a front of the housing and, preferentially, also at least part of at least one of two opposite lateral sides of the housing. Preferentially, the housing has an upper opening, i.e., generally opposite to the bottom, configured to enable insertion of a tablet in the housing itself. This facilitates considerably loading and dissolving of a tablet.

Figure 18:
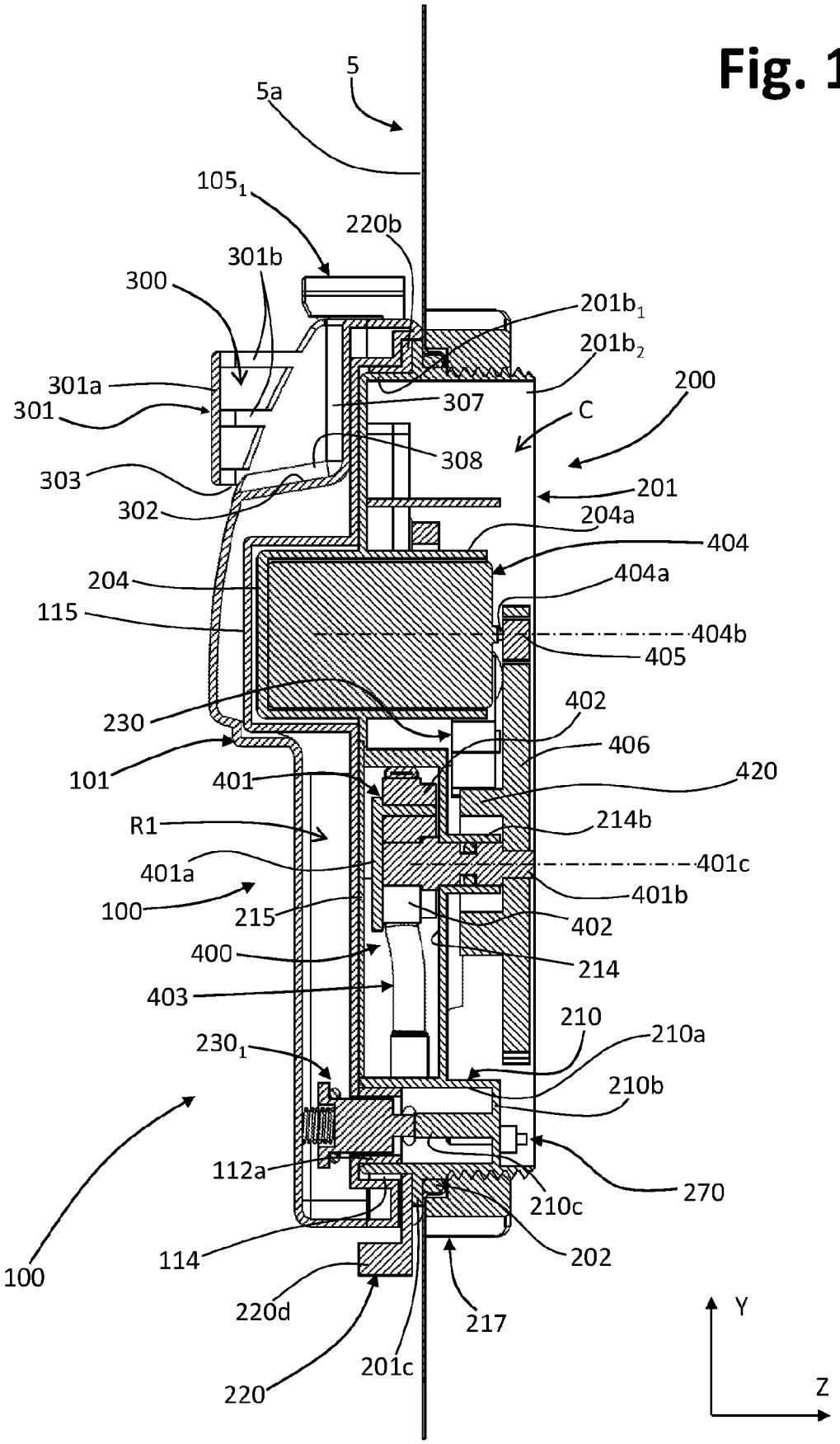
FIG. 18 is a schematic vertical cross-sectional view of a dispenser according to possible embodiments.

Such a housing is designated by 300 in FIGS. 2-5, whereas designated by 301, 302 and 303 are the respective front containment structure, the respective bottom, and a respective drainage channel (see also FIG. 18). A tablet of one or more washing agents is exemplified only in FIG. 5, where it is designated by T. In the example, the housing 300 is open at the top, to enable convenient insertion of the tablet T.

As may be appreciated, a tablet T can be inserted in the housing 300 prior to execution of a washing program. In the course of this program, part of the water sprayed into the tub 3 of the dish-washing machine 1, for example, by means of a known rotating-sprinkler system, can reach the housing 300, favouring dissolving of the tablet T and outflow of the corresponding mixture of water and washing agent towards the inside of the tub 3. This effect is made possible by the presence of the at least one drainage passage 303, defined between the front containment portion 301 and the bottom 302.

The effect of dissolving the tablet T and pouring the washing agent into the tub is further favoured by the presence of the front containment portion 301 provided with openings, preferably comprising an alternation of full and empty spaces, such as a substantially grid-like structure, as in the case exemplified. The presence of one or more openings at the front of the housing 300 facilitates the passage of the water sprayed at inlet and of the water-detergent mixture at outlet. One or more jets of water can also arrive with a certain energy at the opening or openings of the portion 301, hitting directly part of the tablet T with a certain energy, which favours dissolving thereof. In various embodiments, a rotating sprinkler of the dish-washing machine 1 can be pre-arranged for directing at least one jet of water to a height corresponding to that of the housing 300 (for this purpose, a thrust nozzle of the sprinkler could, for example, be used). Obviously, it is also possible to equip the hydraulic system of the dish-washing machine with a purposely provided fixed nozzle in order to direct a jet of water towards the housing 300.

Of course, the jets of water can strike the tablet T directly via the upper opening or at the top of the containment portion 301, when this forms a sort of "parapet" for the tablet itself. In other words, the front containment portion can have a height (dimension Y) even smaller than the overall height of the housing 300 or of the tablets of various shapes that it can receive, and in particular a height sufficient to withhold effectively a tablet T within the housing 300 notwithstanding the typical vibrations of the dish-washing machine 1 during operation and notwithstanding the energy of the possible incident jets of water. The withholding function is performed by the portion 301 also in the course of the movement of closing and engagement of the door 3 of the dish-washing machine 1, when the dispenser 10 is mounted on the wall 5.

The presence of one or more drainage passages 303 between the containment portion and the bottom 302 is likewise aimed at enabling outflow of the water and/or of the mixture of water and washing agent from the housing 300 in order to prevent any stagnation inside the housing itself. For this purpose, in various preferential embodiments, the bottom 302 of the housing 300 extends generally inclined downwards from its back towards its front (see also FIG. 18). The bottom 302 can be made inclined in the production stage, or else its inclination can be obtained by mounting the dispenser 10 on the corresponding mounting wall 5.

The bottom 302 is preferably defined by a non-perforated surface of the dispenser body. In the bottom 302 there may possibly be defined reliefs, which extend in the dimension Y for localized resting of the tablet T, and/or recesses, which extend in the dimension Z in order to obtain drainage channels. The bottom 302 itself could have a structure with one or more through openings or drainage passages: in embodiments of this sort, the bottom 302 may hence be in the form of a substantially cantilever wall, and possibly, the front of the hollow body 101 may be shaped so as to define a sort of chute underneath a bottom wall of this sort in order to favour outflow of the mixture of water and washing agent into the tub 3.

In various embodiments, the containment portion 301 defines at least one front of the housing 300. In various preferential embodiments, the containment portion 301 defines at least part of one of two opposite lateral sides of the housing. In the example illustrated, the portion 301 defines both the front and part of both of the lateral sides of the housing, such a part being designated by 304 in FIG. 5. Once again with reference to the example illustrated, both the front and the part 304 of the sides have a perforated structure, which makes it easier for the water sprayed into the tub 3 to reach the inside of the housing 300 and for the mixture of water and washing agent to flow out into the tub 3. In possible variants only the front or only the parts 304, or at least one of them, could be perforated.

At least one part of the two opposite sides of the housing 300 can be defined by respective non-perforated surfaces of the dispenser body, i.e., of the hollow body 101, in the example. In the example, these non-perforated lateral surfaces are designated by 305 in FIG. 3. Likewise, also the back of the housing 300 can be defined by a non-perforated surface 306 of the dispenser body, here the removable dispenser part 100, i.e., its hollow body 101. Preferentially, the non-perforated surface 306 that defines the back and the non-perforated surfaces 305 that define part of the sides are radiused together and/or with respect to the surface that defines the bottom 302 via radiused or inclined surface portions in order to favour further outflow of the liquid (two of said radiused portions are visible in FIG. 18, designated by 307 and 308).

Preferentially, the housing is defined integrally by a part of the dispenser body 10, here the removable dispenser part 100, i.e., its hollow body 101. However, in possible variants, the housing may be at least in part defined by walls or a structure associated to the dispenser body 10, such as a perforated or grid-like structure moulded separately and then fixed to the dispenser body 10, for example, via slotting, hooking, or welding.

In various preferential embodiments, the perforated structure of the front containment portion 301 (and/or of the bottom 302) is formed by one or more transverse parts (i.e., ones that extend according to the dimension X) and/or by one or more upright parts (i.e., ones that extend according to the dimension Y). In the case where both transverse parts and upright parts are provided, these can be connected together or cross over one another. This type of embodiment makes it easier to produce the housing 300 via moulding of the dispenser body, at the same time making it possible to obtain a robust structure distinguished by sufficiently wide empty areas, preferably a substantially grid-like structure.

The aforesaid transverse and upright parts—some of which are designated in FIG. 18 by 301*a* and 301*b*, respectively—are preferably in the form of small rods or bars. More in general, the structure described for the housing 300 and/or for the front containment portion 301 as a whole makes it possible to obtain these elements via moulding of plastic material, preferably of a single piece with the corresponding part of the dispenser body, without requiring fixing of separate parts.

Obviously, the front containment portion could have a structure different from the one exemplified, without prejudice to its function of withholding the tablet T within the housing and facilitating passage of the water and outflow of the mixture of water and washing agent. In possible variant embodiments, the front containment portion, preferably comprising at least part of at least one of the lateral sides of the housing, is partially obtained via moulding of plastic material, and subsequently associated or welded to the corresponding part of the dispenser body in which the remaining part of the housing is defined.

Once again preferentially, the housing 300 is defined in an upper region of the dispenser body, here the removable dispenser part 100, i.e., its hollow body 101, in particular with the corresponding upper opening for loading the tablet T closer to the upper edge (with reference to the dimension Y) of the dispenser body; however, the housing 300 could also be defined in a lower region of the dispenser body 10.

If at the front of the dispenser body two loading openings 103 are provided, with corresponding closing elements, such as the hatches $\mathbf{104}_1$, $\mathbf{104}_2$ of the case exemplified, the housing 300 is preferentially defined in an intermediate position between them, and in any case in a position such as not to constitute a hindrance to their displacements; however, the housing 300 could also be defined in a lateral region of the dispenser body 10.

Of course, the shape and position of the housing 300, as well as the shape of the tablet T, can vary from what is illustrated by way of example. In general terms, the housing will have dimensions such as to be able to receive and effectively withhold tablets of various shapes and dimensions, as are available on the market, without necessarily involving a pre-set direction of introduction. Indicatively, the housing 300 may have a useful width (dimension X) comprised between 50 and 60 mm, a useful depth (dimension Z) comprised between 20 and 30 mm, and a height (dimension Y) of the grid structure 301 comprised between 30 and 40 mm.

The presence of the housing 300 enables use of tablets T in combination with the dispenser 10, without, however, having to equip the latter with a specific compartment closed by a hatch with associated thereto a corresponding automatic opening system, as occurs, instead, in traditional dispensers for dish-washing machines, where a compartment for containing a dose of a washing agent in powder form, provided with a hatch of its own having associated thereto an electrically controlled opening system has to be used to contain the tablet.

As has already been mentioned, in various embodiments, the at least one tank R1 and/or R2 provided in the removable dispenser part 100 has a respective outlet, defined at the back of the hollow body 101.

Visible in FIG. 4 is a rear wall of the hollow body, designated by 111, which defines the back thereof, whereas designated by 112 and 113 are the outlets of the tank R1 and R2. Preferentially, each outlet 112, 113 is defined in a generally lower position (with reference to the dimension Y) of the corresponding tank. Once again preferably, each outlet 112, 113 is defined at least in part by a tubular duct 112*a*, 113*a*, preferably having a cylindrical cross section, which can couple with a corresponding inlet, which preferably also includes a tubular duct of congruent section, provided at the front of the fixed dispenser part 200.

In various embodiments, the back of the removable dispenser part 100, i.e., of the hollow body 101, is shaped so as to be able to couple with, or receive, at least a corresponding portion of the front of the fixed dispenser part 200. In addition and/or as an alternative, the front of the fixed dispenser part 200 can be shaped so as to be able to couple with, or receive, at least a corresponding portion of the back of the removable dispenser part 100.

For instance, with reference once again to FIG. 4, the rear wall 111 of the hollow body 101 is shaped so as to define a seat or recess 114, having a bottom surface 114*a* and a peripheral surface 114*b*; in the example, the recess 114 has a generally circular shape, with the bottom surface 114*a* that is substantially circular and the peripheral surface 114*b* that is substantially cylindrical. As will be seen, the recess 114 can be occupied at least partially by the front of the fixed dispenser part 200, in particular in order to reduce the overall dimensions in the direction Z and/or in order to improve the coupling between the parts and/or in order to facilitate a user in repositioning the removable part on the fixed part. The two outlets 112 and 113 can be defined on the bottom surface 114*a* of the recess 114 and project therefrom.

The rear wall 111 of the hollow body 101 can be conveniently shaped to house at least partially a component of the fixed dispenser part that is particularly cumbersome in the depth dimension Z. For instance, once again with reference to FIG. 4, designated by 115 is a seat or recess of the rear wall 111 (which also has a bottom surface and a peripheral surface, not indicated) that is designed to receive partially a housing having a corresponding section, which is defined in the front of the fixed dispenser part 200 and partially housed in which is an actuator device, such as an electric motor (see also FIG. 18, where a motor is designated by 404 and the corresponding housing is designated by 204-204*a*). The recess 115 can be defined on the bottom surface 114*a* of the recess 114; the recess 115 can hence also project towards the inside of the volume defined by the hollow body 101, beyond the recess 114.

In the rear wall 111 of the hollow body 101 there may be defined one or more further seats or recesses suitable for receiving corresponding parts of the front of the fixed dispenser part 200. For instance, once again with reference to FIG. 4, designated by 116 are two shaped seats or recesses, preferably located in the upper part, which are to receive at least some respective parts of a locking/unlocking arrangement that, in possible embodiments, is mounted on the dispenser 10. In the example, each recess 116 extends from the peripheral surface 114*b* of the recess 114 as far as the upper edge of the hollow body 101 and houses part of a respective latching/releasing device $\mathbf{105}_1$, $\mathbf{105}_2$ as described previously.

In various embodiments, two shaped lateral seats 117*a*-117*b* are provided, in particular in substantially opposite diametral positions of the peripheral surface 114*b* of the recess 114, each of these seats preferentially comprising two appropriately shaped different areas 117*a* and 117*b*.

The seats 117*a*-117*b* are designed to receive and enable movement of respective angularly movable engagement elements (designated, for example, by 220*c* in FIG. 11 and described hereinafter), which, in possible embodiments, form part of an coupling/uncoupling arrangement (for example, of a bayonet type) operating between the removable dispenser part 100 and the fixed dispenser part 200. In the example, each seat 117-117*b* extends in a radial direction outwards from the peripheral surface 114*b* of the recess 114.

Designated by 118 is a lower shaped seat or recess, which is designed to receive and enable angular movement of an element that is manually operable (designated by 220*d* in FIG. 3, and described hereinafter), which, in possible embodiments, forms part of the aforesaid coupling/uncoupling arrangement. In the example, the recess 118 extends from the peripheral surface 114*b* of the recess 114 as far as the lower edge of the hollow body 101.

Other seats or recesses that extend from the peripheral surface 114*b* of the recess 114 as far as the lower edge of the hollow body 101 may be provided, in possible embodiments, for example, for housing partially a duct for delivery of a washing agent (such as the stretch of tube designated by 403*ci* in FIG. 11, described hereinafter) or to enable outflow of a washing agent (as described hereinafter): this is the case of the recesses designated by 118*a* and 118*b*, respectively, which in the example are defined in the direction of depth Z starting from the bottom of the recess 118.

It will be appreciated in any case that, irrespective of the conformation chosen for the interface walls between the removable part 100 and the fixed part 200, operation of the dispenser 10 in the course of a treatment program does not imply any movement of the removable part 100, which is hence coupled in a stationary position on the fixed part 200.

Figure 9:
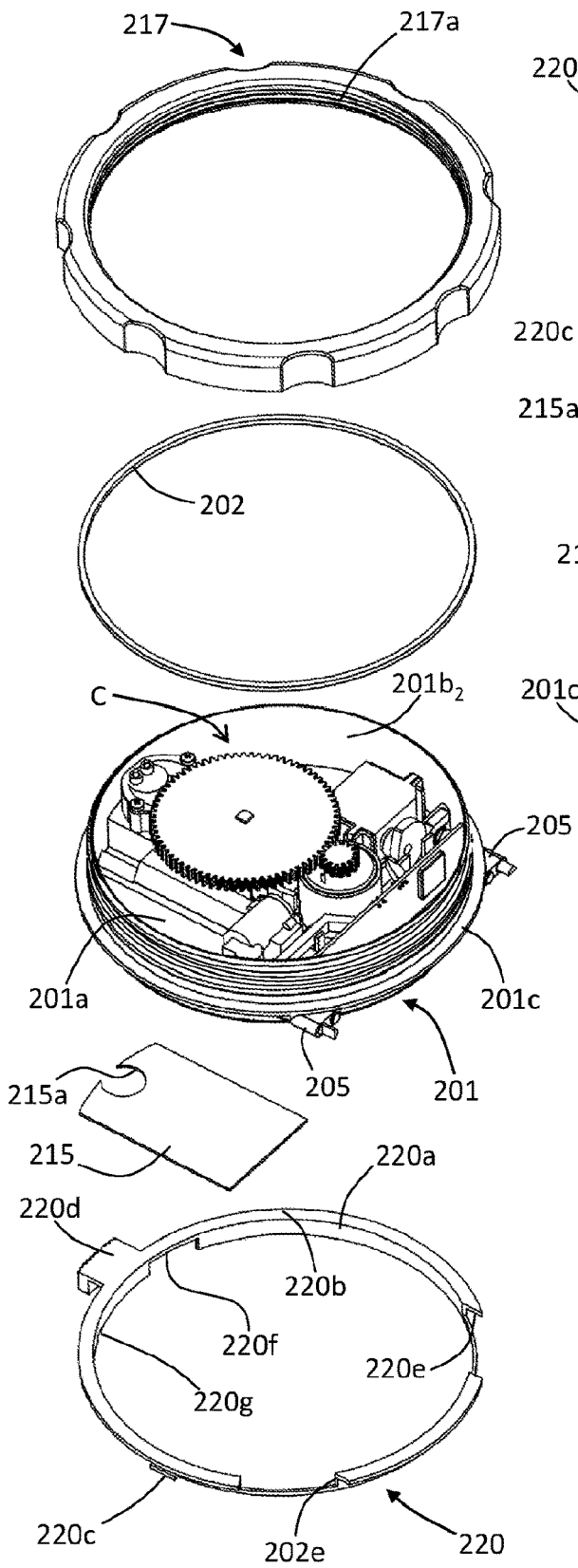
FIGS. 9 and 10 are partially exploded schematic views, from different angles, of a fixed part of a dispenser according to possible embodiments.
Figure 10:
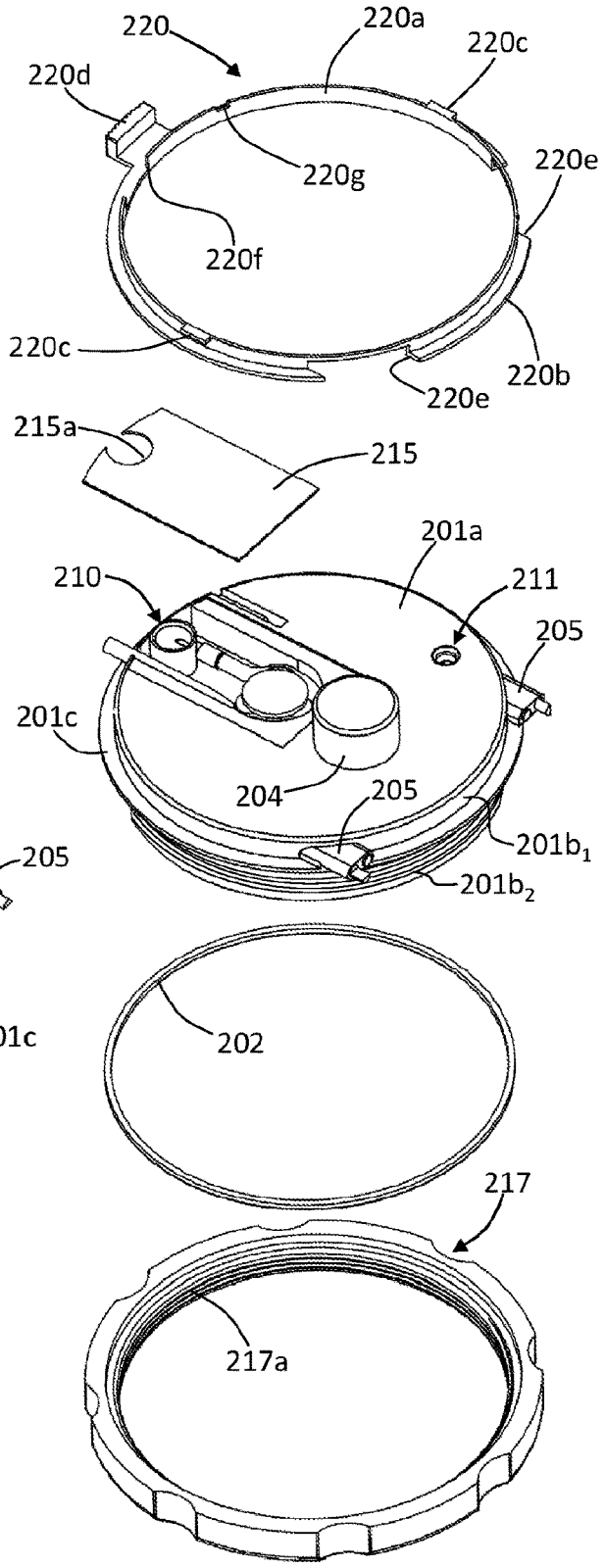
Figure 11:
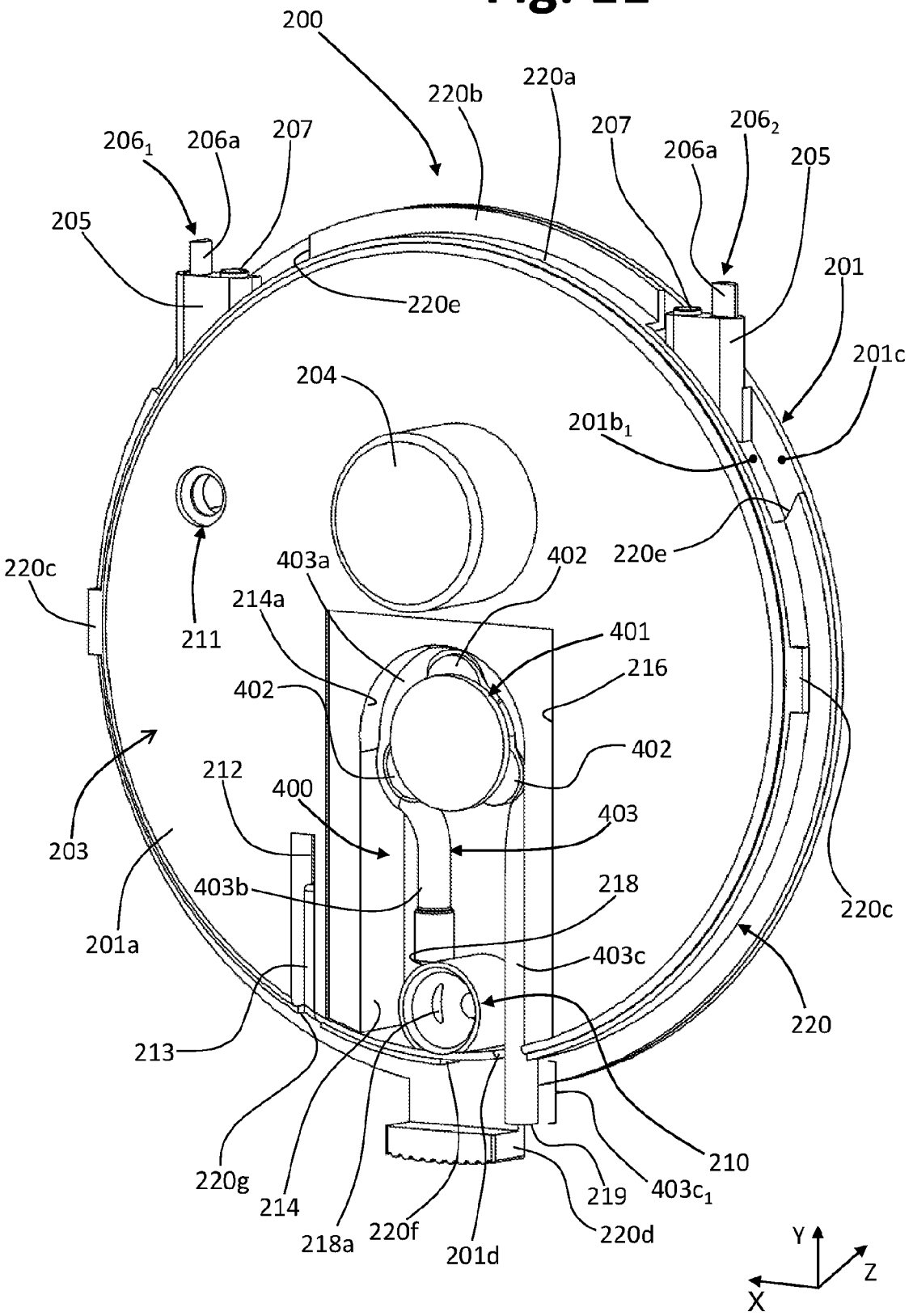
FIGS. 11 and 12 are schematic perspective views of a front and a back of a fixed part of a dispenser according to possible embodiments.
Figure 12:
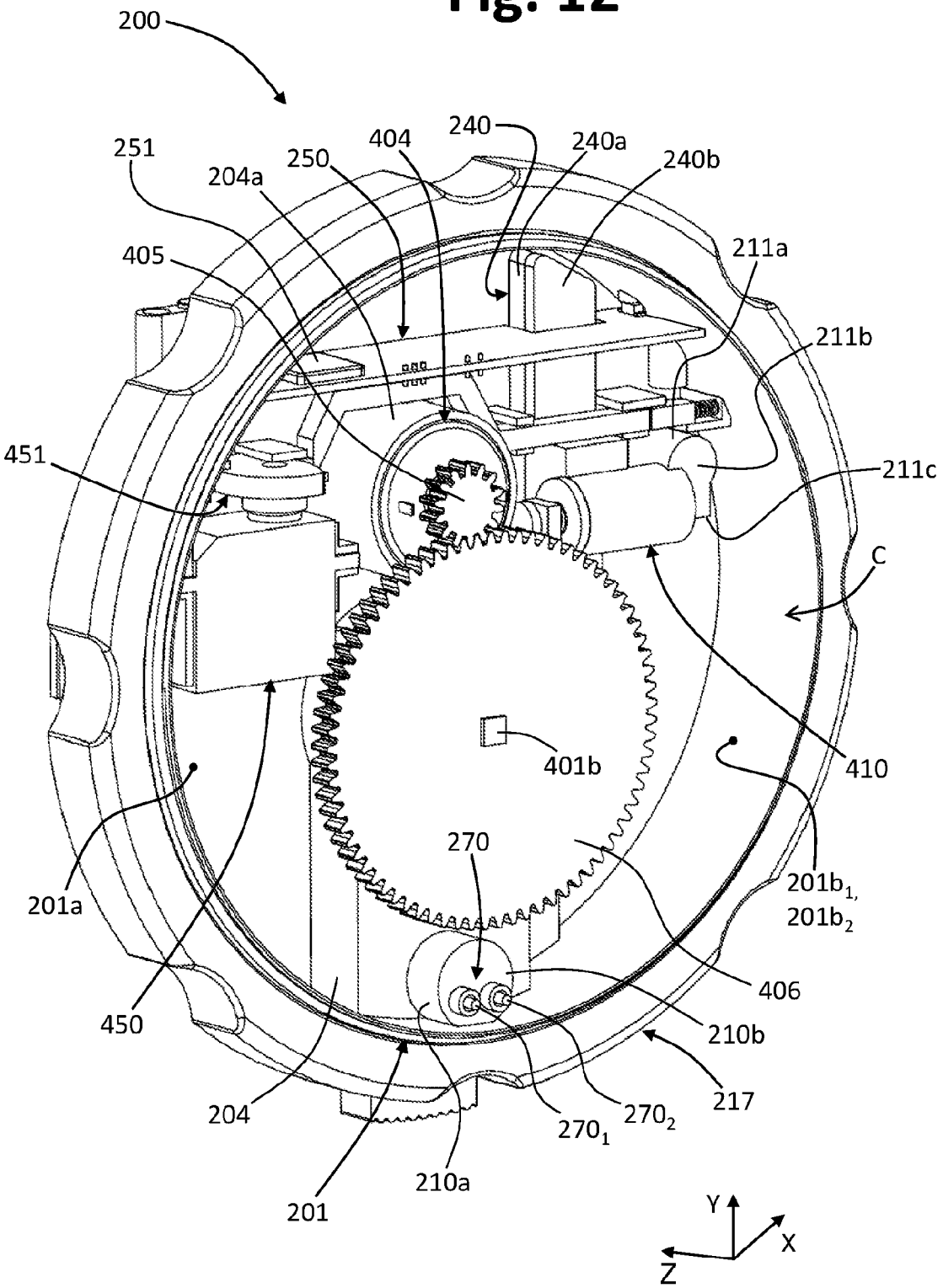

The fixed dispenser part 200 is visible in FIGS. 3 and 4, as regards the outer side 5*a* and the inner side 5*b* of the corresponding mounting wall 5, in partial exploded view in FIGS. 9-10, and in isolation in FIGS. 11 and 12.

With initial reference to FIG. 3, the fixed dispenser part 200 includes a main body 201, which is designed to be mounted in a through opening of the wall 5, preferably an opening having a substantially circular profile. Also the main body 201 may be made of plastic material, for example, via moulding; if necessary, also the body 201 may be formed by a number of parts joined together, for example, welded together or coupled in a separable way, possibly with interposition of sealing elements.

With reference, in particular, to FIGS. 9-11, in various embodiments, the main body 201 has a bottom wall 201*a* and a peripheral wall $\mathbf{201}b_1$-$\mathbf{201}b_2$ at which a flange 201*c* is defined, projecting radially outwards. Preferentially, the main body is mounted starting from the outer side 5*a* of mounting wall 5, with the flange 201*c* that is designed to bear upon the aforesaid outer side 5*a*, with possible interposition of a sealing element, designated by 202 in FIGS. 9-10 (see also FIG. 18), for example, an annular gasket made of elastomer.

In various embodiments, in the mounted condition, a front portion of the main body 201, designated as a whole by 203 in FIG. 3, projects at the front with respect to the outer side 5*a* of the wall 5, in particular for being received in the recess 114 described above (FIG. 4), of the back of the removable dispenser part 100. This projecting portion 203 of the main body 201 is formed by the bottom wall 201*a* and by the part of peripheral wall 201$b_1$ that extends in front of the flange 201*c*. In the example, for this purpose the bottom wall 201*a* is substantially circular, and the peripheral wall 201$b_1$-201$b_2$, or at least its part 201$b_1$, is substantially cylindrical.

In various embodiments, extending forwards from the bottom wall 201*a* is a further hollow projection, designated by 204. In the non-limiting example illustrated, this further projection 204 is designed for coupling with the recess 115 (FIG. 4) of the back of the removable dispenser part 100 (see also FIG. 18), and for this purpose the projection 204 preferably has a generally cylindrical shape, or some other shape substantially complementary to the recess 115.

In various embodiments, associated to the dispenser are at least one of a signalling arrangement and a locking/unlocking arrangement, possible embodiments of which will be described hereinafter: in various embodiments, at least one first functional element of such an arrangement is mounted on the fixed dispenser part and is designed to co-operate with at least one second functional element mounted on the removable dispenser part. In these embodiments, the at least one first functional element is accessible in the front area of the fixed dispenser part so that it can be operatively coupled to, or uncoupled from, the at least one second functional element. The front portion of the fixed dispenser part can be shaped for supporting and/or guiding and/or positioning an aforesaid first functional element.

For this purpose, in various embodiments, defined in the front portion 203 is at least one positioning and/or guiding formation 205, preferably formed integrally with the main body 201. Provided in the example of FIG. 11 are two formations 205, in specular positions, which extend upwards (with reference to the dimension Y) starting from the part of peripheral wall 201$b_1$ of the main body 201. In the example, each formation 205 performs functions of positioning and/or guiding for at least one locking element, belonging to the aforesaid locking/unlocking arrangement, and for at least one light-transmitting element, belonging to the aforesaid signalling arrangement, which are preferably substantially parallel to one another and extend axially in the height dimension Y of the dispenser; in FIG. 11, two of the aforesaid locking elements are designated by 206$_1$ and 206$_2$, whereas two of the aforesaid light-transmitting elements are designated by 207.

Once again with reference to FIG. 11, according to possible embodiments, at the front of the fixed dispenser part 200 (i.e., of the bottom wall 201*a* of its main body 201) at least one inlet for a washing agent opens, this inlet being designed for connection with a corresponding outlet of a tank defined in the removable dispenser part 100. In the example represented, a first inlet 210 and a second inlet 211 are provided, preferably defined by positioned tubular ducts, to which the outlets 112 and 113 (FIG. 4) of the tanks R1 and R2, respectively, are couplable in a separable way.

Once again with particular reference to FIG. 11, in possible embodiments at the front of the fixed dispenser part 200 (i.e., of the wall 201*a* of its main body 201) at least one passage 212 for dispensing a washing agent opens. Preferentially, this passage 212 opens at a grooves or recess 213 of the front surface of the bottom wall 201*a*, which extends downwards (with reference to the dimension Y) at least between the passage 212 itself and the part of peripheral wall 201$b_1$ of the main body 201, for the purpose described hereinafter. In the example represented, the passage 212 is associated to an arrangement for dispensing the washing agent coming from the tank R2.

In various embodiments, the dispenser has a dispensing arrangement for the washing agent contained in a tank of the removable dispenser part, comprising a pump that is preferably mounted on the fixed dispenser part. In various embodiments of this sort, at least part of the pump is set within a corresponding housing defined at the front of the fixed dispenser part. In various preferential embodiments, at least part of this housing extends towards the inside of the washtub 3; i.e., it extends beyond a plane identified by the mounting wall 5 of the dispenser 10. In this way, the housing, and hence at least part of the pump, can be located on the outside of the door 3 of the dish-washing machine 1 or in any case in an easily accessible position, which proves useful, for example, for the purposes of maintenance/repair/cleaning.

In the example represented in FIG. 11, such a housing is designated by 214 and is defined in the wall 201*a* of the main body part 201. As may be noted, at least part of the housing extends at the front beyond the flange 201*c* used for mounting the fixed dispenser part 200.

The housing 214 is preferentially closed by a corresponding removable lid, designated by 215, for example, in FIGS. 3 and 9-10, with possible interposition of sealing means, not represented. In various embodiments, the lid 215 is mounted in a removable way to facilitate cleaning of the housing 214 and/or of the pump; in particular, the lid 215 can then be removed from the tub side. In the example, the lid 215 is shaped in order to define a passage 215 for the inlet 210. Advantageously, defined on the outer surface of the bottom wall 201*a* of the main body 201 is a seat 216 for the lid 215.

More in general, in various embodiments, at least part of the pump is mounted or accessible at a front portion of the fixed dispenser part, which in the example is represented by the front projecting portion 203 (as has been seen, the portion 203 can be received in the corresponding seat 114 defined in the back of the removable dispenser part 100).

In various embodiments, the part of peripheral wall 201$b_2$ of the main body 201, which extends behind the flange 201*c* and is to be inserted through the corresponding through opening of the mounting wall 5, is pre-arranged for coupling with at least one retention element for fixing the fixed dispenser part 200 to the wall itself. With reference in particular to the example of FIGS. 9-10, for this purpose the part of peripheral wall 201$b_2$ has a male thread (not shown) on its outer surface, on which a retention ring-nut, designated as a whole by 217, provided with a corresponding female thread 217*a*, is to be screwed (see also FIG. 4, for the assembled condition of the two parts in question). As an alternative to a threaded coupling, the part of peripheral wall 201$b_2$ of the main body 201 and the retention element—here represented by the ring-nut 217—could have some other shape and/or be provided with other means of mutual coupling, for example, in the form of an attachment of the bayonet type and/or means at least in part elastic for mutual engagement and/or provided with holes and corresponding fixing screws. Also the retention element 217 may be made of plastic material.

The bottom wall 201*a* and the peripheral wall 201$b_1$-201$b_1$ of the main body 201 define a cavity, designated as a whole by C, for example, in FIGS. 4, 9, and 12, mounted or defined in which are one or more functional elements of the dispenser 10, described hereinafter.

In various embodiments, the dispenser comprises an arrangement operable by a user to cause coupling and uncoupling of the removable dispenser part to/from the fixed dispenser part. In various embodiments, the coupling/uncoupling arrangement comprises at least one element that, albeit mounted on the fixed dispenser part, is operable in the front area of the dispenser, i.e., its part that is designed to project towards the inside of the washtub of the machine 1.

In various embodiments, the aforesaid arrangement includes a movable coupling/uncoupling member. With reference, in particular, to FIGS. 9-11, this member—designated as a whole by 220—is here of an angularly movable type, and is mounted on the front portion 203 of the main body 201. The member 220 may be made of plastic material.

As may be seen in FIGS. 9-10, the member 220 has a ring-shaped body, including a generally cylindrical peripheral wall 220*a*, from which—preferably but not necessarily—a flange 220*b* projects radially outwards. The ring-shaped body 220*a*-220*b* has an internal diameter slightly greater than the part of peripheral wall 201$b_1$, so that it can be constrained thereon in a rotatable way. For this purpose, in possible embodiments, on the part of peripheral wall 201$b_1$ there can be provided a purposely designed seat (not represented), in which the rotating member 220 can be engaged via snap action, with the possibility of rotation.

In various embodiments, the rotating member 220 has at least two coupling elements 220*c*, in particular in the form of wings, preferably in opposite diametral positions, which project in a radial direction, preferably starting from the peripheral wall 220*a*. In various embodiments, radially projecting from the rotating member 220, in particular from its flange 220*b* if envisaged, is a manually operable element, like a lever, designated by 220*d*. Preferably, the operable element 220*d* extends downwards (with reference to the dimension Y) substantially at its bottom dead centre, at an angular distance of approximately 90° with respect to each coupling element 220*c*. Once again preferentially, the element 220*d* has a length and conformation such that it can be operated from the front of the dispenser 10 even when the removable dispenser part 100 is coupled on the fixed dispenser part 200 (see, for example, FIGS. 2 and 18).

In various embodiments, the member 220 has one or more undercuts or recesses in order to prevent, in the course of its angular displacement, possible interference with one or more corresponding fixed elements of the main body part 201. These recesses can extend on the peripheral wall 220*a* and/or on the flange 220*b*.

For instance, with reference to FIGS. 9 and 10, designated by 220*e* are two recesses, which are designed to be located at the formations 205 that extend from the part of peripheral wall 201$b_1$ of the main body 201. As may be noted also in FIG. 11, the recesses 220*e* have an angular extension greater than that of the formations 205 and are arranged with respect thereto in order to enable angular movement of the rotating member 220. A recess having a similar function, designated by 220*f*, is provided in the lower area of the rotating member 220, in particular to prevent interference of movement with a delivery outlet (see the elements designated by 219 and 403*ci* in FIG. 11, described hereinafter), which extends beyond the outer surface of the part of peripheral wall 201$b_1$ of the main body 201 of the fixed dispenser part 200.

Once again with reference to FIGS. 9-11, designated finally by 220*g* is a recess that, in the operating condition of the dispenser 10, i.e., with the removable dispenser part 100 coupled on the fixed dispenser part 200, is aligned with the outlet end of the discharge recess 213 described previously, in order to enable outflow by gravity of a dose of washing agent delivered.

Figure 13:
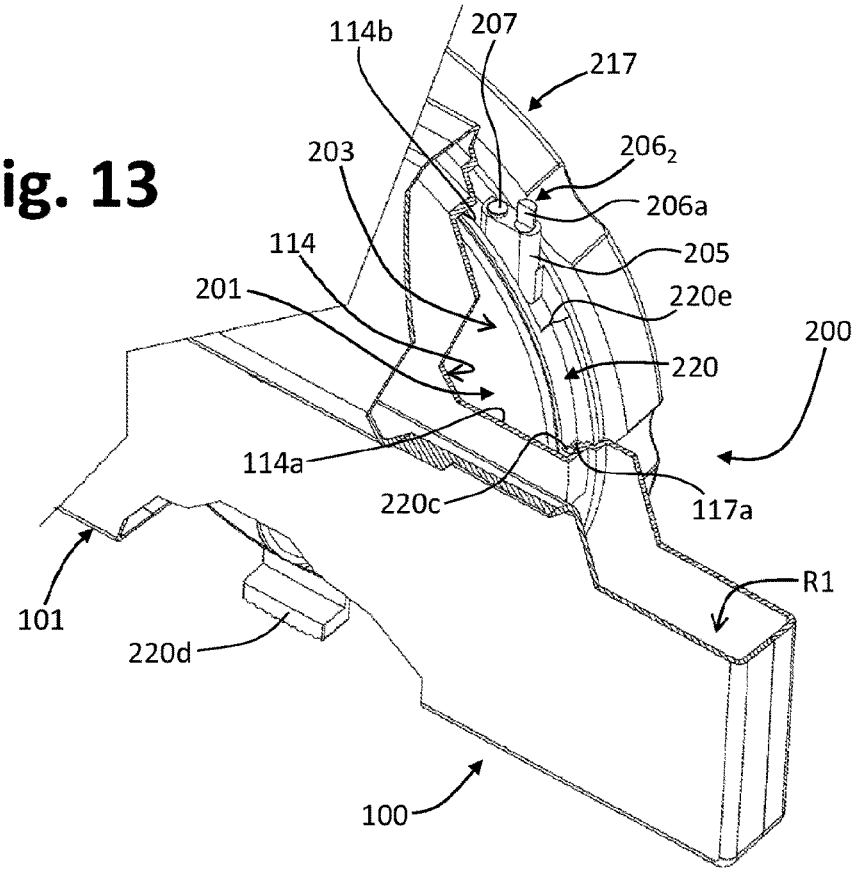
FIGS. 13 and 14 are partial and sectioned perspective views of a removable part and a fixed part, coupled together, of a dispenser according to possible embodiments, in two respective different conditions.
Figure 14:
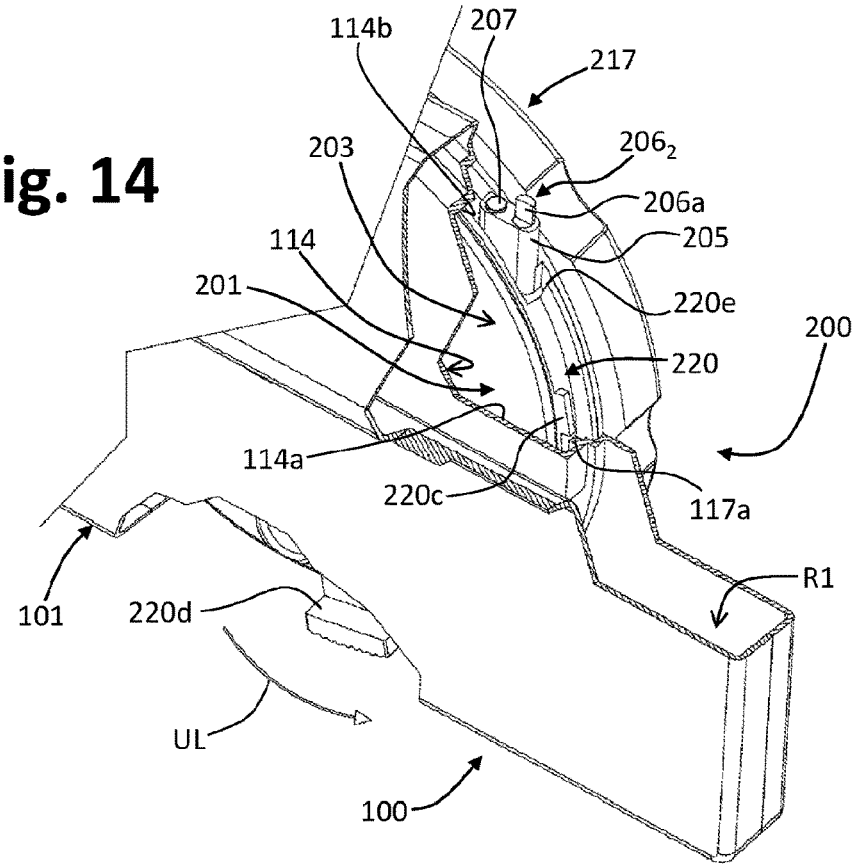

Exemplified in FIGS. 13 and 14 is the mode of operation of the coupling/uncoupling arrangement including the rotating member 220. As mentioned previously, in the operating condition of the dispenser 10, housed within the recess 114 (see also FIG. 4) of the back of the hollow body 101 of the removable dispenser part 100 is the front projecting portion 203 (see also FIG. 3) of the main body 201 of the fixed dispenser part 200; likewise, the positioning and/or guiding formations 205 are located in the recesses 116 (FIG. 4) of the back of the hollow body 101.

In this coupled condition, as represented in FIG. 13, the coupling elements 220*c* of the rotating member 220 are engaged in the respective shaped seats defined in the peripheral surface 114*b* of the recess 114, in particular in their engagement area 117*a* (see also FIG. 4): in this way, firm coupling between the removable dispenser part 100 and the fixed dispenser part 200 is guaranteed. As has been said, in the example of FIGS. 4 and 13-14, the seats referred to are shaped to obtain a coupling substantially of the bayonet type, and hence each have an engagement area 117*a* and a release area 117*b* (not visible in FIGS. 13-14 but represented in FIG. 4) for the coupling elements 220*c*.

As shown in FIG. 14, when it is necessary to remove the removable dispenser part 100 from the fixed dispenser part 200, a user has to bring about a rotation—here in the counter-clockwise direction—of the rotating member 220 with respect to the main body 201 on which the element 220 itself is mounted, as indicated by the arrow UL. For this purpose it is possible to use the operable part 220*d* of the rotating member 220, projecting downwards beyond the hollow body 101. In this way, following upon the rotation imparted on the rotating member 220, the coupling elements 220*c* are released from the respective engagement areas 117*a* of the corresponding seats, coming to occupy the corresponding areas of release (117*b*—see FIG. 4): in this condition of manual uncoupling, the removable dispenser part 100 can thus be removed from the fixed dispenser part 200 (except for the possible presence of further blocking elements, as exemplified hereinafter).

It will be appreciated that, starting from the condition of FIG. 14, after repositioning the part 100 on the part 200, manual re-coupling may be obtained simply by bringing about an opposite rotation of the rotating member 200, i.e., a rotation in the direction opposite to the one indicated by the arrow UL of FIG. 14.

In various preferential embodiments, the movements for coupling and uncoupling the removable dispenser part and the fixed dispenser part occur in a substantially linear direction, in particular in the dimension of depth Z of the dispenser. In these embodiments, a coupling/uncoupling arrangement of the type exemplified is particularly advantageous in view of its simplicity.

It should be noted in any case that the coupling/uncoupling arrangement operating between the parts 100 and 200 of the dispenser 10 may be different from the one exemplified, according to modalities that will appear clear to the person skilled in the field. It is pointed out, for example, that a mechanism with bayonet coupling could have an opposite configuration with respect to the one exemplified, i.e., with a rotating member functionally similar to the one designated by 220 that is mounted on the back of the movable dispenser body part 100 and with the respective coupling seats defined at the front of the fixed dispenser part. In other embodiments, the coupling/uncoupling arrangement operating between the parts 100 and 200 could be based upon the use of at least one linearly movable coupling/uncoupling member, instead of an angularly movable one, for example, comprising a slider.

As has been seen, in various embodiments the removable dispenser part includes at least one tank, having a respective outlet in a lower part thereof, at the back of the hollow body, which is to face the front of the fixed dispenser part, and with the outlet that can be coupled in a separable way to a corresponding inlet that is at the front of the fixed dispenser part. In embodiments of this sort, the inlet is connected in fluid communication with a corresponding dispensing arrangement, configured to deliver dosed amounts of the washing agent coming from the corresponding tank. In particularly advantageous embodiments of this sort, mounted on the hollow body is at least one retention valve, at the outlet of the tank, which is configured to assume a respective open position following upon coupling between the outlet and the inlet and to assume a respective closed position following upon uncoupling between the outlet and the inlet. The retention valve is hence a valve that automatically switches from the open position to the closed position when the movable dispenser part is removed from the fixed dispenser part, and switches from the closed position to the open position when the movable dispenser part is coupled to the fixed dispenser part. In this way, it is possible to prevent undesired leakages of the washing agent when the removable dispenser part is removed.

In various embodiments, such as the ones exemplified in the figures, the hollow body defines two tanks, each with an outlet of its own, and with two corresponding inlets on the fixed dispenser part: in these cases, one said retention valve can be mounted at each outlet.

Figure 15:
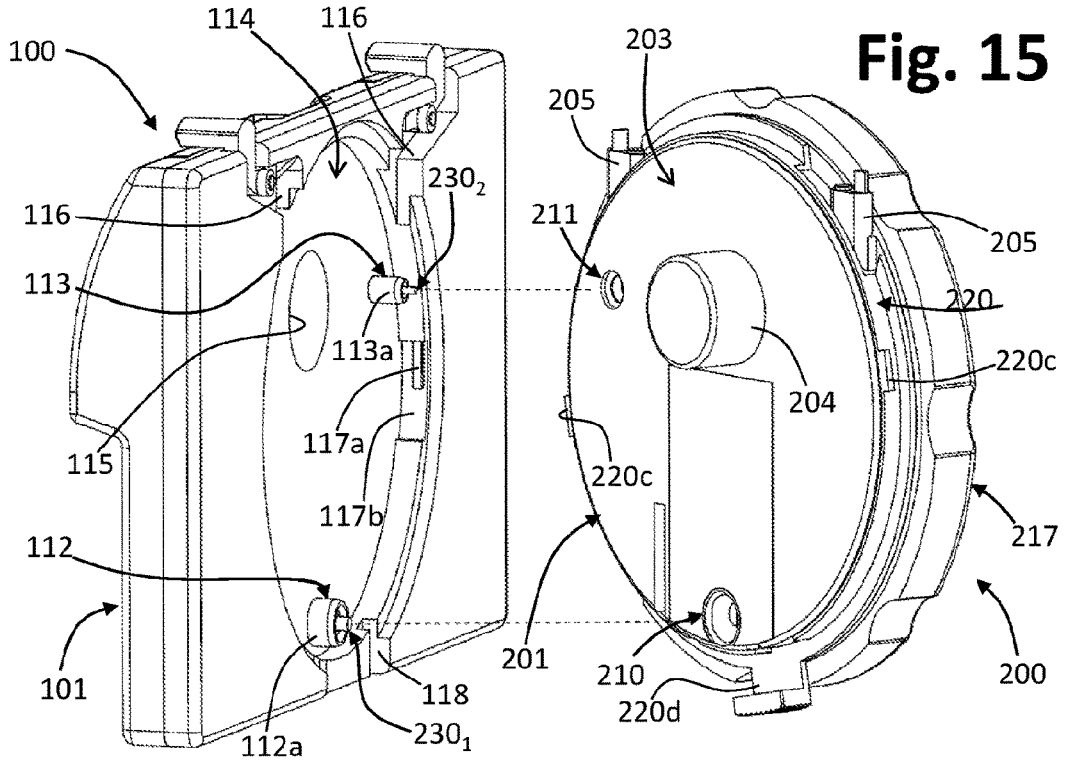
FIG. 15 is a schematic perspective view of a removable part and a fixed part, uncoupled from one another, of a dispenser according to possible embodiments.

The concept, with reference to the examples so far described, is illustrated schematically in FIG. 15, where it may be noted how the outlets 112 and 113 of the hollow body 101 are designed to be inserted in the inlets 210 and 211, respectively, of the main body 201. As has been said, preferentially, the outlets 112 and 123, on one side, and the inlets 210 and 211, on the other side, have at least in part a tubular configuration, in order to facilitate mutual coupling in the direction of coupling of the removable dispenser part 100 on the fixed dispenser part 200. Annular gaskets may possibly be associated to the respective outlets or to the inlets in order to improve—if necessary—fluid tightness.

The tubular arrangement of the outlets 112 and 123 and the inlets 210 and 211 is preferably such as to facilitate a respective seal, for example, via respective sealing elements, in particular in annular form, where the aforesaid seal could be of an axial type or of a radial type. For instance, for a seal of an axial type there could be provided an annular sealing element operating between the head of each outlet and a contrast wall in the corresponding inlet, whereas in the case of a seal of a radial type there could be provided an annular sealing element operating between the tubular wall of the outlet and the tubular wall of the corresponding inlet. Preferably, the outlets 112 and 123 and the inlets 210 and 211 have a circular section, i.e., a substantially cylindrical shape, to which there can be associated respective circular annular sealing elements, for example, in the form of an O-ring; however, the tubular shape of the outlets and the inlets could have a different section (for example, polygonal), but preferably with rounded corners.

The aforesaid first and second retention valves are visible only partially in FIG. 15, designated by $\mathbf{230}_1$ and $\mathbf{230}_2$, associated to the outlet 112 and to the outlet 113, respectively. From the figure it may moreover be appreciated how, in various embodiments, the front of the fixed dispenser part 200 comprises one or more guide elements (such as the projecting portion 203, the tubular inlets 211, 212, the projection 204, the formations 205) and the back of the removable dispenser part 100 comprises one or more guided elements (the recess 114, the tubular outlets 112, 113, the seat 115, the recesses 116), to define a unique direction and/or position of coupling between the aforesaid movable and stationary parts of the dispenser. As has been seen, preferentially the coupling occurs substantially in the depth dimension Z of the dispenser, i.e., in a direction substantially orthogonal to the front of the fixed dispenser part or of the mounting wall of the dispenser.

The retention valves $\mathbf{230}_1$ and $\mathbf{230}_2$ are each configured to assume a respective open position following upon coupling between the outlets 112 and 113, on one side, and the inlets 210 and 211, on the other side, and to assume a respective closed position following upon uncoupling between the outlets 112 and 113, on one side, and the inlets 210 and 211, on the other side. In the example, the non-return valves $\mathbf{230}_1$ and $\mathbf{230}_2$ bring about automatic closing and/or opening of the outlets 112 and 113 of the tanks R1 and R2: in the case of further tanks, further retention valves can be provided on the respective outlets.

Figure 16:
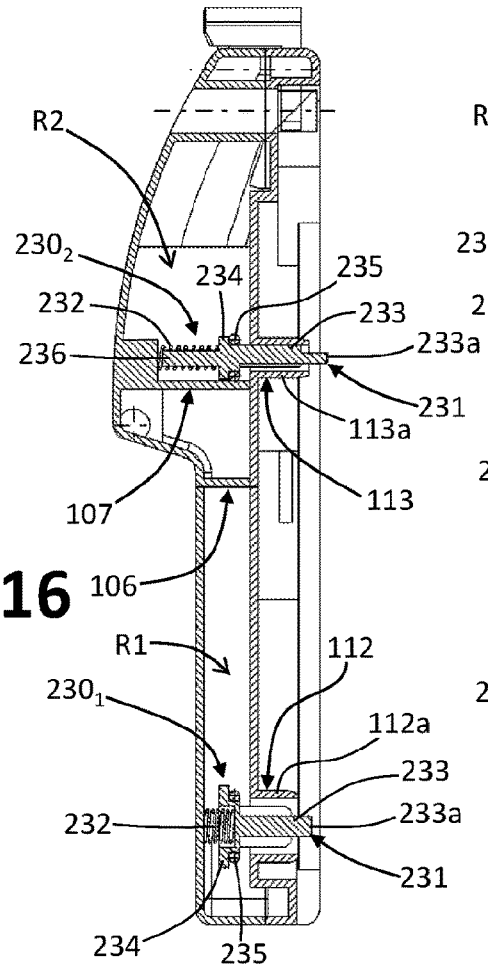
FIGS. 16 and 17 are schematic cross-sectional views of a hollow body belonging to a removable part of a dispenser according to possible embodiments, according to a complex plane of section that passes through two corresponding retention valves.
Figure 17:
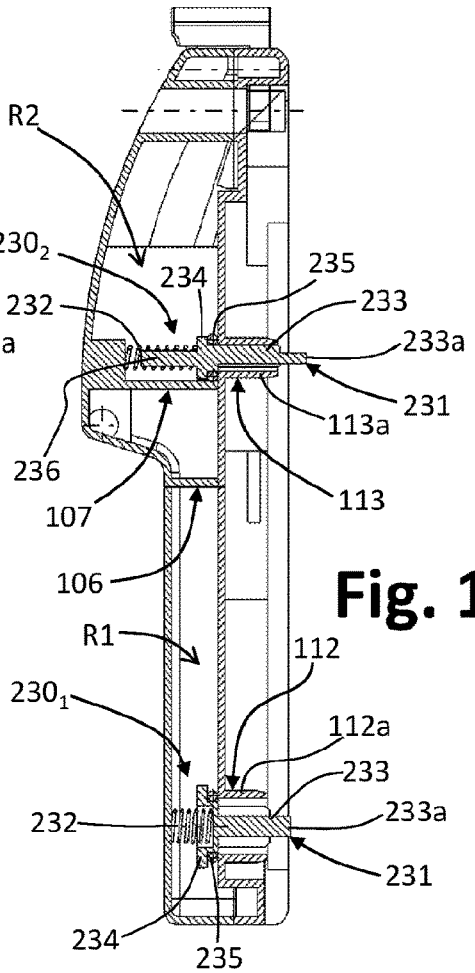

A possible structure of the retention valves $\mathbf{230}_1$ and $\mathbf{230}_2$ is visible in FIGS. 16 and 17, which is a schematic cross-sectional illustration of just the hollow body 101.

In the example, each valve $\mathbf{230}_1$ and $\mathbf{230}_2$ comprises a valve member 231 that is inserted at least partially within the corresponding tubular outlet part 112*a* or 113*a* and is urged by an elastic element 232, in particular a spring, towards the closed position of the outlet itself. Preferentially, the spring 232 extends in the corresponding tank R1 or R2 and has a first end bearing upon an inner surface of the tank itself, opposite to the corresponding tubular outlet part 112*a* or 113*a*; possibly, within the tank there can be defined a resting formation for the first end of the spring 232, as exemplified for the valve $\mathbf{230}_2$.

The valve member 231 has a first portion 233 generally opposite to the spring 232, which extends axially through the corresponding tubular outlet part 112*a* or 113*a* and defines an actuation end 233*a* of the valve member 230. Preferentially, the first portion 233 of the member 231 has a series of radial wings (not designated by any reference number, but clearly visible, for example, in FIG. 6), in order to facilitate centring and/or guiding of the member itself within the corresponding tubular outlet, enabling, however, axial sliding thereof and passage of the washing agent. Once again preferentially, the actuation end 233*a* of the valve member 231 projects beyond the proximal edge of the corresponding tubular outlet part 112*a* or 113*a*.

The valve member 231 is provided with sealing means, which are able to interact with the corresponding tubular outlet part 112*a* or 113*a* to bring about opening or closing thereof. In the example, for this purpose, the valve member 231 defines in its part inside the respective tank R1 or R2 a flange 234, projecting radially outwards. In the example, mounted on the side of the flange 234 facing the corresponding outlet 112 or 113 is a seal gasket, designated by 235, preferably a sealing ring, which has a diameter greater than the internal diameter of the corresponding outlet, and which is able to provide a front or axial seal with respect to the area of the inner surface of the tank R1 or R2 that surrounds the mouth of the outlet itself.

In the example, the member 231 of the non-return valve $\mathbf{230}_2$ has a second portion 236, which extends axially from the flange 234, in the direction opposite to the first portion 233, on which a part of the corresponding spring 232 can be conveniently fitted, and consequently guided, the second end of the spring preferably bearing upon the side of the flange opposite to the corresponding gasket 235. Once again with reference to the example, the flange 234 of the member 231 defines, on its side opposite to the gasket 235, a seat—not indicated—received, and hence guided, in which is a part of the corresponding spring 232, the second end of the spring bearing upon the bottom of the seat.

Of course, the non-return valves $\mathbf{230}_1$ and $\mathbf{230}_2$ could also be built in a similar way. In the example, the reason for the different embodiment is that the valve $\mathbf{230}_2$ is mounted in a deeper area (dimension Z) of the hollow body, i.e., of the tank R2, with the valve member 231 that is axially longer and for which it is thus advisable to envisage an axially extended portion 236 for guiding the spring 232.

FIG. 16 illustrates an operating condition of the non-return valves $\mathbf{203}_1$ and $\mathbf{230}_2$ equivalent to the one that is obtained when the removable dispenser part 100 is coupled on the fixed dispenser part. In this condition, the actuation end 233*a* of the valve member 231 bears upon a corresponding contrast surface defined in the fixed dispenser part 200, in particular at the corresponding inlet 210 or 211: in this way, the valve member 231 is held in a retracted position to counter the action of the spring 232, corresponding to which is the open position of the non-return valve $\mathbf{230}_1$ or $\mathbf{230}_2$. In this condition, the sealing means including the gasket 235 are spaced apart from the inner surface of the tank R1 or R2 that surrounds the mouth of the tubular outlet part 112*a* or 133*a*, thus enabling passage of the washing agent into the corresponding inlet 210 or 211 of the fixed dispenser part 200.

The contrast surface bearing upon which is the actuation end 233*a* of the valve member 231 is preferably defined within the corresponding inlet 210 or 211 of the fixed dispenser part 200. For instance, this surface may be represented by the inner surface of a bottom of the inlet 210 or 211 (the bottom of the inlets 210 and 211 is visible in FIG. 12, where it is designated by 210*b* and 211*b*, respectively), or else defined by a purposely provided element defined within the inlet 210 or the inlet 211: this second case is exemplified in FIG. 18 for the non-return valve $\mathbf{230}_1$, where extending within the inlet 210 is a contrast element 210*c*, bearing upon the front surface of which is the actuation end of the respective valve member, thus keeping it in the retracted position of opening of the outlet 112 or 113, in a compressed condition of the corresponding spring.

As may be seen, instead, in FIG. 17, when the removable dispenser part 100 is, instead, uncoupled from the fixed dispenser part 200, the valve member 231 is pushed and held in an advanced position under the action of the corresponding spring 232, corresponding to which is the closed position of the retention valve $\mathbf{230}_1$ or $\mathbf{230}_2$. In this condition, the sealing means including the gasket 235 are pressed as a result of the spring 232 on the inner surface of the tank R1 or R2 that surrounds the mouth of the tubular outlet part 112*a* or 113*a*, thus preventing outflow of the washing agent through the respective outlet 112, 113.

In various preferential embodiments, such as the ones exemplified in the figures, at least two tanks R1 and R2 are defined in a single body 101, but in possible variant embodiments, two or more tanks could be distinct from one another, i.e., each belong to a respective removable hollow body: in embodiments of this sort, the fixed dispenser part would have a structure suited accordingly in order to enable separable mechanical and fluidic coupling of the hollow bodies, using, for example, means of the type already described above. Also in solutions of this sort each hollow body could be provided with a retention valve of the type described at a corresponding outlet.

In various embodiments, the removable dispenser part includes a first tank and a second tank for a first washing agent and a second washing agent, respectively, and the dispenser includes a first dispensing arrangement and a second delivery arrangement, each configured for dispensing dosed amounts of the respective first washing agent or second washing agent, respectively. In particularly advantageous embodiments of this sort, the first dispensing arrangement comprises a peristaltic pump, which has associated to it a command arrangement of the second dispensing arrangement, the peristaltic pump being configured to be driven in a first direction to cause dispensing of first dosed amounts of the first washing agent, and to be driven in a second direction to drive the command arrangement so as to cause dispensing of second dosed amounts of the second washing agent, in particular via the second dispensing arrangement.

In the above embodiments, each dispensing arrangement preferentially comprises a dispensing duct, which extends between the outlet of the corresponding tank and a dispensing outlet for the dosed amounts of the first and second washing agents, respectively, with at least one part of the dispensing duct of the first arrangement of the peristaltic pump that is deformable.

A possible embodiment of such a peristaltic pump is visible, for example, in FIGS. 11, 12, and 18, in the latter figure the dispenser 10 being illustrated in an operating condition.

The peristaltic pump is designated as a whole by 400 in FIG. 11, even though in the aforesaid figure only a part of the pump is visible set within the housing 214 defined at the front of the fixed dispenser part 200, i.e., of its main body 201. In the aforesaid figure, designated by 401 is a rotating assembly of the pump 400, which carries one or more compression elements 402, for example, constituted by rollers mounted rotatably, according to a circumference, on a structure (401*a*, FIG. 18) of the assembly 401. The pump 400 further comprises a duct or tube that is at least in part deformable 403, hereinafter referred to also just as "tube". Preferably, the tube 403 has at least an intermediate portion 403*a*, which is in contact with and/or wound around the compression elements 402 of the rotary assembly 401 and is in deforming contact with these elements. For this purpose, in various embodiments, the housing 214 defines a curved contact surface 214*a*, resting against which is the part of the intermediate portion of tube 403*a* opposite to the compression elements 402.

In the example, the intermediate portion of tube 403*a* is defined between a first portion of tube 403*b*, here defined as "ascending", and a second portion of tube 403*c* here defined as "descending", these two portions of tube 403*b*, 403*c* preferentially extending at least in part substantially parallel, in particular in the height dimension Y of the dispenser 10. The delivery capacity of flow-rate of the pump 400, or the amount of washing agent delivered, can be determined according to a technique in itself known, as a function of parameters such as the number of compression elements 402, the dimensions of the circumference according to which the elements are arranged, the section of passage of the deformable tube 403, the r.p.m. of the motor 404, and/or the number of revolutions of the motor 404.

Figure 46:
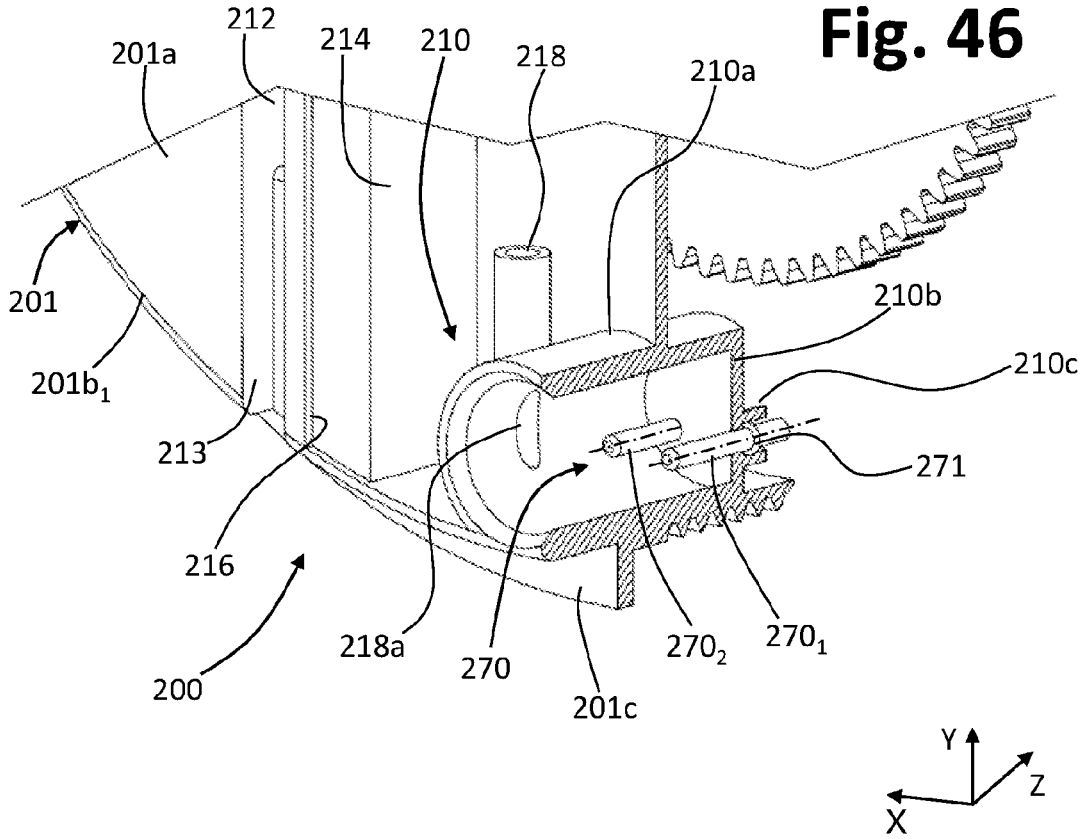
Figure 49:
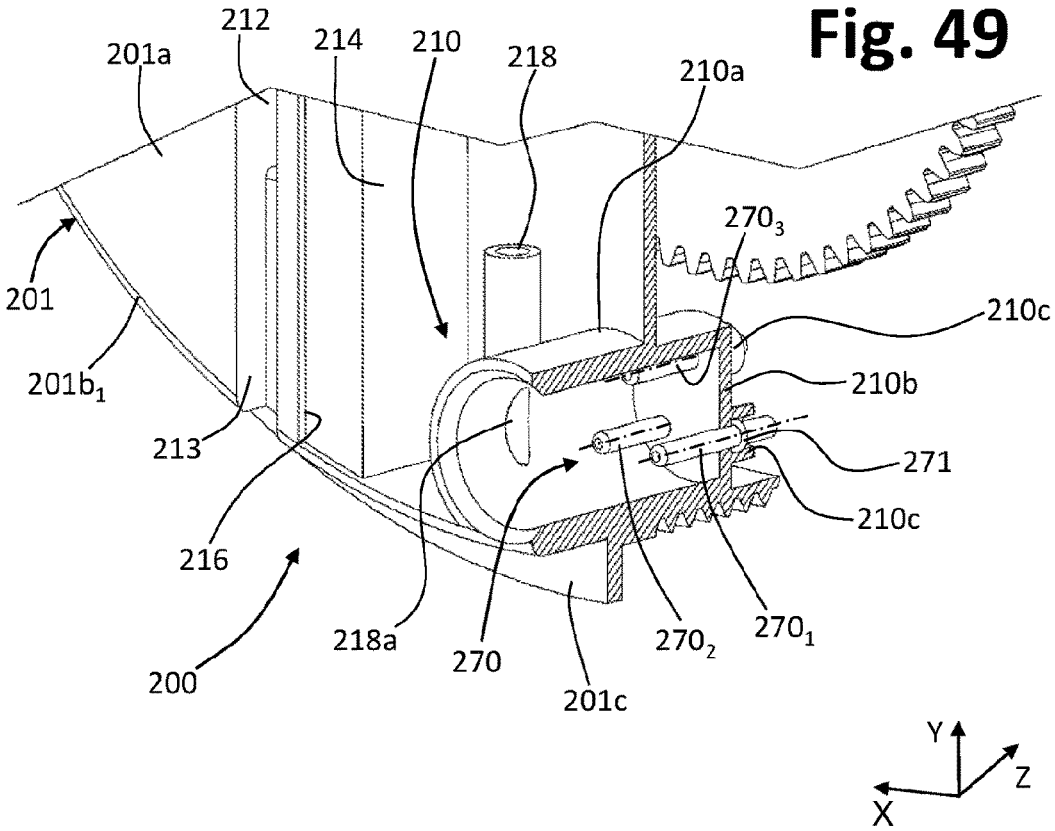

In the non-limiting example described, the lower end of the ascending portion of tube 403*b* is coupled to a corresponding attachment 218 defined by the main body 201 of the fixed dispenser part 200, in particular within the housing 214, with the attachment 218 that is in fluid communication with the tubular inlet 210, via the opening designated by 218*a*, defined on the tubular wall of the aforesaid inlet (see, for example, also FIGS. 46 and 49).

The lower end of the descending portion of tube 403*c* defines, instead, a dispensing opening 219 for the first washing agent. In the example, the portion of tube 403*c* passes through the peripheral wall $201b_1$ of the main body 201, which is provided for this purpose with a corresponding recess, not indicated, with the stretch of tube 403*ci* projecting beyond the peripheral wall that is designed to be at least partially received in the recess 118*a* of the back of the hollow body 101 (see FIG. 4). It should be noted that the outlet 219 could also be defined by a tubular element associated or defined integrally by the main body 201 (like the attachment 218), connected to which is a lower end of the portion of tube 403*c*.

In various preferential embodiments in which a peristaltic pump of the type exemplified with reference to FIG. 11 is used, the outlet of the tank R1, or else the corresponding inlet 210 on the fixed dispenser part 200, is at a lower height than the rotating assembly 411 of the pump, i.e., at a lower height than the portion of tube 403*a* and/or the curved contact surface 214*a*, with reference to the height dimension Y of the dispenser 10 when the latter is in an operating condition (i.e., set vertically, as in FIG. 11). This arrangement prevents any leakage of the corresponding washing agent into the tub 3. This arrangement, associated to the fact that the corresponding delivery outlet 219 is preferentially at a lower height than the rotating assembly 411 of the pump, also makes it possible to prevent any stagnation of the corresponding washing agent in the portion of the delivery duct (here the portion 403*c* of the flexible tube 403) downstream of the assembly 401 of the pump 400.

In operation of the pump 400, rotation of the assembly 401 causes pumping of the first washing agent through the tube 403, with the compression elements 402 that squeeze and release progressively consecutive stretches of the portion of tube 403*a*, with respect to the curved contact surface 214*a*.

Rotation of the assembly 401 is brought about by an electric actuator having an angularly rotatable shaft, such as the motor designated as a whole by 404 in FIG. 12, mounted on the fixed dispenser part 200. In the example, a rear portion of the motor 404 is housed within the hollow projection 204 (see FIG. 11) of the front of the main body 201. A front portion of the motor 404 is preferably housed within a corresponding tubular seat 204*a*, which is defined within the cavity C of the main body 201 and is aligned with the aforesaid hollow recess 204 of the front (see FIG. 18).

Preferentially, the motor 404 has a drive shaft that is able to rotate according to an axis substantially parallel to an axis of rotation of the rotary assembly 401, there being provided one or more transmission members between the drive shaft and the rotating assembly. With reference to the example illustrated, the drive shaft of the motor 404 is partially visible in FIG. 18, designated by 404*a*, with the corresponding axis of rotation designated by 404*b*, and designated by 401*b* in the same figure is a shaft of the rotating assembly 401, which identifies the respective axis of rotation thereof, designated by 401*c*. In the example, the shaft 401*b* of the rotating assembly 401 is mounted passing through a corresponding opening defined on the bottom of the housing 214; at this opening, projecting from the bottom of the housing 214 towards the inside of the cavity C of the main body 201, is a corresponding cylindrical seat 214*b*, for supporting and guiding the shaft 401*b*. Preferentially, mounted in an intermediate stretch of the shaft 401*b* housed in the corresponding cylindrical seat 214*b* is a seal ring (not indicated).

Keyed to the shaft 404*a* of the motor 404 is a first gear wheel 405 and keyed to the shaft 401*b* of the rotating assembly 401 is a second gear wheel 406, the two gear wheels 405 and 406 mutually meshing so that rotation of the shaft 404*a* brings about a rotation of the shaft 401*b*, and hence of the rotating assembly 401. In the example, the wheel 405 has a diameter, and hence a number of teeth, that is smaller than the diameter, and hence the number of teeth, of the wheel 406.

As has been said, the pump 400 belongs to the arrangement for dispensing the first washing agent, which likewise includes a dispensing duct, which extends between the outlet of the corresponding tank R1 and the delivery outlet 219. In the example, the dispensing duct is defined on the fixed dispenser part 200 and includes the inlet 210, the attachment 218, and the deformable tube 403. As has been said, alternatively, the dispensing outlet of the duct could be defined by a tubular part of the main body 201, to which the outlet of the tube 403 is connected.

In various embodiments, the dispensing arrangement for the second washing agent contained in the second tank, i.e., the tank R2, includes a dosing valve, which is operative along the respective dispensing duct. With reference, in particular, to FIG. 12, such a dosing valve is designated as a whole by 410. In general, the dosing valve 410 can be obtained according to a known technique in the field of dispensers for dish-washing machines, and, for example, comprise a dosing chamber that partially houses a valve member, where the member can be moved between a first position, in which the member itself closes an inlet of the dosing chamber and at the same time enables outflow of the second washing agent from the dosing chamber through a respective outlet, and a second position, in which the valve member opens the inlet of the dosing chamber and at the same time prevents outflow of the second washing agent from the dosing chamber through the respective outlet.

Figure 19:
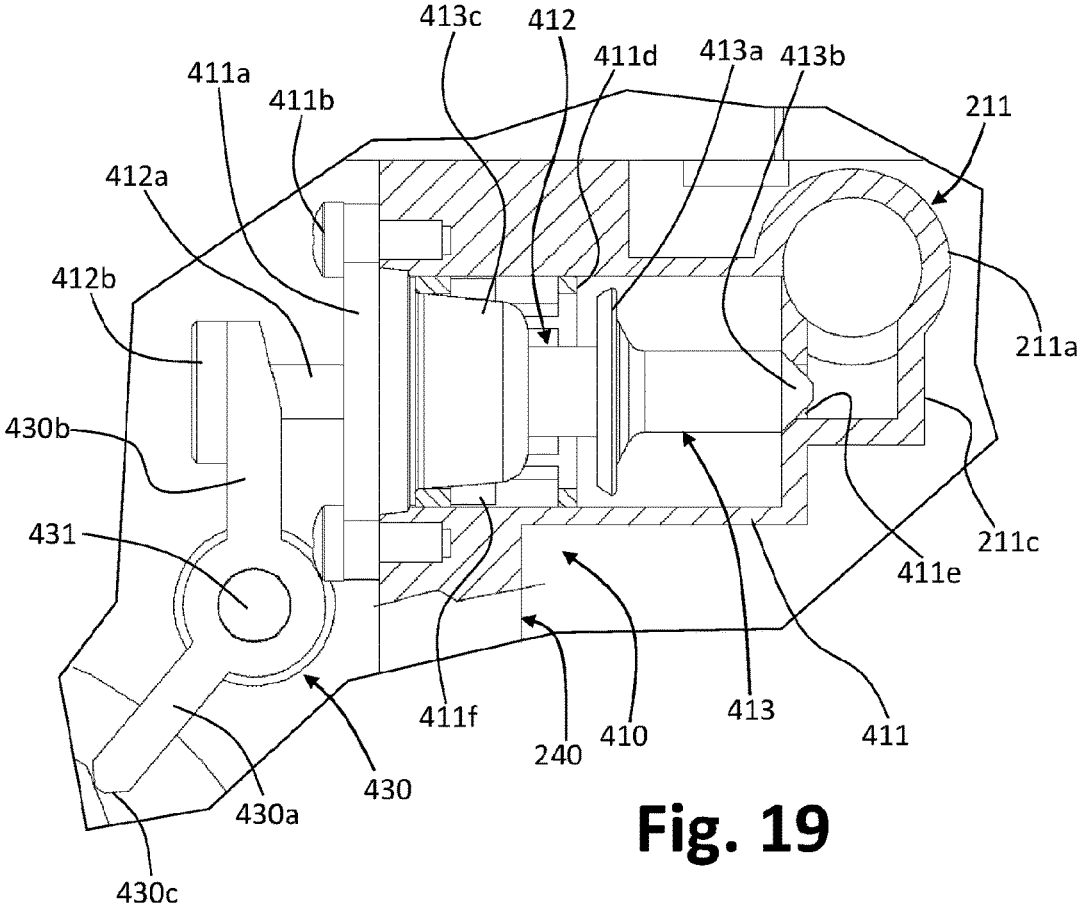
FIG. 19 is a schematic front view in partial cross section of a portion of a dispenser according to possible embodiments.

A possible embodiment of the dosing valve 410 is exemplified in FIG. 19. In the aforesaid figure, designated by 411 is a dosing chamber, defined by the main body 201 of the fixed dispenser part 200, partially housed in which in a linearly slidable way is a valve member designated as a whole by 412. A portion of the valve member, designated by 412*a*, extends always on the outside of the chamber 411, through a through hole of a front lid 411*a* of the chamber itself. The lid 411*a* is preferably fixed at a front opening of the chamber 411 via screws (one of which is designated by 411*b*), with possible interposition of a seal gasket, but in possible variants (as may be seen, for example, in FIG. 12), the screws may be absent and the lid directly welded at the aforesaid front opening. The outer portion 412*a* of the member 412 is preferably provided with a widened head 412*b*, via which a pulling force can be imparted on the member itself.

Fitted on at least part of the portion of the member 412 that extends in the dosing chamber 411 is a sealing element 413 made of resilient material, for example, an elastomer. The sealing element 413 includes a flange portion 413*a*, designed to provide a seal with respect to a valve seat 411 defined within the chamber 411. An end portion 413*b* of the sealing element 413 coats, instead, the end of the member 412 opposite to the lid 411*a* in order to close in a sealed way an inlet 411*e* of the dosing chamber 411. This inlet is formed by a through opening of a wall that belongs to a lower hollow extension 411*c* of the rear part of the inlet 211 defined in the fixed dispenser part 200. The sealing element 413 is likewise shaped to define a bellows portion 413*c*, at the end opposite to the portion 413*b*. The bellows portion 413*c* has the purpose of providing a seal with respect to the inner side of the lid 411*a* (and thus prevent outlet of liquid from the opening of the lid 411 passing through which is the valve member), and at the same time enabling linear displacements of the valve member 412. Housed within the bellows portion 413*c* is a spring (not visible), which tends to push the member 422 into a closed position of the valve seat 411*e*.

As mentioned previously, also the inlet 211 preferably comprises at least one cylindrical tubular portion to enable coupling of the corresponding tubular outlet 113 of the tank R2. FIG. 12, for example, shows the aforesaid cylindrical tubular portion, designated by 211*a*, as well as a corresponding bottom wall 211*b*, which is in common with the aforesaid lower extension 211*c*, which is located in a rear part of the portion 211*a*. The lower extension 2011*c* preferentially has an approximately prismatic shape, or in any case a shape comprising a rectilinear wall that defines the bottom of the dosing chamber 411 and is provided with the through opening that forms the inlet 411*e* of the chamber itself.

The dosing chamber 411 likewise has an outlet 411*f*, which is defined in a peripheral wall thereof and is in fluid communication with a corresponding duct 240 present on the main body 201 of the fixed dispenser part 200. The outside of this duct 240 is partially visible in FIGS. 12 and 20 (see also FIG. 71, where the duct 240 is partially sectioned), and preferentially comprises a part 240*a* defined integrally with the main body 201 and a corresponding lid 240*b* that is fixed in a fluid-tight way, for example, welded. The duct 240 extends at least between the outlet 411*f* of the dosing chamber of FIG. 19 and the delivery passage 212 that opens on the front of the main body 201 (FIG. 11). Preferably, a part of the duct 240 extends also at the top as far as the outlet 411*e* of the dosing chamber 411 to perform a venting function.

FIG. 19 illustrates the aforesaid first position of the dosing valve 410, where the valve member 412 with the corresponding sealing element 413 is pushed by the corresponding spring—present within the bellows portion 413*c*—to close the inlet 411*e*. Assume that in this condition the chamber 411 is empty and that present in the inlet 211 and in the corresponding lower extension 211*c*—which are in direct fluid communication with the second tank R2, and more in particular with its intake volume R2*a* of FIGS. 6-8—is the second washing liquid. The flange portion 413*a* of the sealing element 413 is set at a distance from the corresponding valve seat 411*d*.

For the purposes of dispensing of a dose of the second washing agent, the valve member 412 is made to recede countering the action of the corresponding bellows portion in such a way that the inlet 411*e* of the chamber 411 is opened, and at the same time the flange portion 413*a* of the sealing element displaces towards the corresponding valve seat 411*d*. In this way, a certain amount of the second washing agent can penetrate into the dosing chamber 411. Preferentially, recession of the member 412 proceeds in any case for a certain stretch even after the flange portion 413*a* has reached the valve seat 411*d*, possibly bringing about a "concertina" folding of the sealing element 413 on the valve member 412 (see, for example, FIG. 28), and thus producing also an effect of suction of the second washing agent into the dosing chamber 411. Since the valve seat is closed, the fluid cannot in any case reach the outlet 411*f* of the chamber 411.

Next, the valve member 412 is allowed to return to the initial condition illustrated in FIG. 19, under the action of the corresponding spring, with the flange portion 413*a* of the sealing element 413 that detaches from the valve seat 411*d* and enables outflow of the dose of washing agent from the chamber 411 through the outlet 411*f*, and with the end of the member 412 (i.e., of the corresponding part 413*b* of the sealing element 413) that re-closes the inlet 411*e*, preventing any further inflow of the second washing agent. The dose of the second washing agent consequently flows downwards along the duct 240, until it reaches the discharge passage 212 (FIG. 11), and hence the recess 213 and the recess 220*g* that enable passage thereof towards the inside of the washtub 3 of the dish-washing machine 1.

In the example, then, also the delivery duct of the second delivery arrangement is defined on the fixed dispenser part 200 and includes the inlet 211, the extension 211*c*, the dosing chamber 411 of the valve 410, the duct 240, as well as—preferably—the recess 213 and the recess 220*g*.

As explained previously, in advantageous embodiments, the peristaltic pump, or else at least one of its parts, is used to obtain delivery of both of the washing agents, and for this purpose the pump is of a reversible type; i.e., its actuator can be driven in a first direction to enable delivery of the first washing agent, and can be driven in a second, opposite, direction to enable delivery of the second washing agent, thanks to the command arrangement set between the pump and the second dispensing arrangement, which in the example includes the dosing valve 410. The command arrangement can be driven by a corresponding rotating member associated to the pump, as in the example described hereinafter, or else the command arrangement can be shaped so as to be driven by, or comprise, one of the parts of the pump 400, for example, its rotating assembly 401 and/or one of its compression elements 402 and/or one of its transmission members set between the rotating assembly 401 and the motor 404.

In various embodiments, the command arrangement comprises a transmission lever that can turn through an angle about a respective axis and is operatively associated to a valve member of a dosing valve forming part of the aforesaid second dispensing arrangement, such as the member 412 of the valve 410. This transmission lever is configured in such a way that:

- an angular movement in a first direction of the transmission lever, induced by driving of the peristaltic pump in the first direction of rotation, does not bring about a displacement of the valve member such as to cause dispensing of a second dosed amount of the second washing agent; and
- an angular movement in a second direction of the transmission lever, induced by driving of the peristaltic pump in the second direction of rotation, causes a displacement of the valve member such as to cause dispensing of at least one second dosed amount of the second washing agent.

According to what has been described above, the transmission lever could be driven by one of the parts of the peristaltic pump, such as its rotary assembly or one of its compression elements. However, in other embodiments, driving of the aforesaid dosing valve could be obtained by way of a member associated to the peristaltic pump, such as a cam member that defines a cam profile and that is able to be set in rotation by means by the actuator of the pump.

Figure 20:
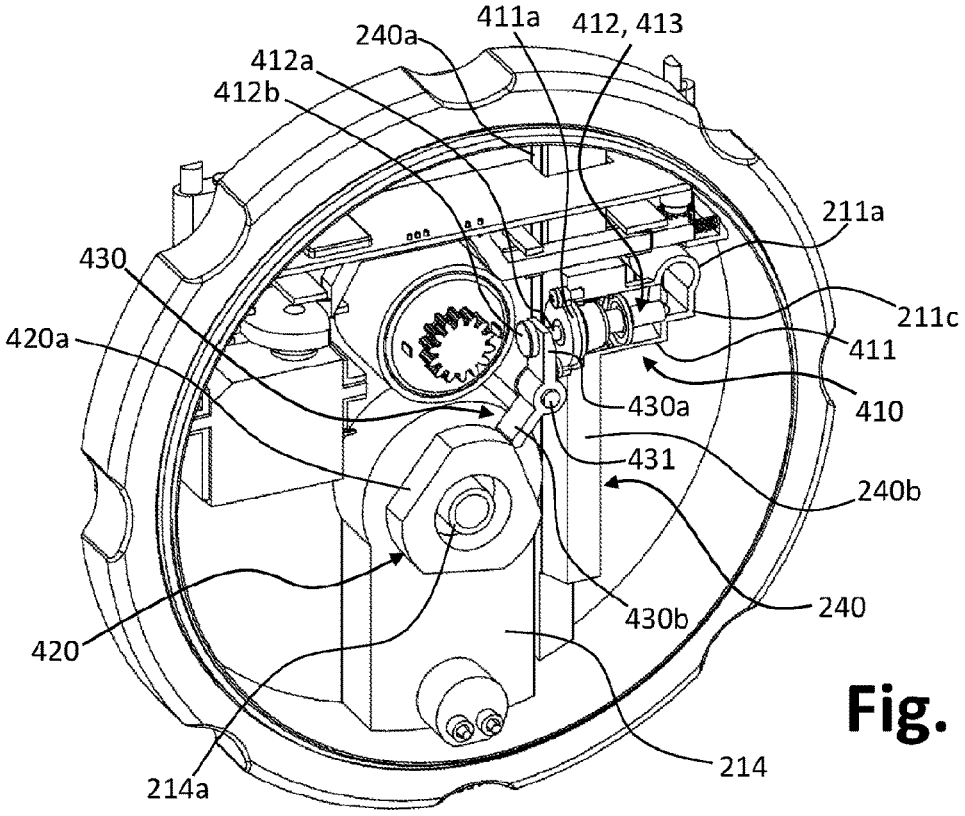
FIG. 20 is a schematic rear perspective view of a fixed part of a dispenser according to possible embodiments, with some components removed.

In the example of FIG. 20, the command arrangement includes such a cam member, designated by 420, whilst the corresponding cam profile is designated by 420*a*; preferentially, but not necessarily, the cam profile 420*a* is a multi-lobed profile, for example, tri-lobed as in the example.

Preferentially, the cam member 420 is coaxial and fixed in rotation with respect to the rotary assembly 411 of the peristaltic pump 400, even though this does not constitute an essential characteristic. The cam member 420—visible in isolation in FIG. 20 and in FIGS. 22, 24, 26, 28, and 30—can be defined integrally by the gear wheel 406, or associated thereto, at the back thereof (see FIG. 18).

In various embodiments, the aforementioned transmission lever belonging to the command arrangement has a first portion that defines a cam-follower configured to interact with the cam profile of the cam member, and a second portion that is constrained or associated to the valve member of the dosing valve. Such a transmission lever is designated as a whole by 430 in FIGS. 19 and 20. In the same figures, designated by 431 is the corresponding rotation pin, which can be defined integrally by the main body 201 of the fixed dispenser part 200, at the corresponding rear cavity C. In the example, the axis of rotation identified by the pin 431 is generally parallel to the axis of rotation of the cam member 420.

In the example, the transmission lever 430 comprises a first lever arm 430*a* and a second lever arm 430*b*, which extend in directions generally opposite to the axis of rotation identified by the pin 431. A first end portion, defining the aforesaid cam-follower—designated by 430*c* in FIG. 19—that is designed to co-operate with the profile 420*a* of the cam member 420, belongs to the arm 430*a*, whereas a second end portion, which is constrained—preferably in a slack way—to the portion 412*a* of the valve member 412 of the valve 410 that extends on the outside of the dosing chamber 411 belongs to the arm 430*b*. Once again with reference to the non-limiting example illustrated, the two lever arms 430*a* and 430*b* form between them an angle greater than 90°.

In various embodiments of this sort, the cam profile 420*a* of the cam member 420 and the transmission lever 430 are configured in such a way that:

- an angular movement in a first direction of the transmission lever 430, induced by rotation in a first direction of the cam member 420, does not bring about a displacement of the valve member 412 such as to cause dispensing of a dosed amount of the second washing agent; and
- an angular movement in a second direction of the transmission lever 430, induced by rotation in a second direction of the cam member 420, brings about a displacement of the valve member 412 such as to cause dispensing of a dosed amount of the second washing agent.

Figure 21:
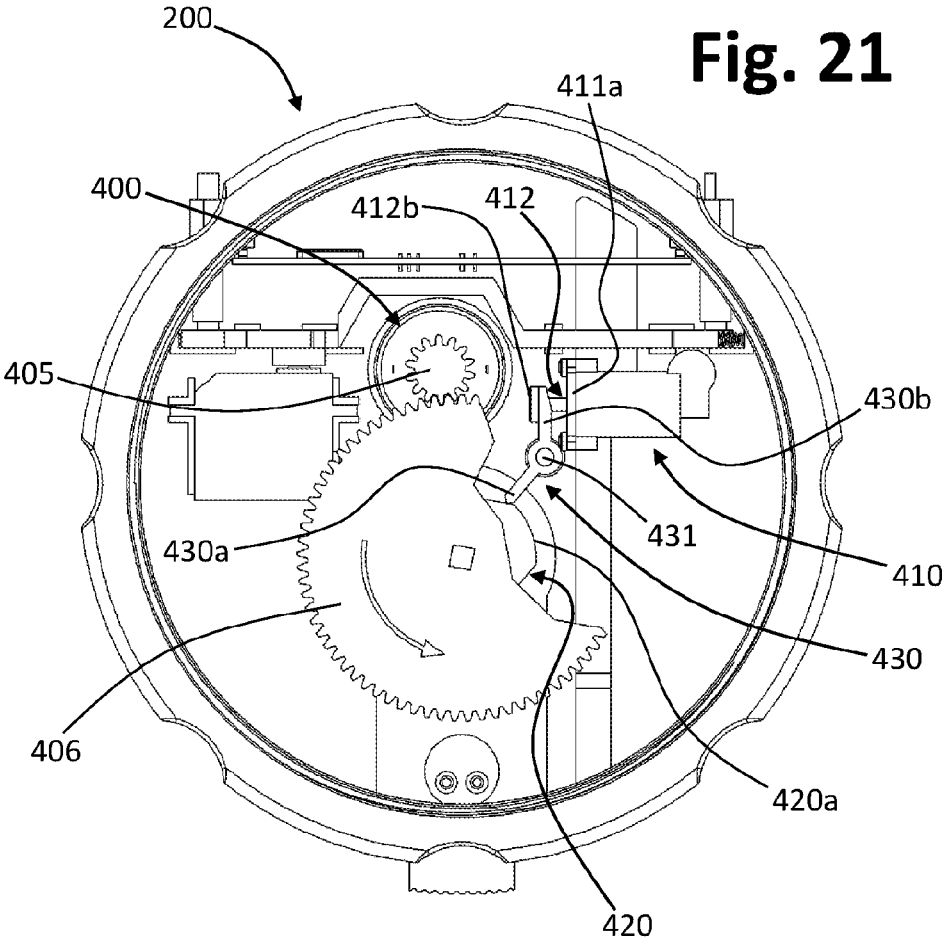
FIG. 21 is a schematic rear view, in elevation, of a dispenser according to possible embodiments in a first operating condition, with a corresponding component represented only partially.
Figure 22:
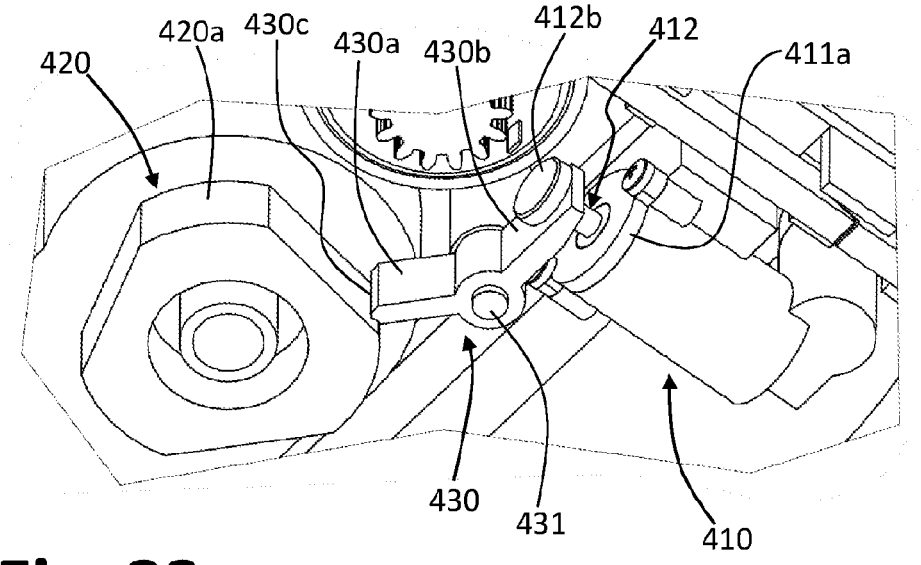
FIG. 22 is a partial schematic perspective view of a portion of the dispenser part of FIG. 21, in the aforesaid first operating condition, with a corresponding component removed.

The concept is exemplified in FIGS. 21-30. FIGS. 21-22 exemplify a possible condition that precedes start of rotation of the motor 400—i.e., of the corresponding shaft and of the gear wheel 405 associated thereto—in a clockwise direction, corresponding to which is a rotation in the counter-clockwise direction of the gear wheel 406, and hence of the cam member 420 associated thereto.

In this condition, the transmission lever 230 is in an angular position such that the cam-follower end of the lever arm 430*a* is on a straight stretch of the cam profile 410*a*, while the opposite end of the lever arm 430*b* is against the widened head 412*b* of the valve member 412 of the dosing valve 410, but without exerting any pulling action thereon. This valve member 412 is thus held by the corresponding spring in the closed position of the inlet 411*e* of the corresponding dosing chamber (see FIGS. 19-20).

Figure 23:
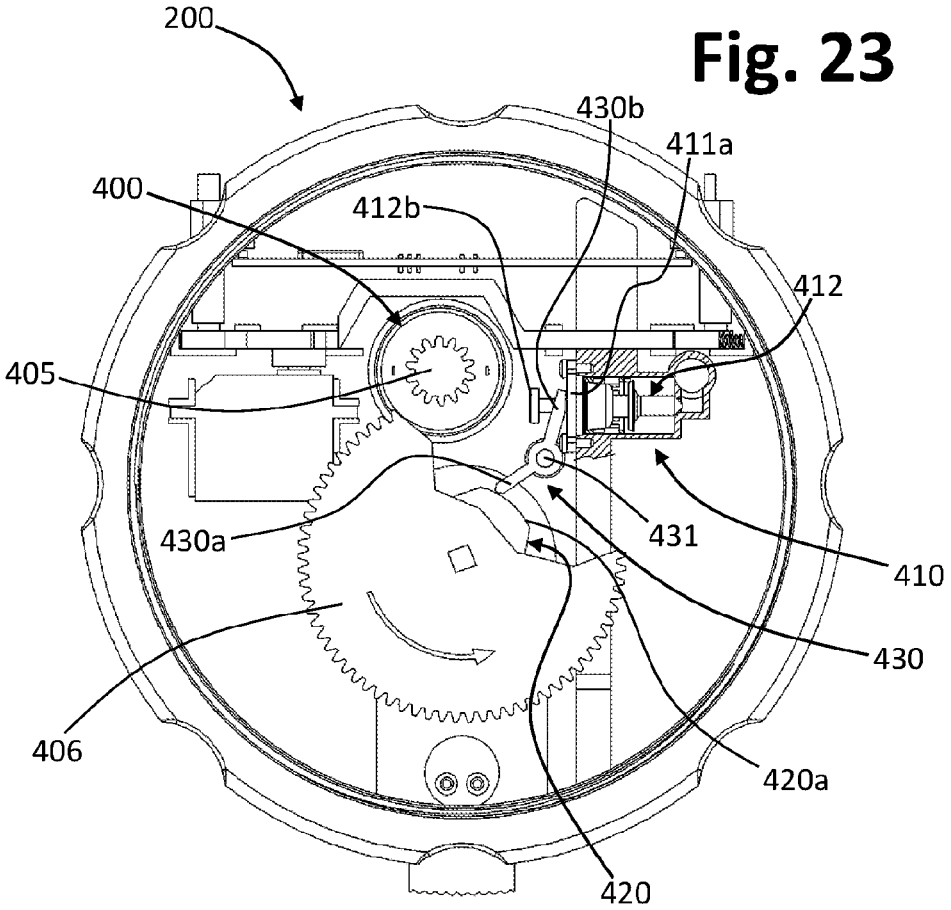
FIGS. 23-24, 25-26, 27-28 and 29-30 are views similar to those of FIGS. 21-22, respectively, of the dispenser in a second, third, fourth, and fifth operating condition, respectively.
Figure 24:
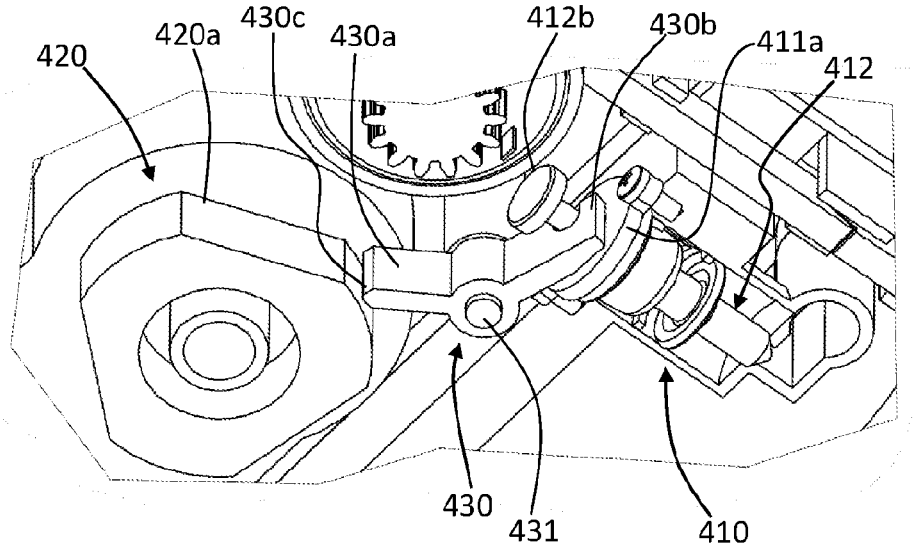

After start of rotation of the motor 400 in a clockwise direction, with the consequent counter-clockwise rotation of the cam member 410, the cam-follower end of the lever arm 430*a* will come to be in contact with a curved stretch of the cam profile 420*a*, such as to induce an angular movement in the clockwise direction of the transmission lever 430: the end of the lever arm 430*b* will hence move away from the widened head 412*b* of the valve member 412, possibly arriving in the proximity of the front surface of the lid 411*a* of the valve 410, and hence without exerting any pulling action on the valve member 412. This condition is illustrated in FIGS. 23-24.

The transmission lever 430 is preferably made of substantially rigid polymeric material or plastic material. However, with a particular shape and type of the material, the lever itself could possibly be able to bend slightly in an elastic way and then return to its original shape. In other words, the substantially rigid structure of the transmission lever 430 may be such as to enable the corresponding driving function, but can allow, if so required, slight elastic bending, for example, to compensate for dimensional tolerances which might cause mechanical interference. In the course of sliding of the cam profile 410*a* on the cam-follower end of the arm 430*a*, the latter (and/or the lever arm 430*b*) could be temporarily bent in an elastic way, in the case where the opposite end of the lever arm 430*b* were to be pressed on the lid 411*a* of the valve 410.

The angular displacement of the lever 430 hence does not cause a displacement of the valve member 412 or any action thereon, hence without causing any dispensing of the second washing agent by the dosing valve 410. As has been said, the end of the arm 230*b* can be constrained in a slack way on the portion of the valve member 412 that projects on the outside of the dosing chamber of the valve. The effect can be obtained by providing the lever arm 230*b* for example with a forklike shape, as may be seen, for example, in FIG. 24. The condition illustrated in FIGS. 21-24 occurs in the course of continuous driving of the motor 404 of the pump 400 in a clockwise direction, during which—via the pump itself—dosing of the first washing agent coming from the first tank R1 is obtained according to what has been described previously with reference to FIGS. 11, 12, and 18 regarding operation of the peristaltic pump 400.

Figure 25:
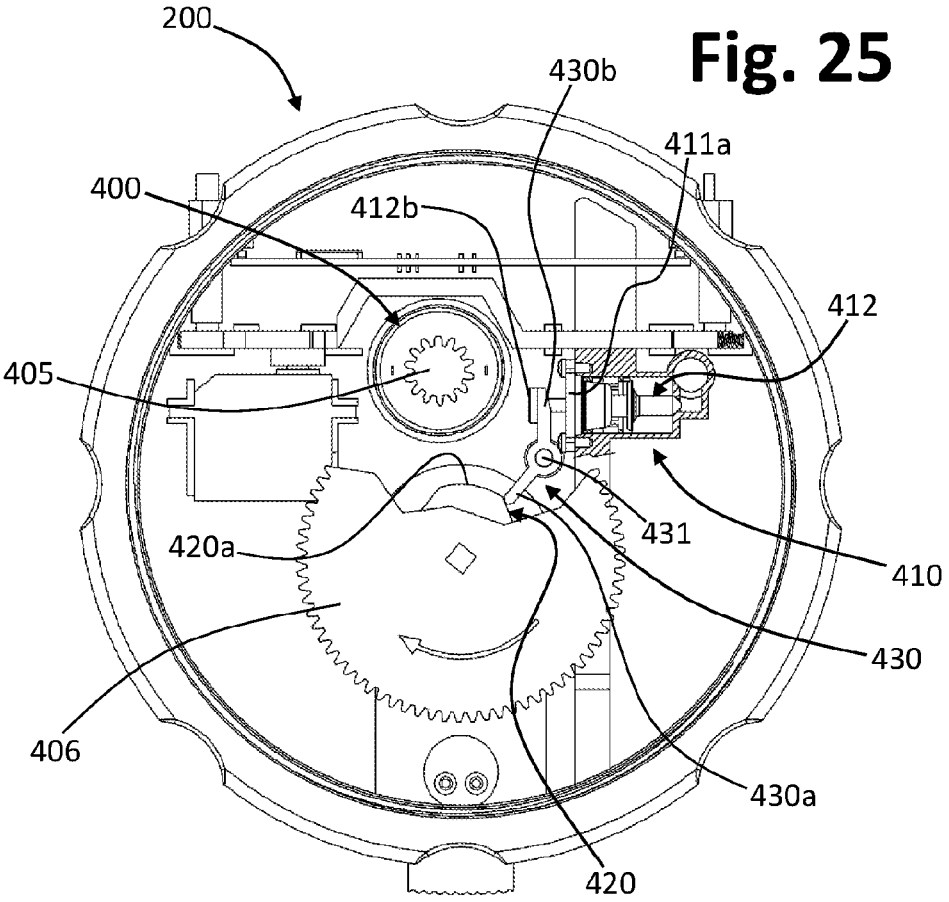
Figure 26:
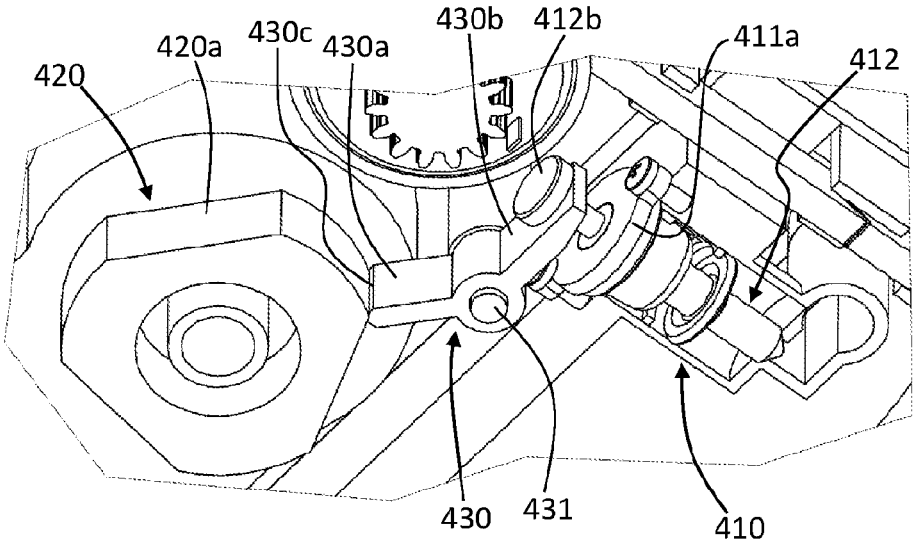

When delivery of a dose of the second washing agent coming from the second tank R2 is required, the motor 404 of the pump is driven in a direction opposite to the previous one, i.e., in a counter-clockwise direction. After start of rotation of the motor 404, with consequent rotation in a clockwise direction of the cam member 420, the cam-follower end of the lever arm 430*a* comes into contact with a rectilinear stretch of the cam profile 420*a* such as to induce an angular movement in the counter-clockwise direction of the transmission lever 430: the end of the lever arm 430*b* then comes back to resting on the widened head 412*b* of the valve member 412, without causing movement of the latter. This condition is illustrated in FIGS. 25-26.

Figure 27:
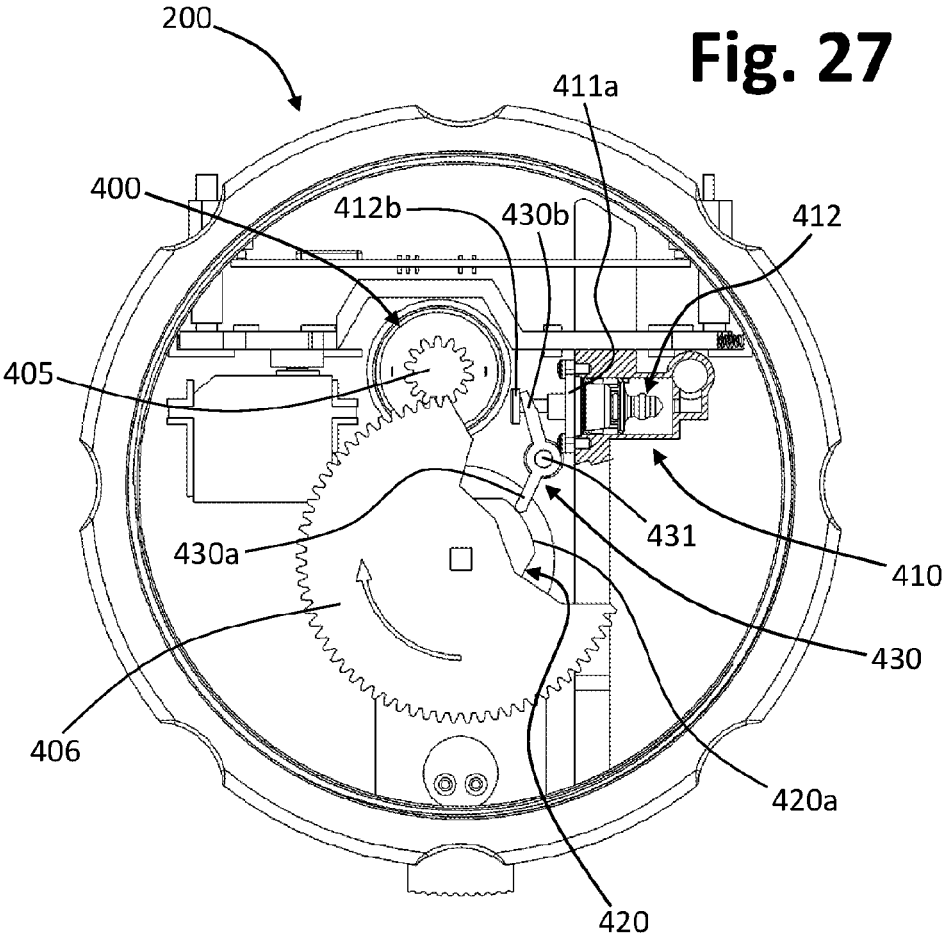
Figure 28:
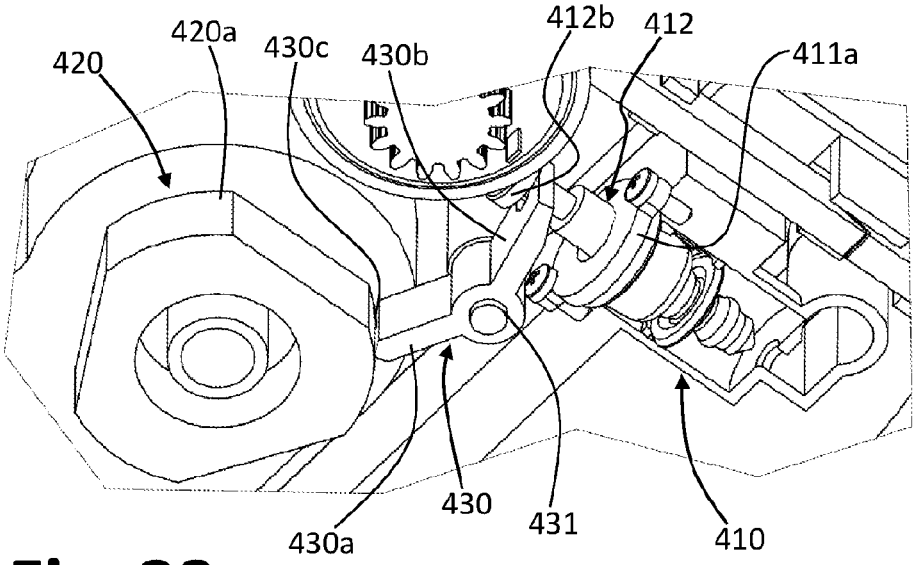

As rotation of the member 420 proceeds, the cam-follower end of the lever arm 430*a* comes into contact with a curved stretch of the cam profile 420*a*, such as to induce a further angular movement in the counter-clockwise direction of the transmission lever 430. In this way, the end of the lever arm 430*b* exerts a pulling action on the widened head 412*b* of the valve member 412, thereby bringing about recession of the valve member 412 against the action of the corresponding spring. This condition is illustrated in FIGS. 27-28. In this way, as explained previously, the valve member 412 frees the inlet 411*e* of the dosing chamber 411 (FIG. 19), enabling inflow into the chamber itself of a certain amount of the second washing agent, while the contact of the sealing flange 413*a* carried by the member 412 with the corresponding valve seat 411*d* prevents outflow of this amount of washing agent through the outlet 411*f* of the dosing chamber 411 (see once again FIG. 19).

Figure 29:
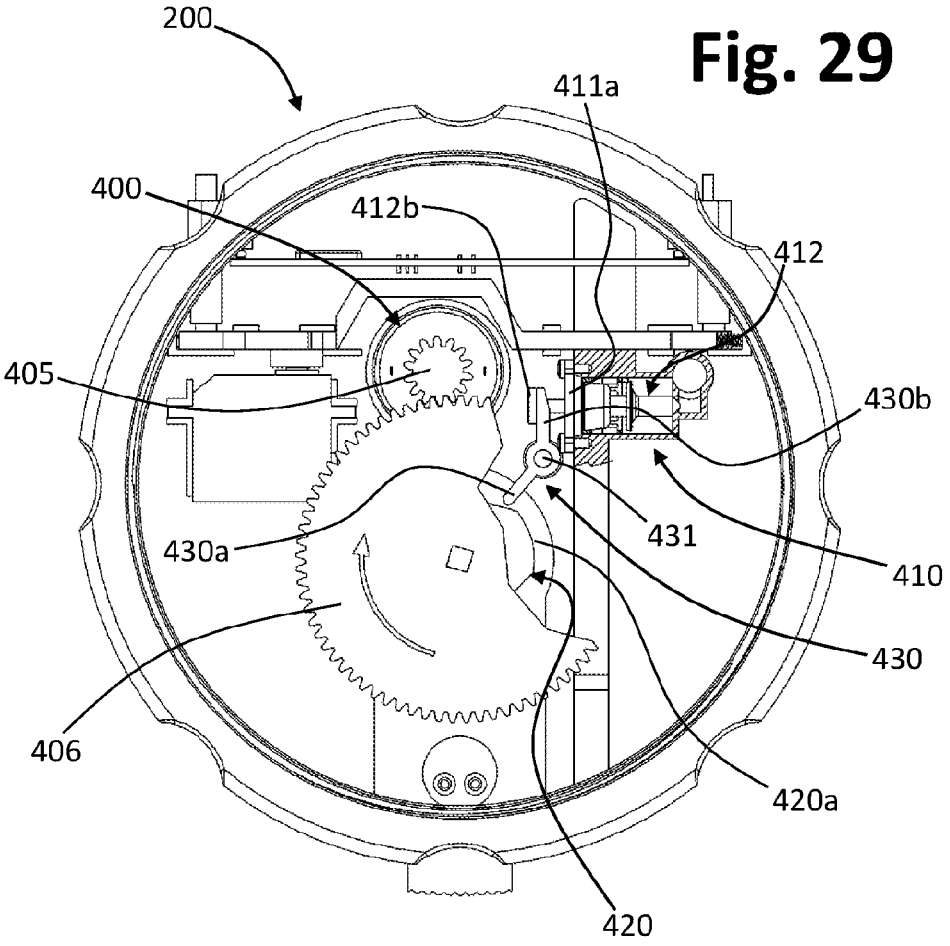
Figure 30:
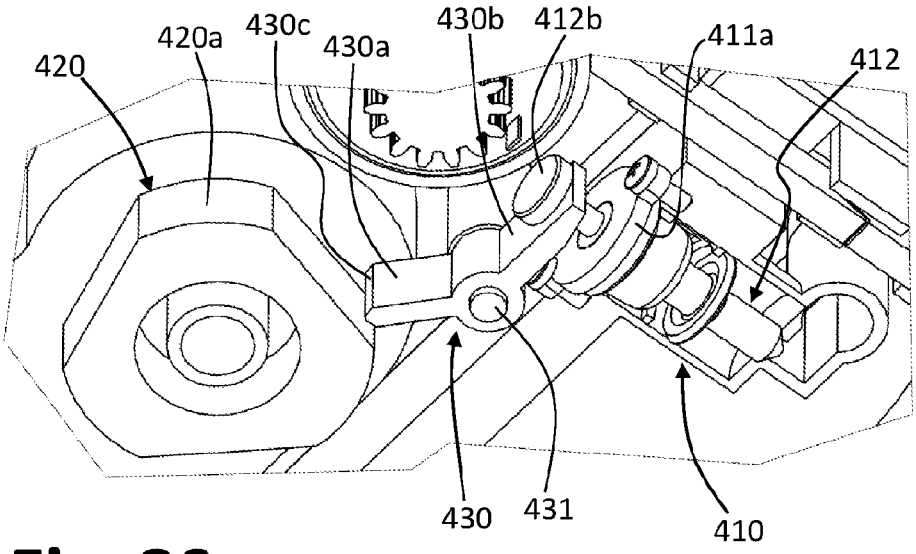

Further rotation of the member 420 causes the cam-follower end of the lever arm 430*a* to come back into contact with a rectilinear stretch of the cam profile 420*a*, now inducing an angular movement in the clockwise direction of the transmission lever 430, and hence enabling advance of the valve member 412 under the action of the corresponding spring. This condition is illustrated in FIGS. 29-30. In this way, as explained previously, the valve member 412 once again closes the inlet 411*e* of the dosing chamber 411, preventing any further inflow of the second washing agent, and the sealing flange 413*a* separates from the valve seat 411*f*, enabling the content of the dosing chamber to flow away through the corresponding outlet 411*f*.

It will be appreciated, with reference to the example illustrated, that to a rotation through 360° in the clockwise direction of the cam member 420 there corresponds dispensing of a number of dosed amounts of the second washing agent (three, in the specific example).

It will likewise be appreciated that, in the course of rotation in the counter-clockwise direction of the motor 404, there will occur a corresponding rotation of the rotating assembly 401 of the peristaltic pump 400, which, however, will not bring about any delivery of the first washing agent from the tank R1.

This rotation of the motor in the secondary direction, as against the primary direction of pumping into the washtub, is, however, useful also as regards the tank R1 in so far as pumping in the secondary direction can enable re-balancing of the volume of "air-washing agent" in the tank, i.e., compensation of the volume of a first dose of the first washing agent previously delivered by means of a rotation in the primary direction of the motor 404. Thanks to this characteristic, the tank R1 may possibly be without any venting openings.

Advantageously, pumping in the secondary direction enables pumping, into the aforesaid tank, of at least a fair share of the washing agent that has remained in the tube 403, in particular in the stretches 403*a* and 403*b*, in this way preventing any stagnation, which, for example, in the case of prolonged disuse, could cause faults, such as clogging of the tube.

It will therefore be appreciated that, in various embodiments, the function of re-balancing of the pressure inside the tank and/or of emptying the dispensing tube of a dispensing arrangement is obtained simultaneously with driving of another dispensing arrangement, in particular thereby enabling overall reduction of the times of activation of the pump, also with the advantage of a reduction in energy consumption.

It will moreover be appreciated that the rotating assembly 401 of the pump 400, and in particular at least one element 402 thereof, is configured so as to keep a portion of the deformable tube 403 constantly compressed even when the pump 400 is inactive, in this way preventing risks of faults, such as an undesired passage of the washing agent WD. This characteristic prevents, for example, any accidental emptying of the tank R1 and/or consequent washing anomalies due to the excess of agents WD accidentally poured into the washtub. Continuous compression of the tube 403 also prevents the undesired inlet of air into the tank, which may prove useful for reducing the risks of degradation of the washing agent.

The actuator 404 of the pump 400 is hence preferentially a reversible electric motor, operation of which can be managed by means of a suitable circuit arrangement, for example, a control circuit or controller, in itself known, implemented on an electronic card mounted on the fixed dispenser part 200, in particular within the cavity C of its main body 201. Such a card is, for example, designated by 250 in FIG. 12, and may comprise a microcontroller 251. The motor 404 may be a stepper motor, or else a different motor, preferably provided with a position sensor, such as a sensor of an encoder or resolver type; for this purpose, the control circuit or card 250 may comprise a circuit for control of the motor 404 and/or a circuit for control of the corresponding position sensor. To the card 250 there can be connected in signal communication the detector RD (FIG. 3) associated to the floating body 110 of the level sensor described with reference to FIGS. 6-8. The controller or card 250 may include memory means, which may contain data and parameters for controlling the motor 404, for the purposes of dosing of the first washing agent, with rotation in the primary direction, and of the second washing agent, with rotation in the secondary direction.

It should be noted, on the other hand, that a control circuit arrangement of the dispenser could be implemented totally or in part in the control system CS of the dish-washing machine 1. In various embodiments, a circuit arrangement on board the dispenser 10 is configured for connection to the control system CS of the dish-washing machine on which the dispenser itself can be installed, and the circuit arrangement of the dispenser is configured to enable control of the actuator of the pump as a function of electrical signals supplied by the aforesaid control system CS. For instance, the card 250 of the dispenser 10 may be provided with communication means in order to receive and/or transmit electrical signals from/to a controller of the control system CS of the dish-washing machine 1, for example, to receive data and parameters for controlling the motor 404, for the purposes of dosage of the washing agents, and/or to send electrical signals supplied by sensor devices on board the dispenser, and/or receive commands for other actuation devices on board the dispenser. The circuit arrangement on board the dispenser could in any case include even just a wiring and/or electrical connectors, electrically connected to at least one actuation device and/or a sensor device on board the dispenser, for direct control of the dish-washing machine 1 by the control system CS.

As has been seen previously, in various embodiments, the dispenser has a dispenser body, defined in which is at least one containment volume, which is able to contain a washing agent in liquid or semisolid form, as well as a dispensing arrangement, configured to dispense one or more dosed amounts of the washing agent, as well as a circuit arrangement, configured for connection to a control system of a dish-washer on which the dispenser itself can be installed. In various embodiments of this sort, the dispenser further comprises at least one operable part, configured to be displaced manually by a user at least from a first position to a second position. With reference, for instance, to the examples described previously, such an operable part may be represented by a plug or a hatch for opening or closing the inlet passage of a tank R1, R2, or by a driving element 220 (FIGS. 9-11) belonging to the coupling/uncoupling arrangement described above operating between the removable dispenser part 100 and the fixed dispenser part 200.

In particularly advantageous embodiments of this sort, the dispenser further comprises a locking/unlocking arrangement, which includes a locking mechanism that can be driven by a corresponding electric actuator to assume at least one operative condition and at least one inoperative condition, in which the locking mechanism prevents or enables, respectively, displacement of the aforesaid operable part from its first position to its second position. The aforementioned electric actuator is configured to be controllable as a function of an electrical signal supplied by at least one of a sensor device belonging to the circuit arrangement of the dispenser and the control system of the dish-washer on which the dispenser is installed, in order to cause passage of the locking mechanism from the at least one operative condition to the at least one inoperative condition.

The electrical signal used for managing the locking/unlocking arrangement may, for example, be a signal representing a level of the washing agent in the corresponding containment volume, supplied by a purposely provided sensor of the dispenser 10, or else representing a purposely provided command generated by the control system CS of the machine 1 (for example, a purposely provided key on the control panel of the dish-washing machine for enabling or preventing removal of the dispenser part 100 from the dispenser part 200 via the coupling/uncoupling arrangement described above).

As has been seen, the at least one volume for containing the washing agent, such as one of the tanks R1, R2, has a loading passage, and the aforesaid operable part may comprise a closing element associated to the loading passage. This closing element may be a plug or else, as in the examples illustrated, a hatch associated to which is an latching/releasing device. A possible embodiment of a locking/unlocking arrangement will now therefore be described with reference to a dispenser 10 according to various examples so far described, where the removable part 100 of the dispenser 10 includes two tanks R1 and R2, each having a loading passage 103 of its own provided with a corresponding hatch $\mathbf{104}_1$ and $\mathbf{104}_2$, respectively, associated to which is a respective latching/releasing device $\mathbf{105}_1$ and $\mathbf{105}_2$. As has been seen, to the tanks R1 and R2 there can be associated respective level sensors, for example, of the type described with reference to FIGS. 6-8, or of some other type (such as those described hereinafter).

Figure 31:
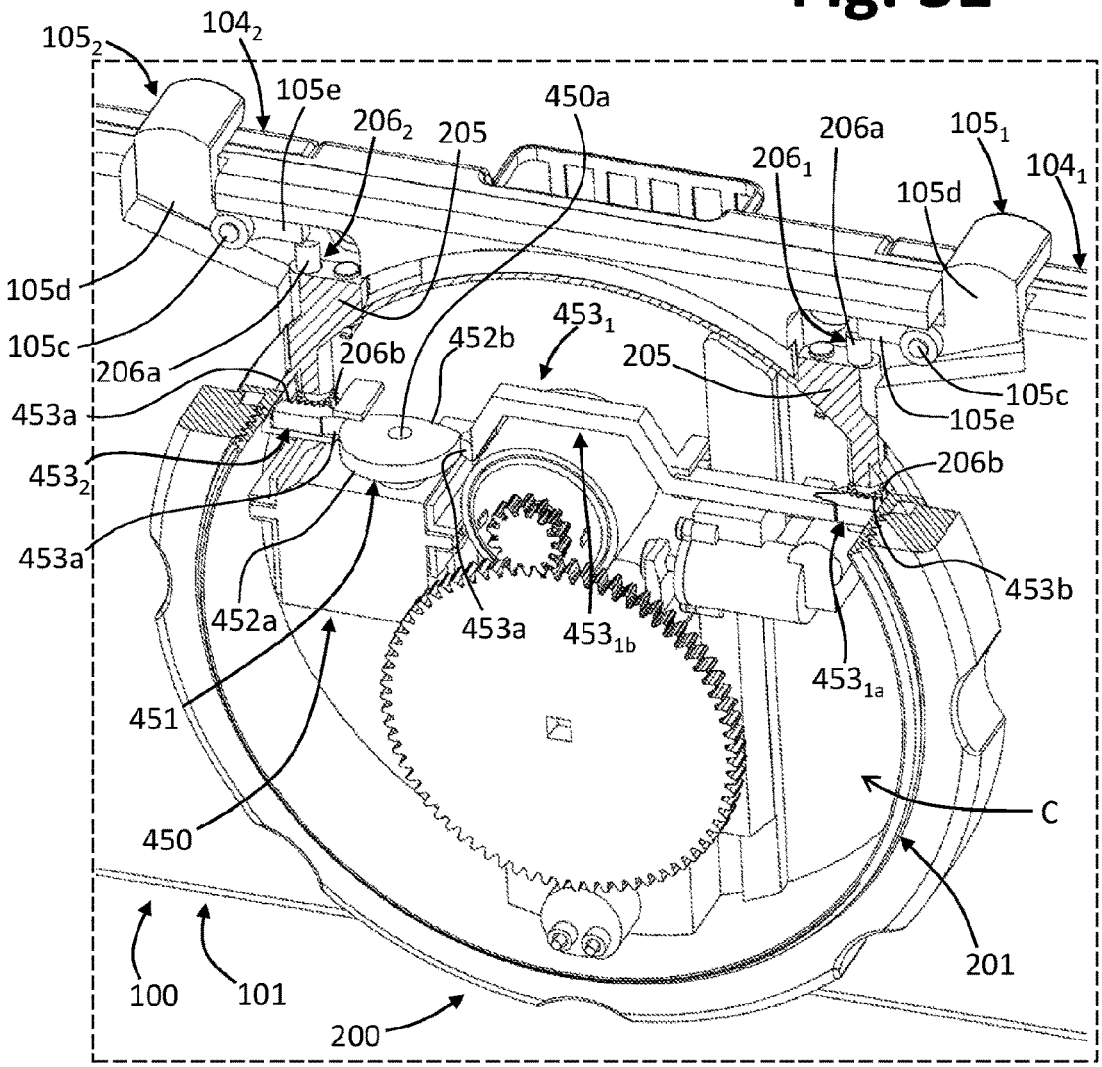
FIG. 31 is a schematic perspective partial view in partial cross section of a dispenser according to possible embodiments in a first operating condition, with a corresponding blocking/unblocking arrangement in a respective first condition.
Figure 32:
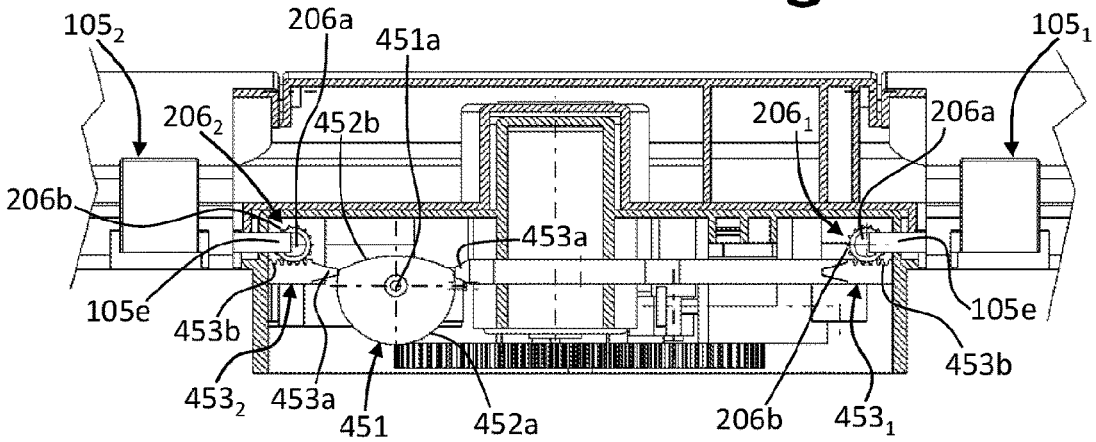
FIG. 32 is a schematic partial horizontal cross section of the dispenser of FIG. 31, with the corresponding blocking/unblocking arrangement in the aforesaid first condition.

With reference in particular to FIGS. 31 and 32, the locking/unlocking arrangement includes a locking mechanism, which can be driven by the electric actuator designated by 450 in FIG. 31, in particular a motor or an electromagnetic actuator, having an angularly movable drive shaft 450*a*, here set substantially according to the height dimension Y of the dispenser 10. Designated by 451 is a cam member, which is designed to be set in rotation through the shaft 450*a* of the motor 450; for this purpose, the member 451 can be keyed to the aforesaid shaft 450*a*. The cam member 451 defines a peripheral cam profile 452*a*-452*b*. Designated by $\mathbf{453}_1$ and $\mathbf{453}_2$ are a first mechanism member and a second mechanism member, each of which defines at an end thereof a corresponding cam-follower 453*a*. For simplicity, in what follows, the members $\mathbf{453}_1$ and $\mathbf{453}_2$ will also be defined as "sliders". In the example, the two sliders $\mathbf{453}_1$ and $\mathbf{453}_2$ are arranged with the respective cam-follower in opposed positions, corresponding to the cam profile 452*a*-452*b*.

In the example, the cam profile is defined by two opposite stretches that extend each according to a respective arc of circumference, the two circumferences being one larger than the other; for example, the stretch of a profile 452*a* may extend for more than 180° of a respective smaller circumference, whereas the stretch of a profile 452*b* may extend for less of 180° of a larger circumference. In general terms, the cam member 451 has at least one part of its peripheral cam profile that is suitable for bringing about displacement of at least one slider $\mathbf{453}_1$o $\mathbf{453}_2$, and at least one other part of the peripheral cam profile that is suitable for not bringing about displacements of the sliders $\mathbf{453}_1$ and $\mathbf{453}_2$. The cam member 451 could hence also be of a lobed type, for example, with three similar lobes, two of which opposite to one another and the third at 90° with respect to each of the others.

Each slider $\mathbf{453}_1$ and $\mathbf{453}_2$ is urged by a corresponding elastic element, such as a helical spring 454 (see FIGS. 33 and 35), towards the member 450 so that each cam-follower 453*a* is constantly in contact with the cam profile 452*a*-452*b* in the course of rotation of the member 450. Preferentially, then, each slider $\mathbf{453}_1$ and $\mathbf{453}_2$ is constrained to carry out linear displacements, here according to the width dimension X of the dispenser 10; for this purpose, provided in the main body 201 of the fixed dispenser part 200 are suitable guiding supports (not indicated).

Each slider may be made up of a number of parts. In the non-limiting example illustrated, the slider $\mathbf{453}_1$ is made up of two parts coupled together, designated by $\mathbf{453}_{1a}$ and $\mathbf{453}_{1b}$ only in FIG. 31, where the part $\mathbf{453}_{1a}$ has a structure similar to that of the slider $\mathbf{453}_2$ and the part $\mathbf{453}_{1b}$, which defines the corresponding cam-follower 453*a*, is conveniently shaped so as to be able to slide without finding any hindrance in other components of the removable dispenser part (such as the motor of the peristaltic pump described previously).

The locking mechanism further comprises a locking member, configured to interact with a respective movable member of the latching/releasing device $\mathbf{105}_1$ or $\mathbf{105}_2$ of a corresponding hatch $\mathbf{104}_1$ or $\mathbf{104}_2$. With reference to the case illustrated, there are hence provided two locking members, designated by $\mathbf{206}_1$ and $\mathbf{206}_2$, already previously mentioned with reference to FIG. 11, mounted passing through the aforesaid positioning and/or guiding formations 205, which rise from the peripheral wall of the main body 201 of the fixed dispenser part 200, in its portion facing the inside of the washtub (it should be noted that in FIGS. 32, 34, and 36 the formations 205 are not represented, for reasons of greater clarity). As mentioned previously, part of said formations 205, with a corresponding projecting end of the locking members $\mathbf{206}_1$ and $\mathbf{206}_2$, can be received in the recesses or seats 116 mentioned in regard to FIG. 4. The locking members $\mathbf{206}_1$ and $\mathbf{206}_2$ hence preferably extend in the height dimension Y of the dispenser 10, i.e., in a direction substantially perpendicular to the direction of displacement of the sliders $\mathbf{453}_1$ and $\mathbf{453}_2$.

Each blocking member $\mathbf{206}_1$ and $\mathbf{206}_2$ is displaceable between a blocking position and an unblocking position, with respect the respective movable member, here represented by the latching/releasing device $\mathbf{105}_1$ and $\mathbf{105}_2$ that are manually operable. As mentioned previously, in various embodiments, each latching/releasing device $\mathbf{105}_1$ and $\mathbf{105}_2$ basically consists of a lever member that can be turned through an angle about a respective fulcrum or axis 105*c* and that defines a first lever arm 105*e* and a second lever arm 105*d*, the second lever arm defining or having associated to it a respective element that is operable by a user. In embodiments of this sort, each locking member $\mathbf{206}_1$ and $\mathbf{206}_2$ has an end—designated by 206*a* in the figures—configured to interact with an end portion of a respective first lever arm 105*e*, to prevent or enable, respectively, an angular movement of the lever member that forms the latching/releasing device $105_1$ and $105_2$. In preferred embodiments, the aforesaid end 206*a* of the locking member $206_1$ or $206_2$ is an upper end.

Preferentially, each locking member $206_1$ and $206_2$ is mounted so that it can turn about the respective longitudinal axis. For this purpose, with reference to the examples illustrated, each member $206_1$ and $206_2$ is constrained in a rotatable way in a through seat defined in the respective positioning and/or guiding formation 205, with its upper end portion 206*a* and its lower end portion that project at the two ends of the formation 205.

In various embodiments, in order to obtain rotation of the locking member, the locking mechanism includes a transmission comprising toothed parts meshing with one another, preferably for a transmission of a pinion-rack type. For this purpose, preferentially each member $206_1$ and $206_2$ includes a respective toothing that extends according to a circumference or a part thereof and that meshes with a corresponding toothing of a respective slider $453_1$ or $453_2$. In the example represented, the lower end portion of each locking member $206_1$ and $206_2$ has a respective gear wheel 206*b* that meshes with a lateral toothing 453*b* of the respective slider $453_1$ or $453_2$, substantially with a transmission of a pinion-rack type. In this way, as may be appreciated, a linear displacement of each slider $453_1$ or $453_2$ causes rotation of the respective locking member $206_1$ and $206_2$ about the respective longitudinal axis.

In various preferential embodiments, the end portion 206*a* of each locking member $206_1$ and $206_2$, designed to interact with the respective first lever arm 105*e* of the corresponding latching/releasing device $105_1$ or $105_2$, has a substantially semi-cylindrical profile, with the locking member that presents an angular travel between the blocking position and the unblocking position of approximately 90°. It should be noted that the semi-cylindrical shape of the profile of the end portion 206*a* of each locking member $206_1$ and $206_2$ is to be understood as being provided merely by way of preferential example in so far as the end portion could also have a profile having the shape of a circular sector with an extension of less than 180° (for example, an extension of just 90°), without prejudice to the functions described hereinafter.

In FIGS. 31-32, the locking/unlocking arrangement is illustrated in a condition such that opening of both of the hatches $104_1$ and $104_2$ is prevented; i.e., switching of both of the latching/releasing devices $105_1$ and $105_2$ is prevented.

In the example represented, in this condition the cam member 451 is in an angular position such that both sliders $453_1$ and $453_2$ are held by the member itself in the respective retracted conditions, with a maximum compression of the corresponding springs 454. The simultaneous retracted position is determined by the fact that the cam-followers 453*a* of both of the sliders $453_1$ and $453_2$ interact with one and the same stretch of the cam profile, namely its more extensive stretch 452*a* of smaller radius.

Corresponding to this position of the sliders $453_1$ and $453_2$ is an angular position of the locking members $206_1$ and $206_2$ such that the corresponding upper ends 206*a* are arranged with their semi-cylindrical portion that extends underneath the end area of the first lever arms 105*e* of the latching/releasing devices $105_1$ and $105_2$. As may be appreciated, in this condition the devices $105_1$ and $105_2$ cannot be operated manually; i.e., an angular movement cannot be imparted thereon sufficient to enable release of the corresponding hatch $104_1$ or $104_2$. The condition illustrated is obtained via appropriate positioning of the shaft 450*a* of the electric motor 450, which may, for example, be a stepper motor, or else a different motor, possibly provided with a position sensor, such as a sensor of an encoder or resolver type. For this purpose the circuit or card 250 may comprise a circuit for control of the motor 405 and/or a circuit for control of the corresponding position sensor.

Control of the motor 405, i.e., of the cam member 451, in the position illustrated in FIGS. 31-32 is preferably determined by the electrical signal supplied by sensors that equip the two tanks R1 and R2, in particular the level sensors. More in particular, in the specific case illustrated, these signals will be indicative of the presence within both of the tanks R1 and R2 of an amount of washing agent that exceeds a pre-set minimum level, or a level indicating the need to top up the tank.

Figure 33:
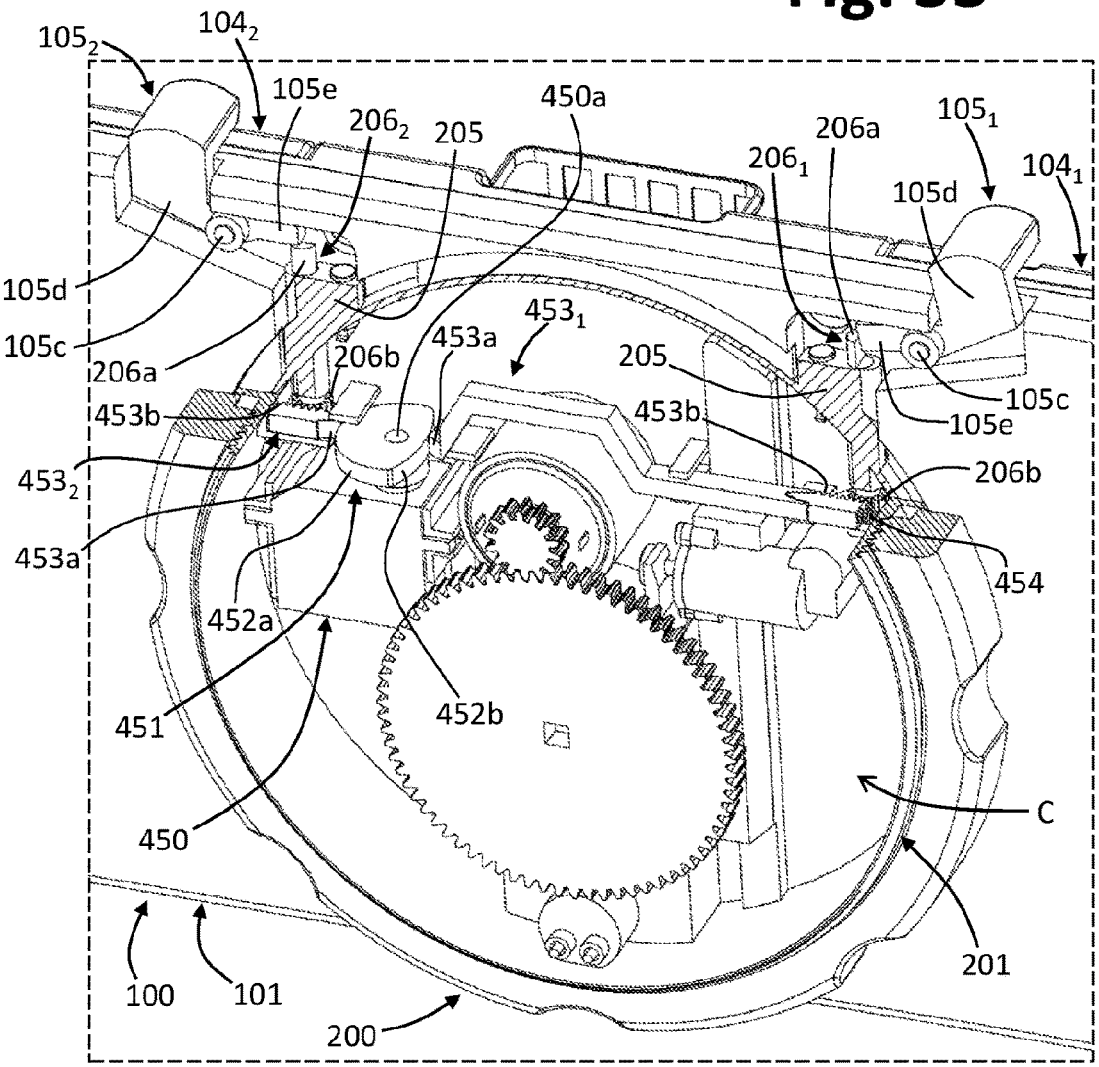
FIGS. 33-34 and 35-36 are views similar to those of FIGS. 31-32, respectively, of the dispenser in a second condition and a third condition of the corresponding blocking/unblocking arrangement.
Figure 34:
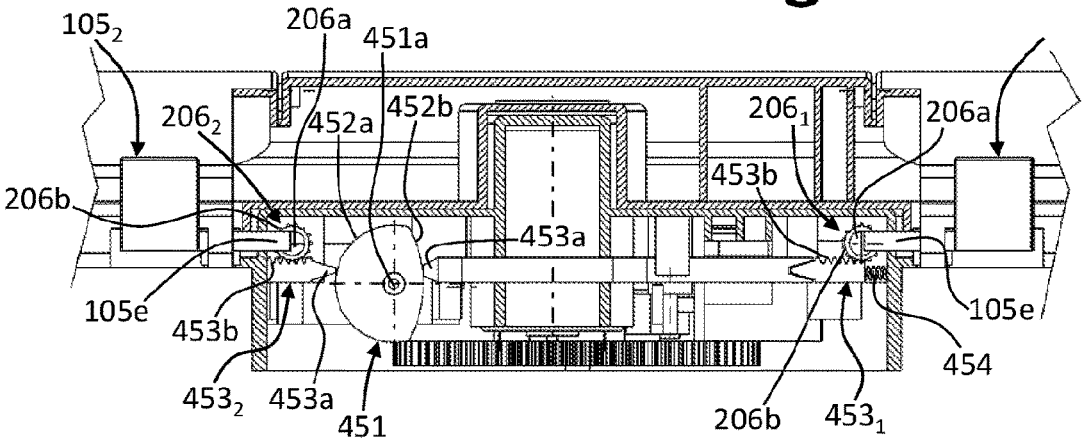

In FIGS. 33-34 the locking/unlocking arrangement is illustrated in a condition such that opening of the hatch $104_2$ is prevented and opening of the hatch $104_1$ is, instead, enabled; i.e., switching of the latching/releasing device $105_2$ is prevented and switching of the latching/releasing device $105_1$ is enabled. This condition arises when the amount of washing agent contained in the tank R1 drops below the pre-set minimum level, with the signal supplied by the corresponding level sensor that represents this condition. Assume that, at the same time, the amount of washing agent contained in the tank R2 exceeds, instead, the corresponding minimum topping-up level, and that the corresponding level sensor supplies a corresponding signal.

In the example represented, in this condition the cam member 451 is in an angular position such that the slider $453_2$ is held by the member itself in the respective retracted condition, with a maximum compression of the corresponding spring 454. Instead, the slider $453_1$ is pushed by the action of the corresponding spring 454 into a respective advanced condition. These different positions are determined by the fact that the cam-followers of the two sliders interact with different stretches of the cam profile: in particular, the cam-follower 453*a* of the slider $453_2$ interacts with the stretch of profile 452*a* that is more extensive and of smaller radius, whereas the cam-follower 453*a* of the slider $453_1$ interacts with the stretch of a profile 452*b* that is less extensive an of greater radius. Corresponding to this position of the sliders $453_1$ and $453_2$ is an angular position of the locking members $206_1$ and $206_2$ such that the upper end 206*a* of the member $206_2$ is set with its semi-cylindrical portion that extends underneath the end area of the lever arm 105*e* of the engagement/release device $105_2$, whereas the upper end 206*a* of the member $206_1$ is set with its semi-cylindrical portion that is staggered with respect to the end area of the lever arm 105*e* of the engagement/release device $105_1$. As may be appreciated, in this condition, it is only the device $105_2$ that cannot be operated manually, as already described above, whereas the device $105_1$ can be operated manually, i.e., an angular movement can be imparted thereon sufficient to enable release of the corresponding hatch $104_1$.

Also in this case, the condition illustrated is obtained via appropriate positioning of the shaft 405*a* of the electric motor 450, as a function of the signal supplied by the level sensors that equip the two tanks R1 and R2. As has been said, in the specific case illustrated, the signal of the sensor that equips the tank R2 will be indicative of the presence within the tank itself of an amount of washing agent that exceeds the corresponding pre-set minimum level, whereas the signal of the sensor that equips the tank R1 will be indicative the presence inside the tank itself of an amount of washing agent lower than the corresponding pre-set minimum level. The hatch $104_1$ of the tank R1 can thus be opened by acting on the latching/releasing device $105_1$ and topping-up with the corresponding washing agent can be carried out.

Finally, in FIGS. 35-36 the locking/unlocking arrangement is illustrated in a condition opposite to the one illustrated in FIGS. 33-34, i.e., such that opening of the hatch $104_1$ is prevented and opening of the hatch $104_2$ is, instead, enabled, i.e., a condition in which the amounts of washing agents contained in the tanks R1 and R2 are above and below, respectively, the corresponding pre-set minimum levels, as indicated by the signals supplied by the corresponding level sensors.

Consequently, in the example represented the cam member 451 is in an angular position opposite to that of FIGS. 33-34, with the sliders $453_1$ and $453_2$ held in the retracted condition and in the advanced condition, respectively. Corresponding to this position of the sliders $453_1$ and $453_2$ is an angular position of the locking members $206_1$ and $206_2$ such that the upper end 206*a* of the member $206_1$ is set with its semi-cylindrical portion that extends underneath the end area of the lever arm 105*e* of the engagement/release device $105_1$, whereas the upper end 206*a* of the member $206_2$ is set with its semi-cylindrical portion that is staggered with respect to the end area of the lever arm 105*e* of the engagement/release device $105_2$.

In this way, the device $105_1$ cannot be operated manually, whereas the device $105_2$ can be operated manually to enable opening of the corresponding hatch $104_2$. Of course, also this condition illustrated can be obtained via appropriate positioning of the shaft 450*a* of the electric motor 450 as a function of the electrical signal supplied by the level sensors. In the specific case illustrated, the signal of the sensor that equips the tank R1 will be indicative of the presence within the tank itself of an amount of liquid that exceeds the corresponding pre-set minimum level, whereas the signal of the sensor that equips the tank R2 will be indicative of the presence within the tank itself of an amount of liquid lower than the corresponding pre-set minimum level. The hatch $104_2$ of the tank R2 can thus be opened by acting on the latching/releasing device $105_2$ and topping-up with the corresponding washing agent can be carried out.

As mentioned previously, the closing element that equips the loading passage of a tank, i.e., the part that can be operated with which the locking/unlocking arrangement interacts, could be a plug, instead of a hatch (without ruling out possible combinations of the two elements). For such a case, the locking/unlocking arrangement could be of a conception similar to the one described above: for example, a latching/releasing system similar to one of those designated by $105_1$ and $105_2$ may be provided, where an latching element of the type designated by 105*b* in FIG. 3 is configured to interact with the plug (for example, partially sliding over it or penetrating into a peripheral seat or toothing thereof) in order to prevent rotation or removal thereof.

As explained previously, in various embodiments, the dispenser comprises a fixed dispenser part and a removable dispenser part, which is couplable in a removable way to the fixed dispenser part and defines at least one tank for a washing agent. In embodiments of this sort, the dispenser may also comprise a signalling arrangement, which includes at least one emitter device mounted on the fixed dispenser part, which is able to emit visible radiation and includes a light source, as well as at least one light-guide element configured to transfer the visible radiation emitted by the emitter device towards an area of the dispenser designed to face inside the washing chamber, the at least one light-guide element being on the removable dispenser part and being optically coupled in a separable way to the emitter device mounted on the fixed dispenser part. Preferentially, the light-guide element extends between a front and a back of the removable dispenser part, very preferably within a corresponding passage or mounting seat defined in the hollow body.

The dispenser may comprise at least one sensor device, configured to supply an electrical signal representing at least one condition of the content of the at least one tank, such as a level thereof or, as described also hereinafter, a characteristic different from the level thereof, in particular a qualitative characteristic thereof, such as a chemico-physical characteristic or a characteristic linked to its composition and/or type.

In the aforesaid embodiments, the signalling arrangement may be controllable as a function of the electrical signal supplied by the at least one sensor device. However, the signalling arrangement may belong to a circuit arrangement of the dispenser, which is configured for connection with a control system of a dish-washer on which the dispenser itself can be installed: in these cases, the circuit arrangement on board the dispenser may be configured to enable control of the signalling arrangement as a function of an electrical signal supplied by the aforesaid control system of the dish-washer.

A possible embodiment of the aforesaid signalling arrangement will be described with reference to a dispenser 10 according to various examples described so far, where the removable part 100 of the dispenser 10 includes two tanks R1 and R2, associated to which are respective level sensors, for example, of the type described with reference to FIGS. 6-8, or of some other type (for example, of the types described hereinafter).

With reference in particular to FIGS. 37-38, in various embodiments, mounted on the fixed dispenser part is at least one emitter device, which is able to emit visible radiation: in the example represented, each emitter device comprises a respective light source, designated by 260, for example, a source of a LED type. The light source 260 may, for example, be mounted on a control card of the dispenser, such as the electronic card designated previously by 205.

In various embodiments, each emitter device may also comprise a respective light-transmitting element on the fixed dispenser part 200, such as the elements already designated previously by 207, for example, in FIG. 11. As has already been seen, each light-transmitting element 207 may be mounted in a respective housing defined in the positioning and/or guiding formations 205. Each element 207 may be made of any material suitable for transmission of light, for example, polycarbonate.

As may be seen in FIG. 37, such a light-transmitting element 207 may extend axially according to the height dimension (Y) of the dispenser 10, above the light source 260. In this way, the light-transmitting element has an entry end 207*a* facing the light source 260 and an exit end 207*b*, through which the emitter device—here constituted by the source 260 and by the element 207—emits visible radiation.

The signalling arrangement includes a first light-guide element, designated as a whole by 261 in FIG. 37 (see also FIGS. 3 and 5), which is configured to transfer the visible radiation emitted by the emitter device 260, 207 towards the front area of the dispenser 10 designed to face the inside of the washtub 3 of the dish-washing machine 1. Also each element 261 may be made of any material suitable for transmission of light, for example, polycarbonate. The light-guide elements 261 are preferentially mounted in the upper portion 101*a* (FIGS. 3 and 5) of the hollow body 101.

Each first light-guide element 261 is mounted on the removable dispenser part 100, and in particular on its hollow body 101. For this purpose, in various embodiments, provided on the hollow body 101 is a corresponding through mounting seat, preferably substantially cylindrical, which extends between the front and the back of the hollow body 101. Such a seat is designated by 262*a*-262*b* in FIG. 37. As explained, in various embodiments, the hollow body 101 is formed by the union of at least one front piece and one rear piece (see, for example, FIG. 3, where these pieces are designated by $\mathbf{101}_1$ and $\mathbf{101}_2$): it should consequently be assumed that the seat part 262*a* is defined in the aforesaid front piece, whereas the seat part 262*b* is defined in the aforesaid rear piece. The seat parts 262*a* are visible also in FIGS. 6-8.

Advantageously, each first light-guide element 261 is designed to be optically coupled in a separable way with respect to the emitter device 260, 207. For this purpose, with reference to FIG. 37, the exit end 207*b* of each light-transmitting element 207 faces the entry end 261*a* of the corresponding light-guide element 261, preferably at a certain distance therefrom. On the other side, the exit end 261*b* of the light-guide element 261 faces frontally towards the outside of the corresponding mounting seat 262*a*-262*b*, preferably but not necessarily substantially flush with a front surface of the removable dispenser part 100, i.e., of its hollow body 101.

The entry end 261*a* of the first light-guide element 261 is preferably an inclined surface in the case where the axis of emission of the emitter device extends in a direction transverse with respect to the axis of the light-guide element. In the case exemplified, the emitter 260, 207 has an axis of emission that extends as a whole substantially vertically, whereas the light-guide element 261 substantially extends horizontally between its entry end and its exit end: for such a case, the exit end 207*b* of the element 207 may be substantially plane, and the entry end 261*a* of the element 261 may have an inclination of approximately 45°. Obviously, in the case where the transmission element 207 were to extend further up than the case represented in the figures, and the light-guide element 261 were at the same time shorter than what is represented, a reverse configuration would be possible, i.e., with the exit end 207*b* of the element 207 inclined and the entry end 261*a* of the element 261 substantially plane. Of course, the exit end 207*b* and the entry end 261*a* could also both be inclined. In general terms, at least one of the entry end 261*a* and the exit end 207*b* is shaped to enable optical coupling between the element 261 and the element 207.

As may be appreciated, the fact that each light-guide element 261 is optically coupled in a separable way with respect to the emitter device 260, 207 enables free removal of the removable dispenser part 100 from the fixed dispenser part 200, ensuring, instead, an efficient and precise transmission of light indications when the two parts in question are, instead, coupled together.

As already mentioned, management of the light source 260 of the emitter device can be carried out by a controller that equips the dispenser 10, such as the card 250 referred to previously, as a function of the signals supplied by the level sensor and/or quality sensor that equips each tank R1 and/or R2, or else can be carried out by the control system CS of the dish-washing machine 1.

In advantageous embodiments, the source 260 of the emitter device may be controllable for emission of radiation at different frequencies and/or different intensities, and hence with different colours and/or different light intensities in order to supply indications of a diversified type according to the information that is to be made available to a user of the dish-washing machine. For instance, emission of a green light could be understood as meaning the presence of an amount of washing agent greater than a pre-set minimum level and/or the presence of a proper washing agent in the tank (in the case where the sensor that equips the tank is able to detect the quality and/or type of washing agent), emission of a yellow light could be understood as meaning the need to top up with the washing agent, and emission of a red light could be understood as meaning the presence within the tank of a wrong washing agent and/or a washing agent that is contaminated (consider the case where a user fills or tops up the tank R1 dedicated for a washing detergent with a rinsing additive). Alternatively or in addition, for these or other indications, it might also be possible to use lights of the same colour that vary in intensity, for example, with more or less intense lights or flashing lights, or else that alternatively increase and decrease the light intensity.

It will thus be appreciated that, in various embodiments, one and the same signalling arrangement may be used for carrying information of a different type, via at least two different signalling modes (colours/flashing).

In various embodiments, the signalling arrangement that equips the dispenser comprises at least one second light-guide element, preferably located at a front of the removable dispenser part, with the second light-guide element that is optically coupled to the at least one first light-guide element and is configured to diffuse the visible radiation received by the at least one first light-guide element.

An embodiment of this sort is illustrated in FIGS. 39-44 for a dispenser 10, the removable part 100 of which is provided with at least one hatch, in particular two hatches $\mathbf{104}_1$ and $\mathbf{104}_2$. As explained previously, in solutions of this sort, on the front of the dispenser part 10 there may be defined reception seats 103*c* (FIG. 40) that are at least partially occupied by the corresponding hatch when this is in the closed position of the corresponding loading passage 103.

Figure 41:
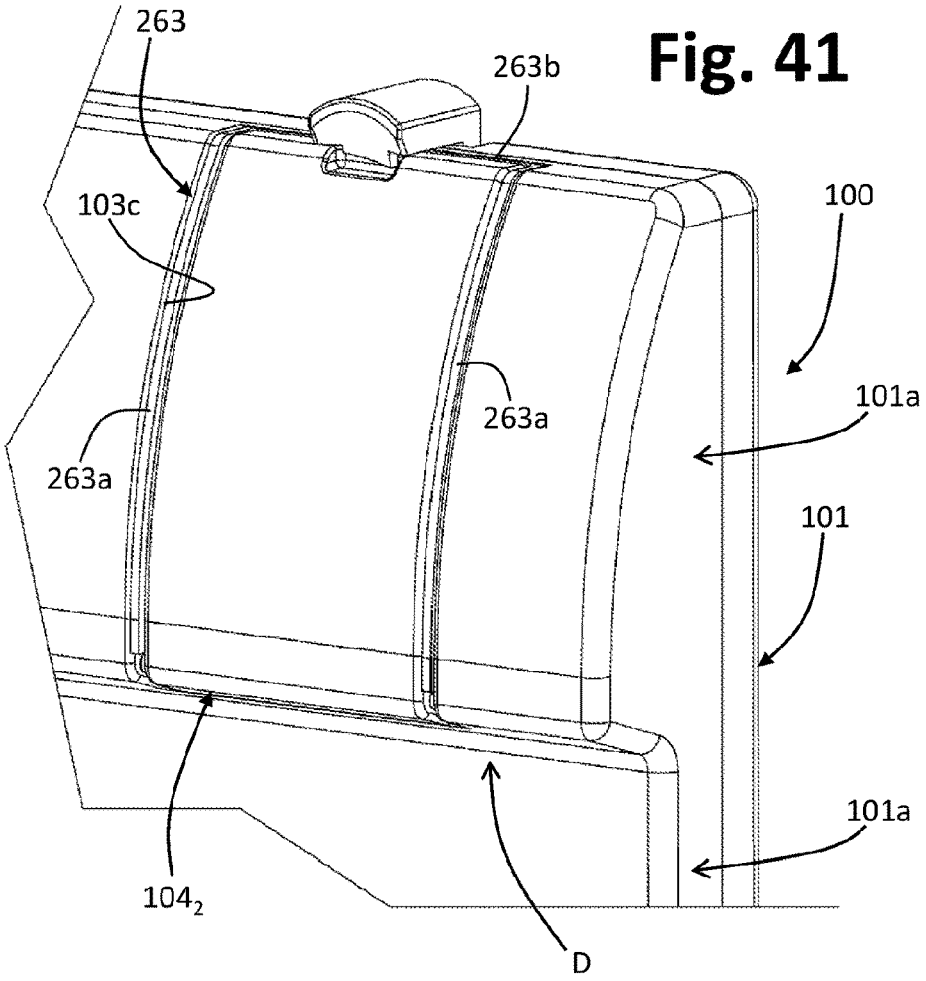
FIG. 41 is a detail at an enlarged scale of FIG. 39.

In the example illustrated in FIGS. 39-41, the aforesaid second light-guide element designed for diffusion of visible radiation, designated as a whole by 263, is at least partially set within an aforesaid seat 103*c* and preferentially extends along at least part of a perimetral area of the seat itself that is not occupied by the hatch. According to alternative embodiments, the second light-guide element may be at least in part set underneath a corresponding hatch $\mathbf{104}_1$, $\mathbf{104}_2$, with the latter made at least in part of transparent material and/or provided with an opening designed to enable vision of the optical signal. The light-guide elements could also be set in positions different from the ones exemplified, such as a position in any case close to a charging opening of a tank, for example, located in the proximity or alongside a seat of the type designated by 103*c* and/or of a hatch of the type designated by $\mathbf{104}_1$ or $\mathbf{104}_2$, or again alongside a plug that closes a charging opening.

To return to the example illustrated, the second light-guide element 263 hence extends at least in part in a gap existing between lateral facing surfaces of the seat 103*c* and of the hatch $\mathbf{104}_1$ or $\mathbf{104}_2$ so as to have at least one respective surface directly exposed, even when the hatch is in the closed position within the corresponding seat. It will consequently be appreciated that in embodiments of this sort it is not necessary for the exit end of each first guide element

260 to be directly visible at the front of the removable dispenser part 100, as, instead, in the case represented in FIGS. 3 and 5.

In preferential embodiments, the second light-guide element 263 extends along a number of contiguous sides of the seat 103*c* and hatch $\mathbf{104}_1$ or $\mathbf{104}_2$, for example, in the form of a frame. Obviously, the shape chosen may vary widely with respect to the one exemplified, also according to the position chosen for the second light-guide element 263 (for example, U-shaped, L-shaped, circular, semicircular, polygonal, etc.).

Figure 42:
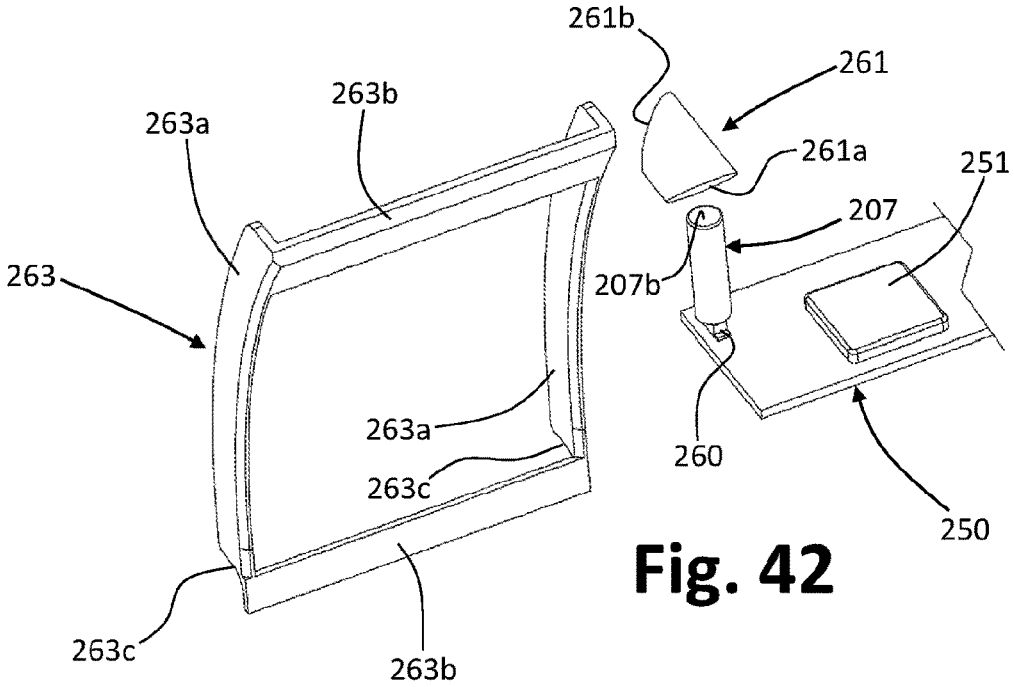
FIG. 42 is a schematic perspective view that shows in isolation some components of a warning system of a dispenser according to possible embodiments.

FIG. 42 illustrates the case of an element 263 shaped like a frame with four sides, including two upright parts 236*a* and two transverse parts 263*b*, which are relatively thin to define a substantially quadrangular shape. As may be noted, for example, in FIGS. 40 and 41, such a frame element 263 is mounted in a fixed position (for example, glued, or engaged, or welded, or interference inserted, or fixed via riveting of parts), within a seat 103*c*, with the upright parts 263*a* set up against corresponding lateral surfaces of the seat 103*c*; preferably, the upright parts 263*a* have an exposed surface, between the upper portion 101*a* of the hollow body 101 and the corresponding hatch $\mathbf{104}_1$ or $\mathbf{104}_2$.

The upper transverse part 263*b* is at the upper end of the seat 103*c*, set up against its bottom, in any case with an exposed surface at the upper edge of the hollow body 101. The lower transverse part 263*b* is, instead, at the lower end of the seat 103*c*, set up against its bottom, which is also with its lower surface possibly exposed between the seat 103*c* and the hatch $\mathbf{104}_1$ or $\mathbf{104}_2$, at the step D (FIG. 41) defined between the upper and lower portions 101*a*, 101*b* of the hollow body 101. In the example, given the presence of the lower transverse part 263*b*, its regions of connection with the upright parts 263*a* have a suitable shaping 263*c* to prevent interference with the lower hinging means of the hatch $\mathbf{104}_1$ or $\mathbf{104}_2$.

Visible in isolation in FIG. 42 are also some of the other elements belonging to the signalling arrangement, i.e., the light source 260 (also here mounted on the card 250), the light-transmitting element 207, and the first light-guide element 261.

Figure 43:
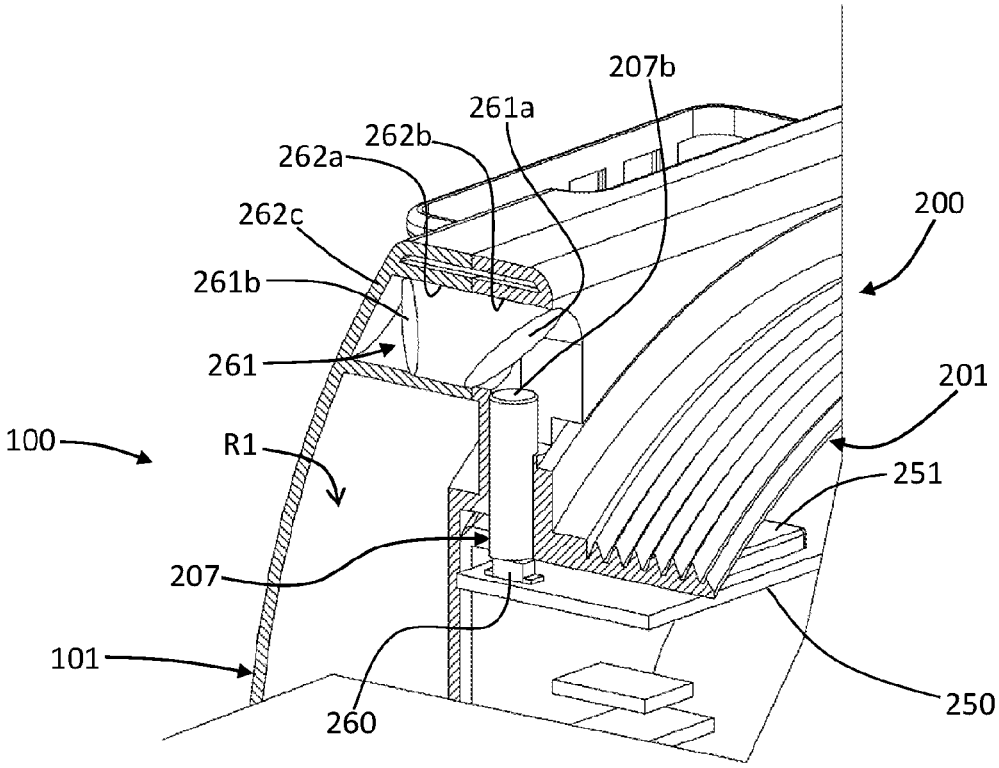
FIGS. 43 and 44 are schematic partial cross-sectional views, according to different planes of section, of a dispenser according to possible embodiments.
Figure 44:
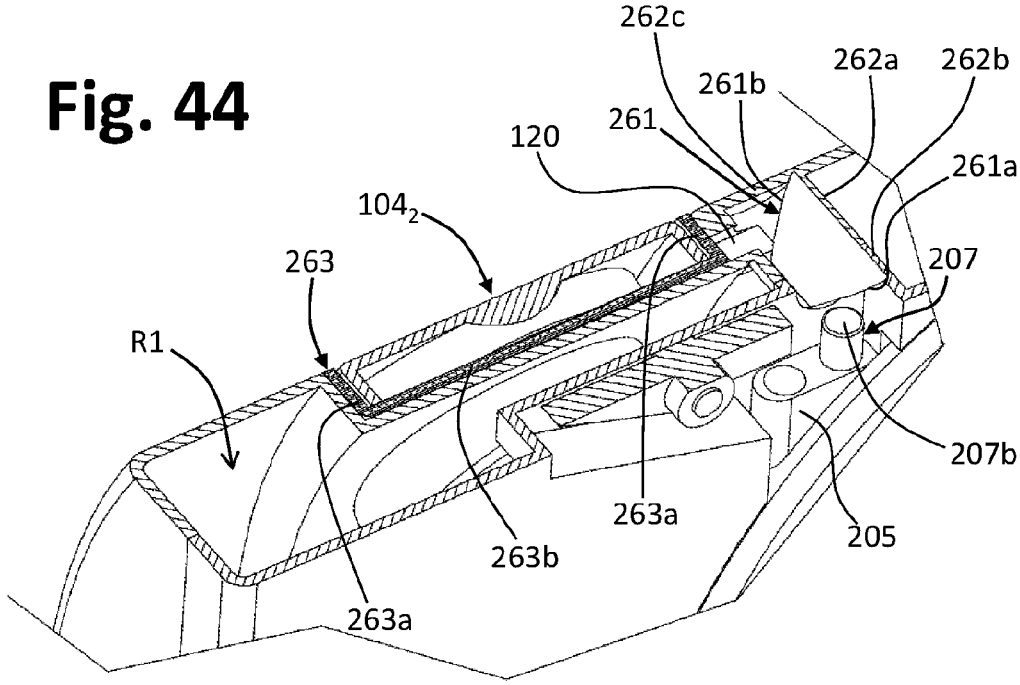

In embodiments of this sort, and as may be seen in FIGS. 43-44, the first light-guide element 261 may be shorter than in the case illustrated to FIG. 37, and it is preferable for its exit end 261*b* to be inclined in order to direct visible radiation at output into the second light-guide element 263. From FIGS. 43-44 it may moreover be noted how, in embodiments of this sort, the mounting seat 262*a*-262*b* of the first light-guide element 261 may be closed at the front by a corresponding portion of the front wall of the hollow body 101. From FIG. 44 it may be noted how in the hollow body 101, in particular in its front body piece ($\mathbf{101}_1$, FIGS. 3-4), an internal passage 120 is defined, which enables at least part of the exit end 261*b* of the first light-guide element 261 to face a corresponding portion (here belonging to an upright part 263*a*) of the second light-guide element.

In various embodiments, the first light-guide element 261 and the second light-guide element 263 substantially extend in a direction transverse with respect to one another, as in the case exemplified in FIG. 44. For this reason, it is preferable for the exit end 261*b* of the first element 261 to be inclined, for example, with an inclination of approximately 45°. In general terms, the first light-guide element 261 will have an outlet end 261*b* at least partially facing a corresponding portion of the second light-guide element 263, the exit end 261*a* being in any case shaped to enable an optical coupling between the elements 261 and 263. The two light-guide elements 261 and 263 could, however, also be rendered fixed with respect to one another (for example, engaged via snap action) or made of a single piece.

With reference, for example, to FIGS. 42 and 43, and as in the case of the embodiments of FIGS. 37-38, the light emitted by the source 206 impinges on the entry end 207*a* of the transmission element 207, then coming out of the corresponding exit end 207*b* to impinge upon the entry end 261*a* of the first light-guide element 261*a*. In this case, the visible radiation is then directed from the exit end 261*b* of the first light-guide element 261 towards the second light-guide element 263, thanks to the presence of the internal passage 120 (FIG. 44). The radiation, preferably a light radiation having a variable colour or intensity, is then propagated within the second element 263 and diffused along at least part of the perimeter of the seat 103*c* (FIG. 40), i.e., of the hatch $\mathbf{104}_1$ or $\mathbf{104}_2$ in order to be perceivable at the front of the removable dispenser part.

It should be noted that, albeit preferable, the emitter device set on the fixed dispenser part 200 does not necessarily have to include a light-transmitting element of the type designated by 207, in particular if the light source 260 is mounted on the aforesaid fixed part directly facing the entry end 261*a* of the first light-guide element 261.

The configurations exemplified in FIGS. 39-44 make it, for example, possible to highlight in a clear way to a user, preferably with radiation or lights of different colour and/or intensity, when a charging opening of a tank can be freely opened, for example, for topping-up or filling, and/or when a charging opening cannot be freely opened. In this way, it is, for example, possible to prevent the risk of excessive manual stresses on a hatch or on a plug that is prevented from being opened or removed by the blocking/unblocking arrangement described above to prevent failure of the dispenser or of parts thereof. Likewise, the light-guide configurations exemplified may be used for highlighting in a clear way possible fault conditions, such as a tank in which the wrong washing agent or a contaminated washing agent has been introduced, in such a way that the user can intervene in a timely way, for example, by removing the tank in question and washing it.

As also mentioned previously, in various embodiments, the dispenser includes at least one tank, preferentially operatively associated to which is a level sensor; in addition or an alternative, in various preferential embodiments, there may be operatively associated to the at least one tank a sensor for detecting at least one characteristic of the substance contained in the tank other than the level, and in particular a qualitative characteristic thereof. In the present description and in the attached claims, by "qualitative characteristic" is meant a characteristic or property linked to the type or composition of the substance, such as a chemical or physical or electrical characteristic. Detection of a qualitative characteristic may prove useful for the purposes of recognition of the type of substance, or of a possible contamination thereof or mixing thereof with another substance, or a possible deterioration thereof. This detection may, for example, enable limitation of possible risks that could derive from incorrect operations carried out by a user when topping up a tank, which could result in damage to the dispenser or in damage to the dish-washer, or in a poor washing result.

A quality sensor proves, for example, useful for recognising whether the substance contained in the tank is the right one, i.e., whether it corresponds to the one to which the tank in question is effectively dedicated. Consider, for example, the case where a user introduces, by mistake and without realizing, a liquid rinsing additive (brightener) into a tank dedicated, instead, for a liquid washing detergent: the possible subsequent starting of a dish-washing program in this condition would entail extremely negative effects, both in terms of low washing efficiency and in terms of an abundant production of foam, which is difficult to eliminate, within the tub 3, which could even jeopardise operation of the dish-washing machine 1 (the foam could infiltrate into ventilation ducts, until it penetrates into the door of the dish-washing machine, where the foam formed by an electrically conductive liquid—as is a brightener—could create short-circuits between electrical components of the dish-washing machine, or else this foam could come out into the domestic environment. Similar considerations may be made as regards mixing in one and the same tank of two different washing agents, or again as regards contamination of a washing agent with a different substance, for example, dilution thereof with water, which could reduce the washing efficiency, or else mixing with two different washing agents, where uncontrolled reaction between different chemical compounds could produce harmful substances. It should in any case be noted that such a quality sensor is associated to the dispenser body and is designed to detect characteristics of a substance contained therein, prior to its dispensing.

The signal supplied by a quality sensor of the type referred to can be conveniently used by a circuit arrangement of the dispenser or of the dish-washing machine to provide a suitable indication for the user (obviously with the machine supplied electrically), such as a warning of an audible type (for example, via a buzzer) and/or a warning of a visual type (for example, using a light warning system of the types exemplified previously).

In various embodiments, the quality-sensor device comprises a sensing element having at least two electrodes, prearranged for being in contact with the respective washing agent, and a circuit arrangement configured to measure the value of at least one electrical quantity between the at least two electrodes. The circuit arrangement, implemented on board the dispenser or in the control system of the machine, is configured to compare the value of the at least one electrical quantity measured with at least one respective reference value, and consequently generate information representing a qualitative characteristic of the washing agent. Such a sensor may possibly be pre-arranged to obtain also a measurement of level, as will be exemplified hereinafter.

Figure 45:
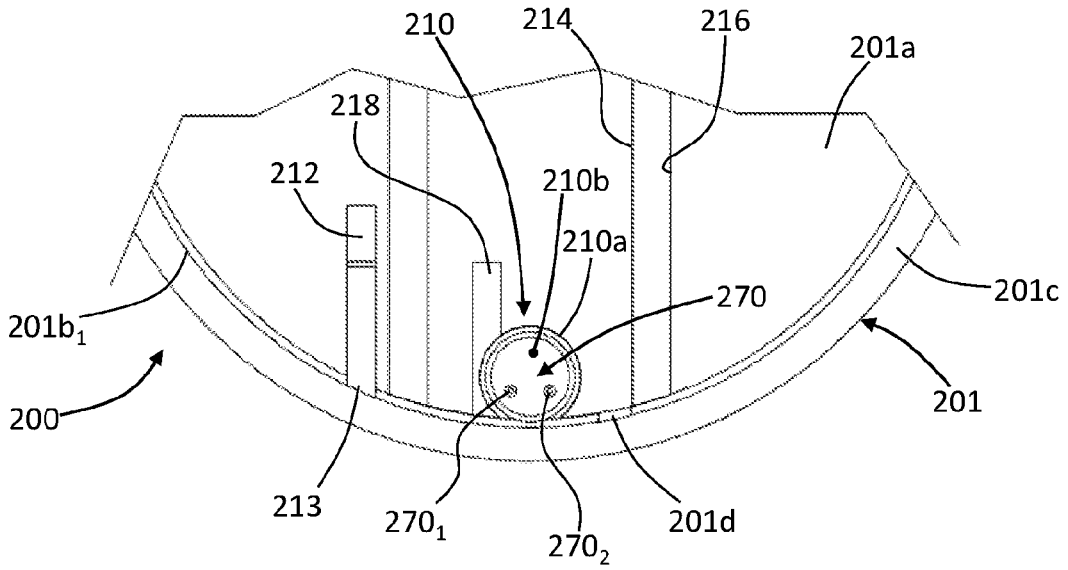
FIGS. 45 and 46 are schematic partial views, respectively a front view and a sectioned perspective view, of a bottom area of a part of a dispenser according to possible embodiments.

A possible embodiment of a quality sensor of the type referred to is illustrated schematically in FIGS. 45-46, which are partial views, respectively a front view and a sectioned perspective view, of a lower area of the fixed dispenser part 200, and in particular of its main body 201. In the aforesaid figures, some of the elements already described with reference to FIG. 11 are hence visible. It should be noted that in these figures, for requirements of clarity, the representation of the peristaltic pump described previously has been omitted; the attachment 218 to which the deformable tube of such a pump can be connected is, however, clearly visible.

As mentioned previously, the inlet 210 preferably comprises at least one cylindrical tubular portion, to enable coupling of the corresponding tubular outlet 112 of the tank R1 (see, for example, FIG. 4). In this way, in operative conditions of the dispenser 10, the inlet 210 is filled with the washing agent coming from the tank R1. Visible in FIG. 46 are the aforesaid cylindrical tubular portion, designated by 210*a*, as well as a corresponding bottom wall 210*b* (see also FIG. 12). In various embodiments, such as the ones represented in FIGS. 45-46, positioned at the inlet 210 is the sensing element 270 of a sensor device configured for detection of at least one qualitative characteristic of the washing agent coming from the tank R1.

In the example, the sensing element 270 comprises at least two electrodes $\mathbf{270}_1$ and $\mathbf{270}_2$, which project into the volume of the inlet 210. The electrodes are preferably made of metal and designed to come into direct contact with the washing agent, for example, when the electrical quantity being detected is the impedance or the conductivity or the capacitance.

Preferably, the at least two electrodes $\mathbf{270}_1$ and $\mathbf{270}_2$ each have a respective axis that substantially extends in the depth dimension Z of the dispenser 10; in these embodiments, the electrodes substantially extend parallel to one another. The axes of the at least two electrodes are preferentially at a distance comprised between 2 and 20 mm from one another, preferably comprised between 3 and 7 mm. In various embodiments, such as the one exemplified, the sensing element 270 comprises two electrodes $\mathbf{270}_1$ and $\mathbf{270}_2$ substantially at one and the same height, with reference to the height dimension Y of the dispenser 10. Of course, the length and the position the electrodes $\mathbf{270}_1$ and $\mathbf{270}_2$ is such that they occupy in depth (dimension Z) only a part of the inlet 210 in order not to constitute a hindrance to insertion in the inlet itself of the tubular portion (112*a*, FIG. 4) that forms the corresponding outlet of the tank R1, provided on the back of the removable dispenser part 100.

In the example, the electrodes $\mathbf{270}_1$ and $\mathbf{270}_2$ are driven in a fluid-tight way into respective through holes provided in the bottom 210*b* of the inlet, and have for this purpose an abutment flange 271, which can also possibly perform sealing functions. In addition or as an alternative to the flange, the electrodes $\mathbf{270}_1$ and $\mathbf{270}_2$ could be provided with respective seal rings. Instead of driving, fixing between the body of the dispenser and the electrodes could be obtained by overmoulding the former on the latter. The electrodes $\mathbf{270}_1$ and $\mathbf{270}_2$ could comprise an electrically conductive polymer, such as a polymer with electrically conductive fillers, for example powders or metal fibres and/or containing carbon fibres. The electrodes $\mathbf{270}_1$ and $\mathbf{270}_2$ could also have a shape different from the one exemplified. Possibly, the electrodes could be isolated from the liquid substance, for example, coated with a layer of electrically insulating material, if they are designed for measurement of an electrical quantity that does not imply a direct contact with the substance, for example, a measurement of capacitance: in such a case, it is sufficient for the coated electrodes to be arranged so that they can at least partially be immersed in the substance.

In other embodiments still, the sensing element could be configured like a stand-alone module, coupled in a sealed way to the rear part of the inlet, for this purpose provided with a suitable mounting opening (variants of this sort will be described hereinafter).

Once again with reference to the example illustrated in FIG. 46 (see also FIG. 12), the part of the electrodes $\mathbf{270}_1$ and $\mathbf{270}_2$ that projects at the rear from the inlet 210 can be at least partially surrounded by shaped formations 210*c*, preferably cylindrical, for example, to define an electrical connector used for connection of the sensing element 270 to the circuit arrangement on board the dispenser 10 or to the control system CS of the dish-washer.

In various embodiments, the value of the electrical quantity measured between the electrodes $\mathbf{270}_1$ and $\mathbf{270}_2$ of the sensing element 270 is used by the circuit arrangement of the dispenser 10 or by the control system CS of the dish-washing machine 1 for assessing the correctness or quality of the substance present at the inlet 210 or else of the washing agent contained in the corresponding tank. For this purpose, the aforesaid circuit arrangement of the dispenser or of the control system CS of the machine 1 preferentially includes memory means, stored in which are values or ranges of reference values (for example, in tabulated form) of the electrical quantity in question, representing those washing agents that are considered correct for the specific tank, here the tank R1.

The circuit arrangement hence compares the value of the quantity detected via the sensing element 270 with the reference values stored, and consequently controls generation of a suitable audible and/or visual warning, as mentioned previously. For instance, in the case where the washing agent detected corresponds to one of those encoded in the memory means, the warning system is not activated, or is activated in a first mode (for example, a short intermittent sound or a green light); in the opposite case, the warning system is activated, or is activated in a second mode (for example, a continuous sound or a red light). As has been said, the aforesaid circuit arrangement may, for example, be implemented in the card previously designated by 250, including the microcontroller 251, or else be implemented in the control system CS of the dish-washing machine 1.

In particularly advantageous embodiments, the electrical quantity detected between the at least two electrodes $\mathbf{270}_1$ and $\mathbf{270}_2$ of the sensing element 270 is the impedance. Some possible detection modes based upon measurement of impedance will be described hereinafter, also with reference to alternative sensor versions.

Of course, a quality sensor of the type described with reference to FIGS. 45-46 may be provided at the inlet 211, to which the tank R2 is to be connected, for example, at the back of its tubular part 211*a*, 211*b* (see, for instance, FIG. 12).

As has been seen, in various embodiments the dispenser includes a fixed dispenser part and a removable dispenser part, the latter comprising a hollow body that defines at least one tank, where at least one first wall of the hollow body is designed to face at least partially at least one second wall of the fixed dispenser part, and the dispenser comprises at least one sensor device, configured to supply an electrical signal representing at least one of a level and a qualitative characteristic of the content of the at least one tank. In embodiments of this sort, the at least one sensor device is arranged at least in part on the fixed dispenser part. In preferential embodiments, the sensor device is entirely arranged on the fixed dispenser part.

In various embodiments, the at least one tank has, preferably in a lower part thereof, an outlet in a wall of the hollow body, which can be coupled in a separable way to a respective inlet present in a wall of the fixed dispenser part: in particularly advantageous embodiments, the sensor device is arranged substantially at the inlet, or in a corresponding housing in fluid communication with the inlet.

Such a solution may also be explained with reference to FIGS. 45-46 already considered, in which the sensing element 270 is arranged at the tubular inlet 210 of the fixed dispenser part 200, which is designed to receive in a removable way the corresponding tubular outlet 112 (FIG. 4) of the removable dispenser part 100. In this way, as may be appreciated, the sensor device can be entirely mounted on the fixed part 200 of the dispenser 10, thus enabling removal without problems of the removable part 100 and without having necessarily to provide on the removable part other components of the sensor (such as the floating body of FIGS. 6-8). Of course, for this purpose the sensing element 270 does not necessarily have to be mounted at the inlet 210, it being possible for it to be set in fact at least partially in a corresponding housing separate from the inlet 210, for example, a purposely provided a chamber defined by the main body 201 and connected in fluid communication with the inlet 210 (such a solution will be described hereinafter for a sensor of a piezoelectric type).

The preferential version with at least one sensor device set on the fixed dispenser part makes it possible to facilitate and/or guarantee reliability of the corresponding electrical connections in so far as a fixed electrical connection is provided (for example, a wiring) between the dish-washer and the fixed dispenser part, albeit enabling detection of the content of the removable dispenser part, i.e., the content of the at least one tank R1 or R2. It is also clear that the concept of mounting of the entire sensor on the fixed dispenser part also applies as regards the already mentioned possibility of mounting a sensing element 270 at the inlet 211, for example, at the back of its tubular part 211*c*, 211*c* (see, for example, FIG. 47).

The solution of providing a sensing element with at least two electrodes, which are designed to be at least partially immersed in the washing agent, can be advantageously used also for the purposes of production of a level sensor.

Figure 47:
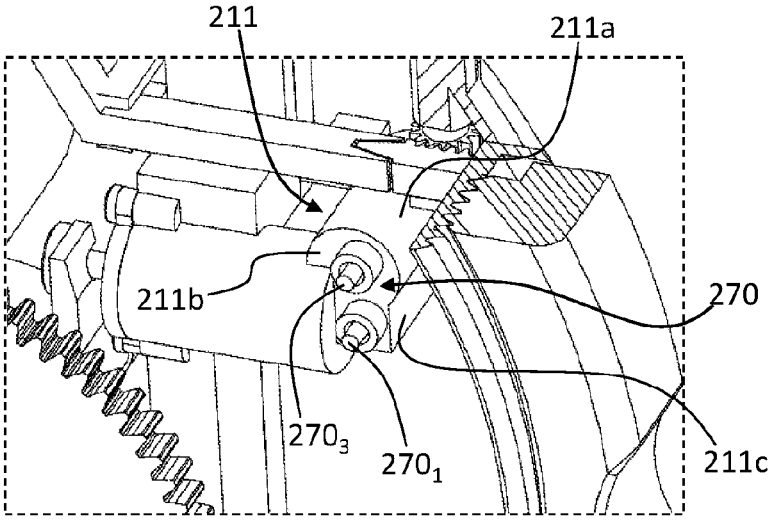
FIG. 47 is a schematic partial view in partial cross section of a portion of a dispenser according to possible embodiments.

An embodiment of this sort is exemplified in FIG. 47 as regards installation of a sensing element 270 at the inlet 211 for the contents of the tank designated previously by R2. Of course, in addition or as an alternative, a similar sensing element could be mounted at the inlet 210 for the contents of the tank designated previously by R1.

In the example of FIG. 47, the sensing element 270 includes two electrodes $\mathbf{270}_1$ and $\mathbf{270}_3$, arranged at the bottom 211*b* of the inlet 210 and of the corresponding lower extension 211*c*, already described previously, these electrodes being at different heights, with reference to the height dimension (Y) of the dispenser 10. The electrodes $\mathbf{270}_1$ and $\mathbf{270}_3$ can be built in a way similar to the electrodes already described above, and hence be made, for example, of metal material or other electrically conductive material (possibly coated with an insulator, for example, in the case of capacitive measurement) and each have a respective axis that substantially extends in the depth dimension (Z) of the dispenser 10, preferably parallel to one another and at a distance indicatively comprised between 3 and 7 mm. Also in this case, the part of each electrode $\mathbf{270}_1$ and/or $\mathbf{270}_3$ that extends into the inlet 211 will have a length and a position such as not to constitute a hindrance to insertion of the tubular outlet 113 of the corresponding tank R2 (see FIG. 4).

Also in the case of the level sensor exemplified in FIG. 47, the value of the electrical quantity measured between the electrodes $\mathbf{270}_1$ and $\mathbf{270}_3$ of the sensing element 270 is used by a circuit arrangement of the dispenser 10 or of the dish-washing machine 1 for assessing the level of the washing agent present in the inlet 211, which represents a level of the washing agent contained also in the corresponding tank R2, in particular a threshold level.

The aforesaid circuit arrangement can hence include memory means, stored in which is at least one reference value of the electrical quantity in question, for example, a value representing the simultaneous contact of both of the electrodes $\mathbf{270}_1$ and $\mathbf{270}_3$ with the washing agent in question (or, more in general, with a liquid or semisolid substance). The value representing the simultaneous contact of both of the electrodes $\mathbf{270}_1$ and $\mathbf{270}_3$ with the washing agent could hence indicate, for example, a level of the washing agent that exceeds a minimum value.

The circuit arrangement hence compares the value of the quantity detected via the electrodes $\mathbf{270}_1$ and $\mathbf{270}_3$ of the sensing element 270 with the at least one reference value stored. It will be appreciated that, when both of the electrodes $\mathbf{270}_1$ and $\mathbf{270}_3$ are in contact with the washing agent, the electrical quantity measured will have a first value; instead, when the level of the washing agent within the inlet 211 and the corresponding bottom extension 211*c* is at a lower height than the electrode $\mathbf{270}_3$ or comprised between the two electrodes $\mathbf{270}_1$ and $\mathbf{270}_3$ (i.e., with the upper electrode $\mathbf{270}_3$ in air), or else with both of the electrodes $\mathbf{270}_1$ and $\mathbf{270}_3$ in air, the electrical quantity measured will have a second value, clearly distinguishable from the first value.

This condition of intermediate level between the two electrodes, hence lower than the upper electrode, can be considered as representing a low level of the washing agent in the tank R2 (given that the outlet 113 is located in the lower area of the tank R2), and consequently of the need to proceed to topping-up. In this perspective, the lowest point of the electrode $\mathbf{270}_3$, with reference to the height dimension (Y) identifies a minimum level of the washing agent, below which it will be necessary to carry out topping-up with the washing agent.

On the basis of the comparison may between the measured value and the at least one reference value, the control arrangement will accordingly control generation of a suitable audible and/or visual warning, like the one already mentioned previously. Also in the case of a level detection, the electrical quantity detected between the at least two electrodes $\mathbf{270}_1$ and $\mathbf{270}_3$ of the sensitive element 270 may be the impedance, or the conductivity, or the capacitance.

It will be appreciated that the level sensor described with reference to FIG. 47 can be used as an alternative to the float-type level sensor described previously with reference to FIGS. 6-8. Otherwise, such a float-type level sensor can be used in combination with a quality sensor of the type described with reference to FIGS. 45-46.

As has been seen, in various embodiments the dispenser comprises a body, defined in which is at least one tank, which is able to contain a corresponding washing agent in liquid or semisolid form, and at least one sensor device, configured to provide information representative of at least one of a level and a qualitative characteristic of the washing agent. In advantageous embodiments of this sort, the sensor device comprises a sensing element that includes at least two electrodes, prearranged for being in contact with the washing agent, and a circuit arrangement, which is configured to measure a value of at least one electrical quantity between the at least two electrodes and compare the value of the at least one electrical quantity measured with at least one respective reference value in order to generate information representative of at least one of a level and a qualitative characteristic of the washing agent.

In various preferential embodiments, the sensing element of the sensor device includes at least three electrodes, and in particular a first electrode and a second electrode preferably at one and the same height, and a third electrode at a height higher than that of the first and second electrodes. In an embodiment of this sort, the circuit arrangement associated to the sensing element may be configured to:

- measure the value of the at least one electrical quantity between the first electrode and the second electrode, and compare the measured value with the at least one respective reference value, in order to generate information representing a qualitative characteristic of the washing agent; and
- measure the value of the at least one electrical quantity between the third electrode and one of the first electrode and the second electrode, and compare the measured value with the at least one respective reference value, in order to generate information representing a level of the washing agent.

As may be appreciated, a sensor device of the above sort can be obtained by combining the concepts expressed previously with reference to FIGS. 45-46, on the one hand, and FIG. 47, on the other. An embodiment of this sort is illustrated, in fact, in FIGS. 48-49, where the sensitive element 270 of the sensor device includes the electrodes $\mathbf{270}_1$, $\mathbf{270}_2$ and $\mathbf{270}_3$, the electrodes at the same height $\mathbf{270}_1$ and $\mathbf{270}_2$ being usable for quality detection, according to the principles explained previously with reference to FIGS. 45-46, and the upper electrode $\mathbf{270}_3$ being usable in combination with any one of the lower electrodes $\mathbf{270}_1$ and $\mathbf{270}_2$ for level detection, according to the principles explained previously with reference to FIG. 47.

A sensor device of the above sort is thus able both to detect an incorrect topping-up or filling of the tank (for example, introduction of an additive, instead of a detergent) and to detect running-out of the washing agent.

Figure 48:
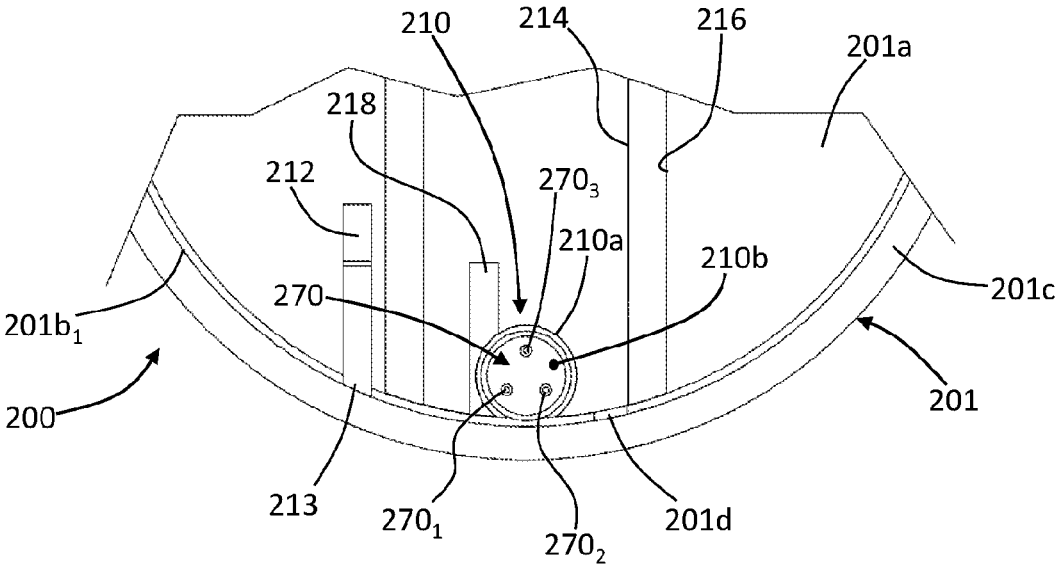
FIGS. 48 and 49 are views similar to those of FIGS. 45-46, regarding a dispenser according to possible alternative embodiments.

As may be seen in FIGS. 48-49, in embodiments of this sort the electrodes can be positioned substantially like a triangle, where one side (corresponding to the electrodes $\mathbf{270}_1$ and $\mathbf{270}_2$) is set horizontal, whereas the upper vertex (corresponding to the electrode $\mathbf{270}_3$) is set at a higher level. A first one of the two electrodes $\mathbf{270}_1$ and $\mathbf{270}_2$ at the base vertices, for example, the electrode $\mathbf{270}_1$, is used as common or reference electrode, whereas the second electrode set at the other base vertex, for example, the electrode $\mathbf{270}_2$, is used with the common or reference electrode for detection of quality; the third electrode, here the electrode $\mathbf{270}_3$ at the upper vertex is used with the common or reference electrode for level detection. It should be noted that, instead of an electrode in common for carrying out the level-sensing and quality-sensing functions, the sensor could envisage at least two distinct electrodes for each of the aforesaid functions.

The electrodes of the sensing element 270 can be obtained in various ways, for example, by means of elements as exemplified in the figures. However, in other embodiments, the at least two electrodes of the sensing element can be obtained by means of screen printing with metallic inks on a corresponding electrically insulating substrate (for example, of alumina, plastic, or vetronite), or else by means of typical techniques used in the production of circuits, for example, constituted by multi-layers of photo-etched copper, and vetronite. Alternatively, it is possible to use thin-film deposition techniques, such as vacuum evaporation, sputtering, and the like, on a suitable electrically insulating substrate. This applies, of course, also to the sensitive elements 270 of FIGS. 44-46 and 47. As has been said, the electrodes can also be coated by an electrically insulating layer.

As already explained, the electrical quantity measured between the two pairs of electrodes ($\mathbf{270}_1$-$\mathbf{270}_2$ and $\mathbf{270}_1$-$\mathbf{270}_3$), for example, the impedance, will be different according to the fluid set between them so that the different characteristics of the fluid will cause a different response between the electrodes of each pair. The fluids considered are those typically of interest for a dispenser for dishwashing machines, such as detergent and liquid or semisolid (gel) additives, water, vinegar and air.

Figure 50:
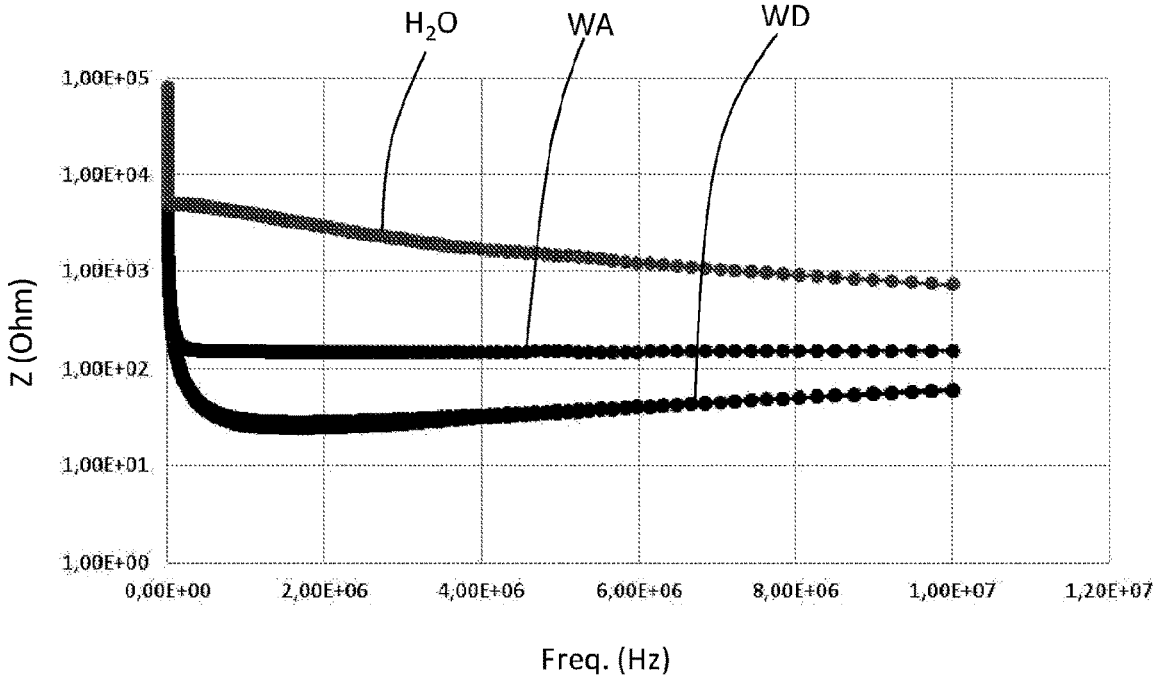
FIGS. 50 and 51 are graphs that exemplify the results of measurements of an electrical quantity made by a sensor device that equips a dispenser according to possible embodiments.
Figure 51:
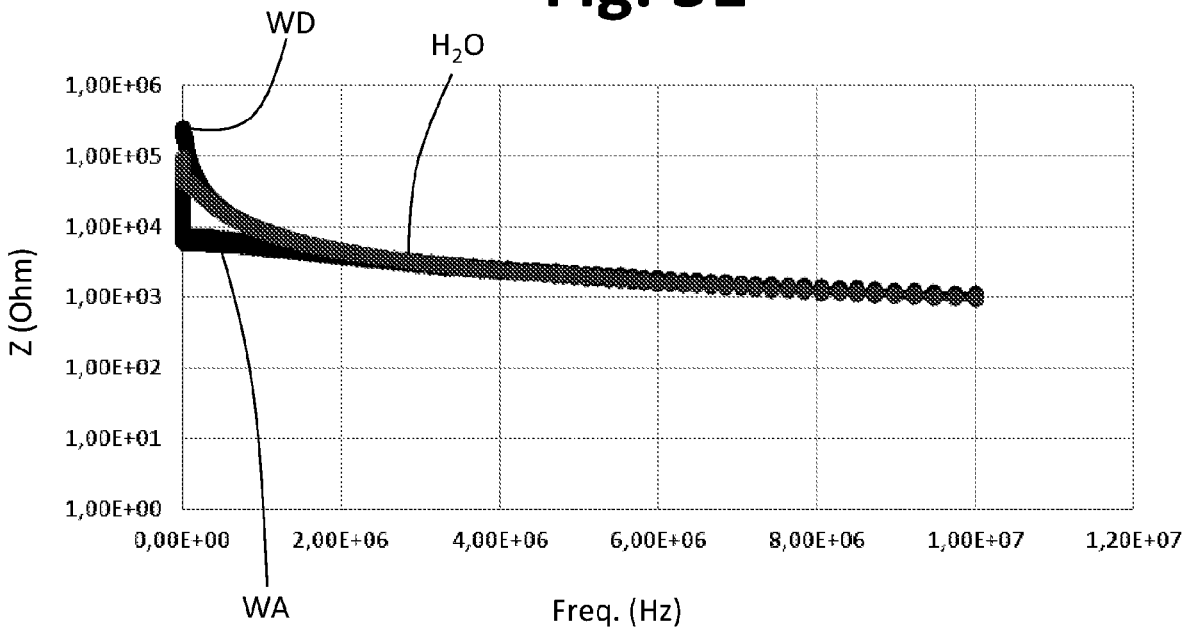

FIGS. 50 and 51 exemplify in graphic form the result of measurements of impedance carried out using a structure of sensitive element 270 of the type illustrated in FIGS. 48-49, with electrodes made of steel having a diameter of approximately 2 mm set at a distance of approximately 5 mm (measured between the central axes of the electrodes). Indicated on the abscissae is the frequency, expressed in hertz, whereas indicated on the ordinates is the impedance, expressed in ohms. The values given cover a wide frequency range, from 200 Hz to 10 MHz.

The graphs of FIG. 50 presents the results of detections made between the two base electrodes $\mathbf{270}_1$ and $\mathbf{270}_2$, i.e., a quality detection, for three different substances, namely water (curve $H_2O$), a commercially available liquid detergent (WD), and a commercially available liquid brightener (WA). As may be noted, the impedance value measured in the three cases makes it possible to distinguish clearly the detergent from the brightener and from water. It should be noted that a curve practically identical to the one designated by WD was obtained by measuring a commercially available detergent in gel form.

The graph of FIG. 51 provides, instead, the result of detections made between the common or reference electrode at the base (the electrode $\mathbf{270}_1$, in the example considered) and the upper electrode $\mathbf{270}_3$, i.e., a level detection, for the same three substances referred to above. The measurements were made with each of the three substances at an intermediate level between the base electrodes and the upper electrode, i.e., with the electrodes $\mathbf{270}_1$ and $\mathbf{270}_2$ in contact with the substance and the upper electrode $\mathbf{270}_3$ in air. As may be noted, the values of impedance measured between the reference electrode $\mathbf{270}_1$ at the base and the upper electrode $\mathbf{270}_3$ are clearly superior to the results appearing in the graph of FIG. 50, with the three curves that tend to overlap as the frequency increases. It should be noted that also in this case a curve practically identical to the one designated by WD was obtained by measuring a commercially available detergent in gel form.

It will thus be appreciated that a possible logic of level detection based upon the use of a sensing element of the type illustrated in FIGS. 48-49 may envisage first of all a step of measurement of impedance between the electrodes at the same height ($\mathbf{270}_1$-$\mathbf{270}_2$), followed by a measurement of impedance between two electrodes at different heights ($\mathbf{270}_1$-$\mathbf{270}_3$), and, in the case where the two values measured differ in a clear way (beyond a certain tolerance), it may be inferred that the level of the substance is in a position intermediate between the two electrodes at different heights. In the case where the level were to drop below the electrodes $\mathbf{270}_1$ and $\mathbf{270}_2$ the values measured will be comparable, but far higher than those measured in the case of presence of liquids of interest, and hence the situation will be identified as empty tank on the basis, for example, of stored tables.

The circuit arrangement associated to the sensitive element 270 may comprise a microcontroller and at least one driving circuit for the sensitive element.

Figure 52:
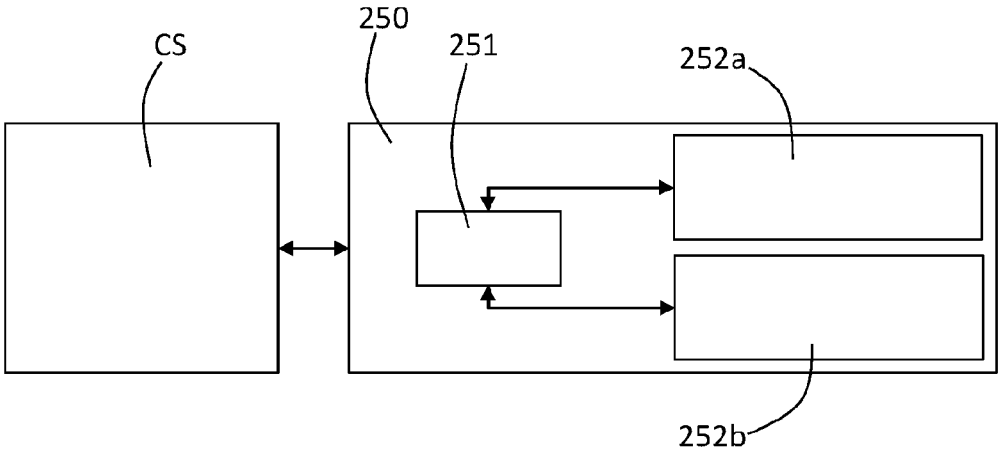
FIG. 52 is a simplified diagram of a possible control circuit of a dispenser according to possible embodiments.

As illustrated in FIG. 52, the above circuit arrangement may also be implemented in the controller or electronic card that possibly equips the dispenser, such as the one designated previously by 250, provided with corresponding microcontroller 251. In the example, the controller or card 250 is configured to be connected in signal communication with the control system CS of the machine 1.

According to the schematic example of FIG. 52, in the controller or card 250 there may be implemented also two driving circuits 252*a* and 252*b*, one for the pair of electrodes $\mathbf{270}_1$ and $\mathbf{270}_2$ and the other for the pair of electrodes $\mathbf{270}_1$ and $\mathbf{270}_3$. In the case of a sensing element 270 including just two electrodes, a single driving circuit may be sufficient.

Each driving circuit can be obtained in various ways.

Figure 53:
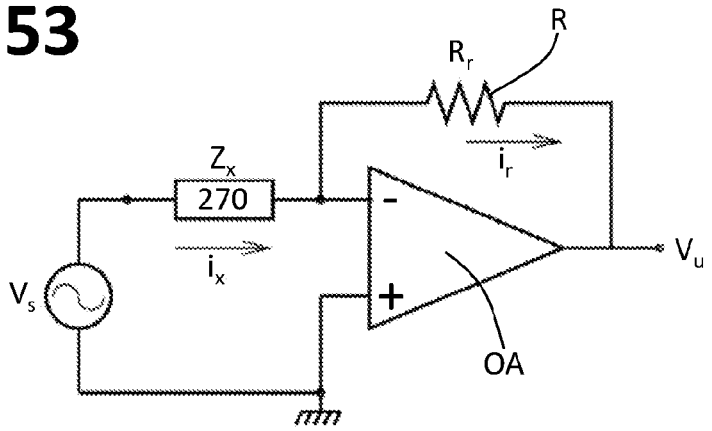
FIG. 53 is a simplified diagram of a first possible driving circuit of a sensitive element of a sensor device of a dispenser according to possible embodiments.

For instance, FIG. 53 illustrates schematically a case where the microcontroller used can generate a frequency signal, where the driving element of each pair of electrodes of a sensing element 270 may comprise an operational amplifier OA.

The amplifier OA has an input (here, the inverting input –) to which the sensing element 270 is connected in series, and a known reference resistance $R_r$ is connected in parallel between the input (–) and the output of the operational amplifier OA. With such a scheme, Zx is the unknown impedance to be measured between the pair of electrodes of the sensitive element 270. The effective driving voltage generated by the microcontroller, designated by $V_s$ is constant, whereas the voltage value at output from the operational amplifier OA will thus depend upon the value of Zx. The value of $V_u$ may, for example, be read using an analog input of the microcontroller, which will calculate the ratio between $V_s$ and $V_u$, proportional to Zx.

Instead, if the microcontroller 250 is not pre-arranged for generating a frequency output, it is possible to use an oscillating circuit, the resonance frequency of which is a function of an impedance value measured between the at least two electrodes of the sensing element 270, with the microcontroller pre-arranged to detect the impedance value on the basis of the aforesaid resonance frequency.

Such an oscillating circuit can be obtained in any known way, such as an RC network, an LC resonant circuit, or a crystal or dielectric resonator for defining the oscillation frequency thereof. RC oscillators are generally used at low frequency (up to hundreds of kilohertz). Forming part of this category are the following oscillators: Wien-bridge oscillators, bridged-T oscillators, twin-T oscillators network, and phase-shift oscillators (PSO). In LC oscillators, an LC network determines the oscillation frequency thereof. In this category there may belong, for example, Colpitts, Hartley, Clapp, Armstrong, and Meissner oscillators.

The electrical characteristics between two electrodes of the sensing element will cause variation of the resonance frequency of the resonant circuit, which may be read with an analog input or with a digital input of the microcontroller: in this case, the unknown impedance will be read on the basis of a frequency measurement.

Figure 54:
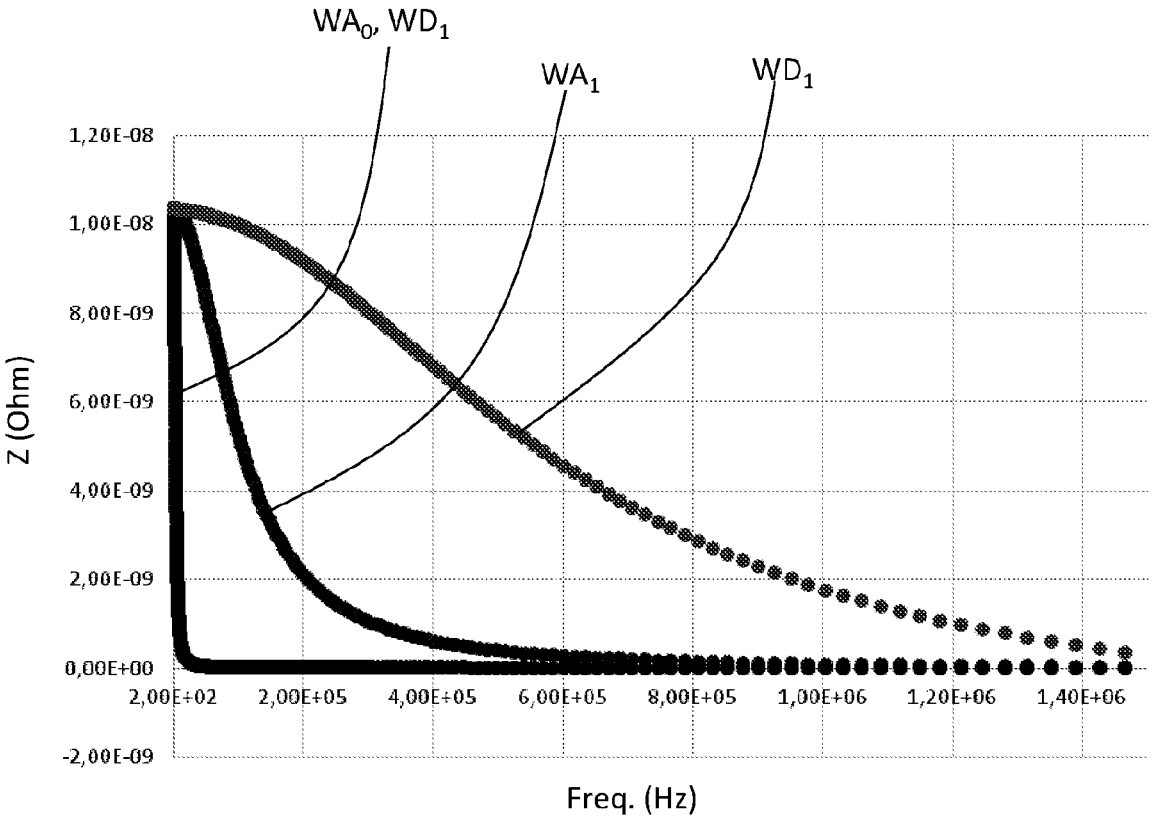
FIGS. 54 and 55 are graphs that exemplify the results of further measurements of an electrical quantity made by a sensor device that equips a dispenser according to possible embodiments.
Figure 55:
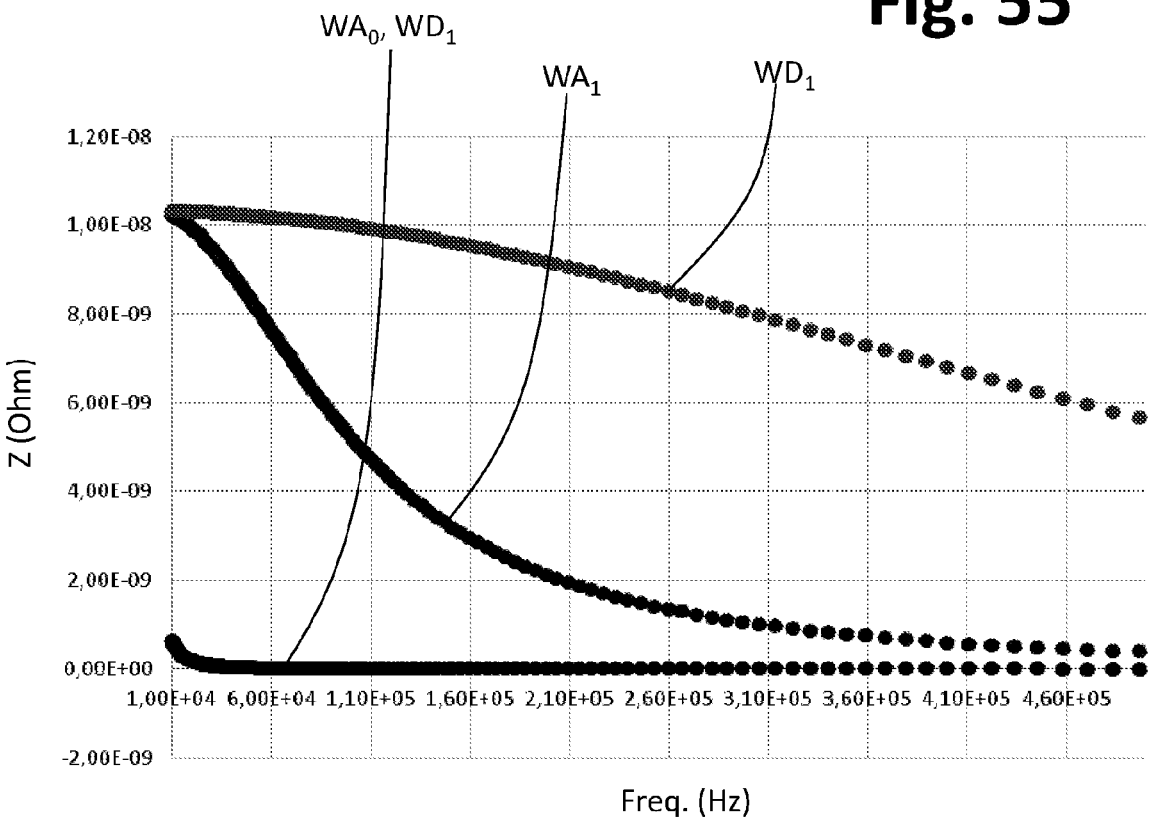

In order to check whether it is possible to use the variation of the capacitive component of a sensing element 270, measurement tests were carried out by means of an impedance meter in parallel-capacitance mode, inserting in series to the sensing element 270 a 10-nF capacitance. The graphs of FIGS. 54 and 55 illustrate the plot of the measurement of capacitance in parallel mode, for a liquid brightener WA and a liquid detergent WD of the same types mentioned in regard to FIGS. 50-51. The curves $WA_1$ and $WD_1$ represent the measurements made with a level of the corresponding washing agents that covers two electrodes at different heights, whereas the curves $WA_0$ and $WD_0$ represent the measurements made for the same washing agents, but with a level intermediate between the two electrodes. As may be noted from the graph, where the curves $WA_0$ and $WD_0$ are practically superimposed, the measurement reveals a clearly detectable difference between the various situations (full/empty and type of washing agent) over a rather wide frequency range, at relatively low frequencies. For this purpose, FIG. 55 provides a detail of the graphs of FIG. 54 in the frequency range of between 10 kHz and 500 kHz.

With the electrodes described previously, it is thus possible to have an excellent differentiation for frequencies around 100 kHz. At these frequencies many circuit solutions are practicable, both with LC circuits suited also for higher frequencies and with RC circuits, or better still with solutions already integrated in the microcontrollers. It is also possible to use for this purpose quartz oscillators. In quartz-crystal oscillators a piezoelectric crystal is used, which is distinguished by a natural resonance frequency. The resonance frequency is determined by the type of cut and by the shape of the material in the feedback network. To control frequency stability, the crystal generally used is that of quartz ($SiO_2$), which has the shape of a hexagonal prism and may be natural or artificial. From the crystal, dice are cut, according to different arrangements with respect to the crystallographic axes, with the different types of cut that bestow on the crystal different electrical and mechanical characteristics. A pair of electrodes of the sensitive element 270, set in series to a fixed and known capacitance, can be connected in parallel to the quartz. The variations of the type of washing agent and of level result in a variation of the oscillation frequency of the circuit.

Figure 56:
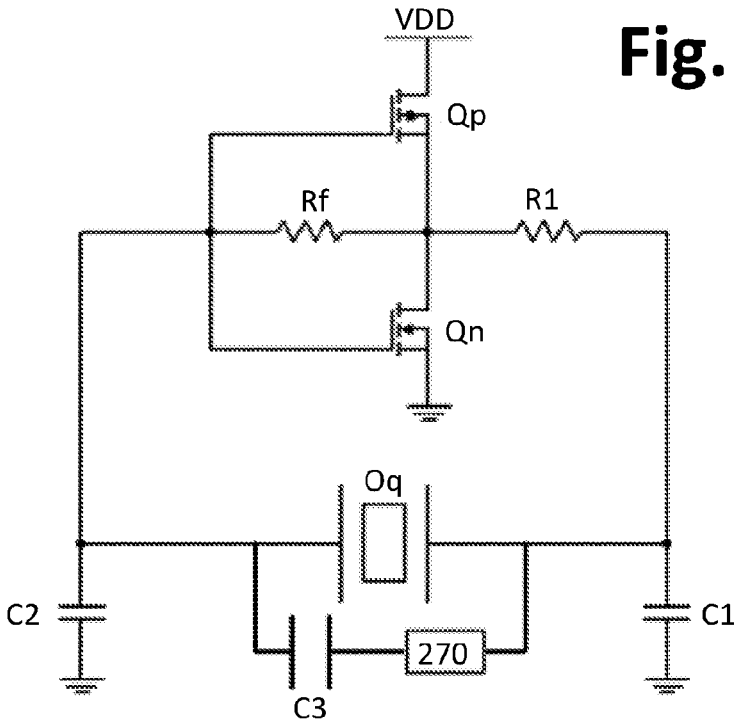
FIG. 56 is a simplified diagram of a second possible driving circuit of a sensitive element of a sensor device of a dispenser according to possible embodiments.

For instance, FIG. 56 represents a Pierce oscillator that uses a CMOS inverter as amplifier. The Pierce oscillator is a modified version of the Colpitts oscillator, in which, instead of an inductor, a quartz crystal is provided, denoted in the figure by Oq. In order for the circuit to function correctly, it is necessary for the quartz Oq to behave inductively, and for this reason the operating frequency has to be comprised between that of the series resonance and that of the parallel resonance. The resistances Rf and R1 serve to fix the working point of the CMOS inverter. C3 designates the aforesaid known capacitance connected in series to the sensitive element 270, the capacitance C3 and the element 270 being in parallel to the quartz Oq.

The circuit will resonate at the resonance pulsation of the parallel between L and C of the quartz and $C0+C1 \cdot C2/(C1+C2)$. Since the capacitance C is smaller than the other three capacitances, it is dominant, and the resonance pulsation is consequently $f=1/(LC)^{1/2}$.

A sensing element of any of the types designated previously by 270 may belong to a sensor module designed for being mounted on the body of the dispenser. In this perspective, the at least two electrodes of such a sensitive element can be associated to one and the same sensor body, configured for being mounted in a fluid-tight way on the dispenser body.

An example of this sort is illustrated in FIGS. 57-59, where designated as a whole by 280 is a sensor body 280, preferably made of electrically insulated material, associated to which is a sensing element 270 including three electrodes $\mathbf{270}_1$, $\mathbf{270}_2$ and $\mathbf{270}_3$. Obviously, such a structure, as likewise that of the subsequent FIGS. 60-61, can be used also in the case of sensing elements 270 having just two electrodes, as in FIGS. 45-46 and/or in FIG. 47.

In the example, the sensor body 280 has a tubular peripheral wall 280*a*, here substantially cylindrical, and a bottom wall 280*b* where the electrodes are mounted. The end of the peripheral wall 280*a* opposite to the bottom wall 280*b* may conveniently define a flange 280*c* radially projecting outwards, possibly provided with one or more polarization and/or coupling elements 280*d*, i.e., elements configured to enable mounting of the sensor body 280 with a pre-set orientation within the rear portion of the inlet 210 of the body part 201 of the dispenser.

In this case, the rear portion of the inlet 210 is without a bottom wall of its own and is preferably shaped for receiving a corresponding portion of the sensor body 280, possibly shaped also to define one or more engagement elements. One or more polarization and/or coupling elements, such as the one designated by 221 in FIG. 57, can also be provided on the body part 201 that defines the inlet 210. The peripheral wall 280*a* of the sensor body 280 may conveniently define a seat 280*e* (FIG. 58) for a corresponding annular sealing element 281 (FIG. 59). The sensor body 280 may be interference fitted into the rear portion of the inlet 210, or else welded or bonded to the back of the inlet 210 at the flange 280*c*, or fixed via respective fixing means, such as a bayonet attachment.

Figure 60:
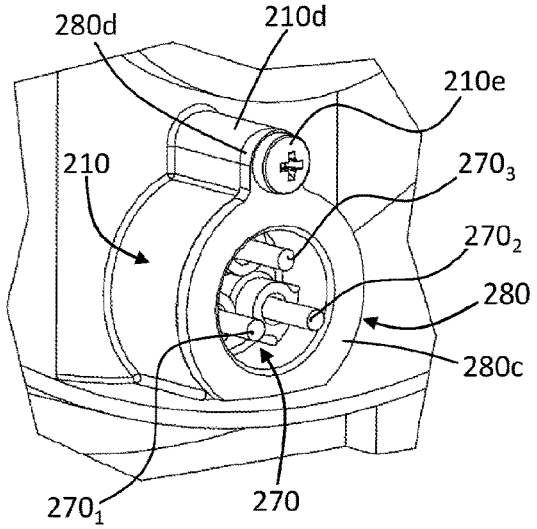
FIGS. 60 and 61 are a schematic perspective view and an exploded view, respectively, of a bottom area of a part of a dispenser according to possible embodiments, equipped with a sensor body according to a possible variant.
Figure 61:
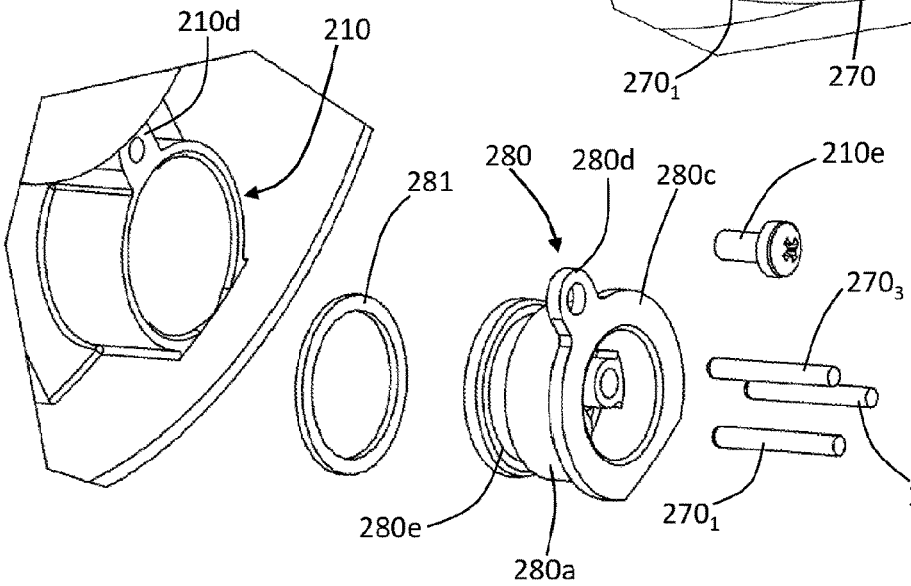

A substantially similar embodiment is illustrated in FIGS. 60-61, where the flange 280*c* of the sensor body 280 is provided with an extension 280*d* that, in addition to functioning as polarization element, has a through hole passing through a fixing element 210*e*, for example, a screw, which is to be received in a corresponding extension 210*d* of the inlet 210, provided at the back of the inlet itself.

Of course, a sensor body obtained according to the concepts expressed with reference to FIG. 57-59 or 60-61, even with just two electrodes, could be mounted at the inlet 211 of the fixed dispenser part 200.

Figure 62:
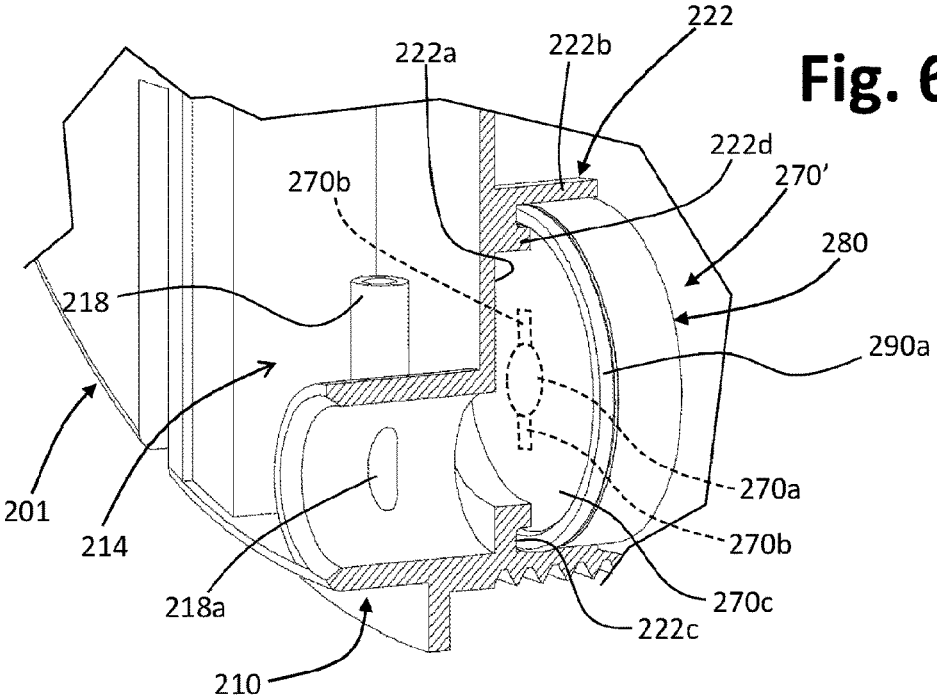
FIG. 62 is schematic perspective view in partial cross section of a bottom area of a part of a dispenser equipped with a sensor device according to possible embodiments.

Illustrated schematically in FIG. 62 is a possible embodiment of a sensor device, the sensing element 270' of which includes at least one piezoelectric element, designated by 270*a*, set between two corresponding connection electrodes 270*b*. The piezoelectric element 270*a* and the electrodes 270*b* may be arranged on a corresponding electrically insulating substrate, set within a sensor body 280, here having a substantially cylindrical shape. In various embodiments, such as the one exemplified, the sensor body 280 is provided at the front with a dielectric or electrically insulating layer, designated by 270*c*, which is to come into contact with the liquid and is designed to isolate the electrical parts from the substance undergoing measurement, the layer 270*c* preferentially coating at least the piezoelectric element 270*a* and the corresponding terminals.

FIG. 62 also highlights how, in various embodiments, a sensor device that equips the dispenser does not necessarily have to be arranged at an inlet of a fixed dispenser part, but, instead, may be set in a housing in fluid communication with the inlet. In the example illustrated, defined in the back of the body 201 of the fixed dispenser part is a housing, designated by 222, here having a generally cylindrical shape that includes a bottom wall 222*a* (here formed by a stretch of the bottom wall of the housing 214 for the pump) and a peripheral wall 222*b*, where the sensor body 280 is mounted.

As may be noted, the housing 222 is connected in fluid communication with the inlet 210, in particular via an opening in the bottom wall 222*a*. Between the sensor body 280 and the housing 222 there may be provided suitable sealing means: in the example, the body 280 is provided at the front with an annular sealing element 290*a*, to obtain axial or front sealing with respect to a corresponding seat 222*c* defined within the housing 222; in the example, the housing 222 is moreover shaped to define an annular part 222*d* bearing or resting on which is the front of the sensor device, here the layer 270*c*. The sensor body 280 can be fixed in the housing 222 according to any known modality.

Figure 63:
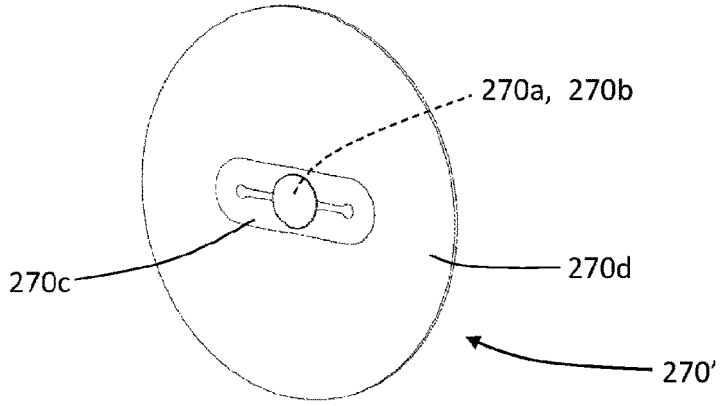
FIGS. 63 and 64 are schematic views, respectively a perspective view and an exploded view, of a part of a sensor device according to possible embodiments.
Figure 64:
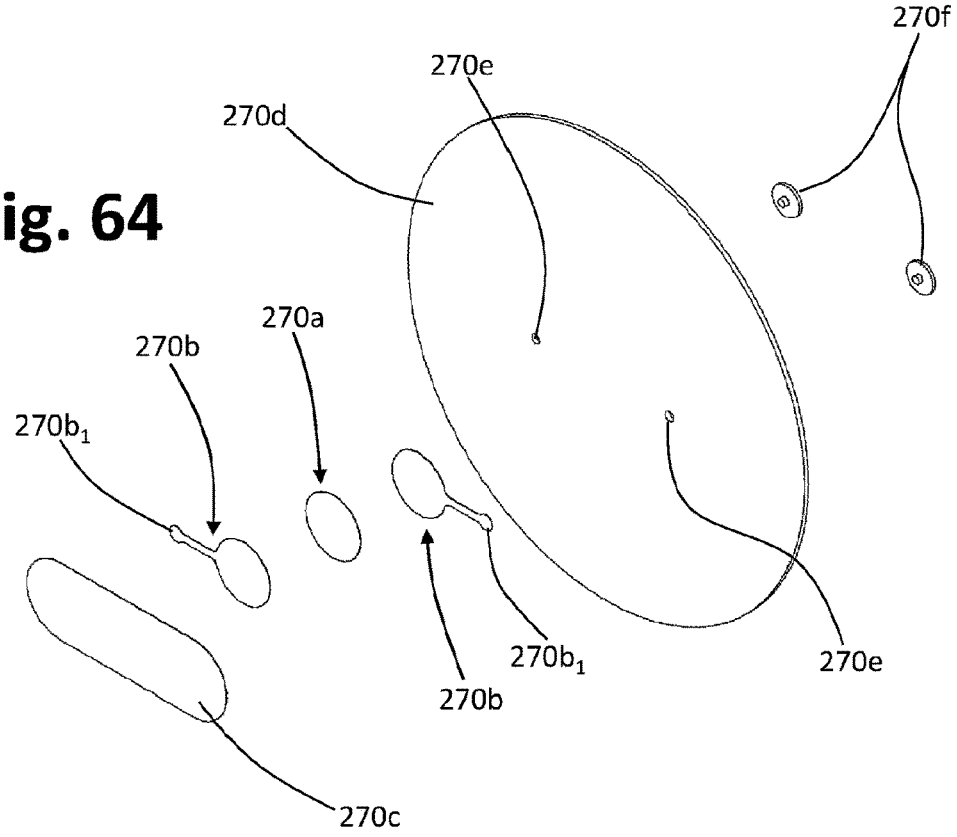

FIGS. 63 and 64 illustrate a possible embodiment of the active part of a sensor of the type illustrated in FIG. 62. In these figures, designated by 270*d* is an electrically insulating substrate, for example, of a ceramic type, preferably having a thickness of less than one millimetre. The substrate may, for example, be made of alumina and have a thickness comprised between 0.5 and 1 mm, in particular between 0.6 and 0.7 mm. In the example, the substrate is provided with holes 270*e*, where respective electrical terminals 270*f*, preferably made of metal, are mounted or deposited on the rear side of the substrate 270*d*. On the front side of the substrate 270*d*, i.e., the one that is to face the washing agent, a piezoelectric element 270*a* is provided, set between two electrodes 270*b*. In the example, the element 270*a* is disk-shaped, and the electrodes 270*b* have a corresponding disk-shaped part, radially extending from which is a respective connection portion 270*b*$_1$ designed to come into the contact with the terminals 270*f*, via the holes 270*e*. The piezoelectric material used to obtain the element 270*a* may, for example, be a lead-zirconate-titanate (PZT) solid mixture; its thickness may be comprised between 50 and 150 μm, in particular approximately 100 μm; the electrodes 27*b* are preferentially made of a noble metal, for example, platinum, having a thickness comprised between 5 and 30 μm, preferably approximately 10 μm.

In various embodiments, the set formed by the piezoelectric element and the corresponding electrodes is isolated from the washing agent. The isolation does not necessarily have to involve the entire front side of the substrate: in the case exemplified in FIGS. 63-64, for this purpose a localized layer 270*c* of dielectric material is provided, namely, a layer that coats a limited region of the front side of the substrate 270*d* and under which the element 270*a* and the electrodes 270*b* are located. The layer 270*c* may have a thickness comprised between 10 and 30 μm, in particular approximately 15 μm, and be made of any dielectric material suitable for the purpose, even of a vitreous type. For instance, in the case of an alumina substrate, the layer 270*c* may be made of the material commercially identified by the code "G-485-2", with base of bismuth, silicon, and boron.

The layers that form the piezoelectric element 270*a*, the electrodes 270*b*, and the insulating coating 270*c* can be obtained with any known technique, for example, techniques of deposition normally used in the electronic field.

Figure 65:
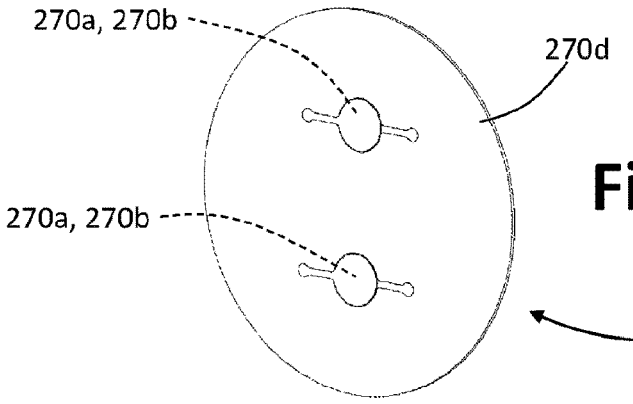
FIG. 65 is a view similar to that of FIG. 63 regarding a possible variant.

It should in any case be emphasised that the provision of the dielectric layer 270*c* is to be understood as optional, in so far as the ensemble formed by the piezoelectric element 270 could be envisaged for direct contact with the washing agent: an example in this sense is illustrated schematically in FIG. 65, where associated to the front side of a substrate 270*c* are two sets—each comprising one piezoelectric element 270*a* and two electrodes 270*b*— which are directly exposed. Provision of an insulation must be deemed preferable in the perspective of an increase in the service life of the sensor.

A piezoelectric sensor of the type referred to can be used both for the purpose of level detection and for the purpose of quality detection.

In the case of a sensor having a sensitive element 270' of the type referred to, an electrical value characteristic of the piezoelectric element 270*a*, which is, for example, its impedance, will be affected not only by the electrical characteristics of the medium in which it may be immersed, but also by the mechanical characteristics of the substance being detected, in particular by its viscosity and its density, this in consideration of the fact that the vibration frequency of the element 270*a* will be different according to whether the layer 270*c*, which is set up against the element 270*a* itself, is in contact with the liquid substance or not (in air), and according to the type of substance, i.e., more or less viscous or more or less dense. Consequently, on the basis of the inverse piezoelectric effect, also to a sensitive element of this sort the circuit considerations set forth previously may be substantially applied. For instance, in the case of use of a piezoelectric element of the type designated by 270*a* it will be possible to use the same piezoelectric element instead of a quartz, in a circuit configuration of any quartz oscillator, for example, the one represented in FIG. 56 (hence, where basically the quartz Oq is omitted).

Very schematically, then, the frequency of vibration of the piezoelectric element 270*a* will be different according to whether the front layer 270*c* of the sensor 270' is in contact or not (or in contact to a greater or lesser extent) with the liquid substance, it thereby being possible to discriminate whether the level is higher or lower than a given threshold. On the other hand, on the basis of the frequency of vibration it will also be possible to discriminate whether the aforesaid layer 270*c* is in contact with a more dense/viscous substance or else with a less dense/viscous substance.

Figure 66:
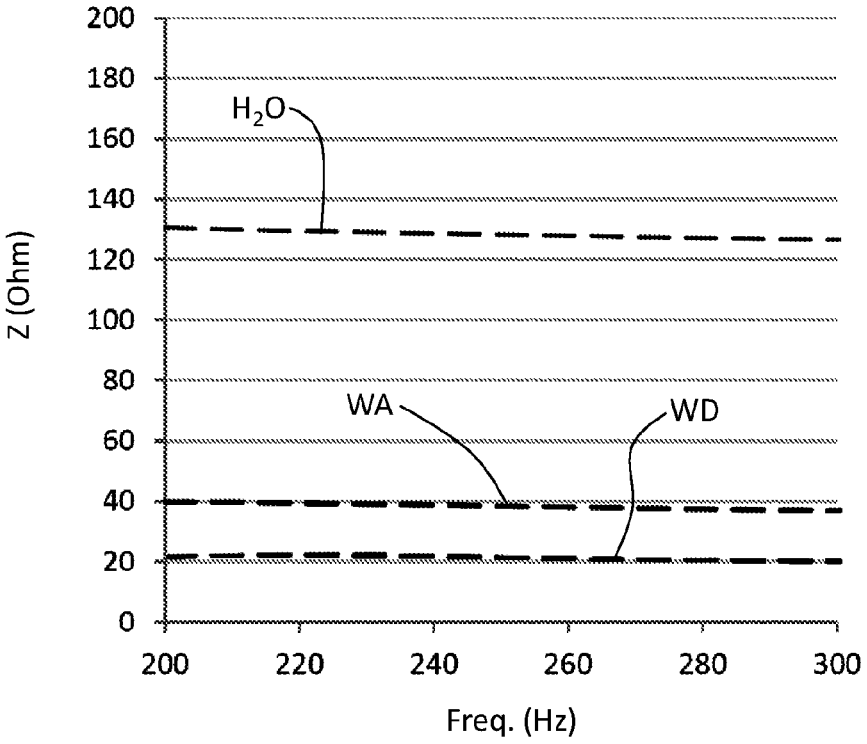
FIGS. 66-67 are graphs that exemplify the results of measurements of an electrical quantity made by a sensor device provided with a part of the type illustrated in FIGS. 63-64.
Figure 67:
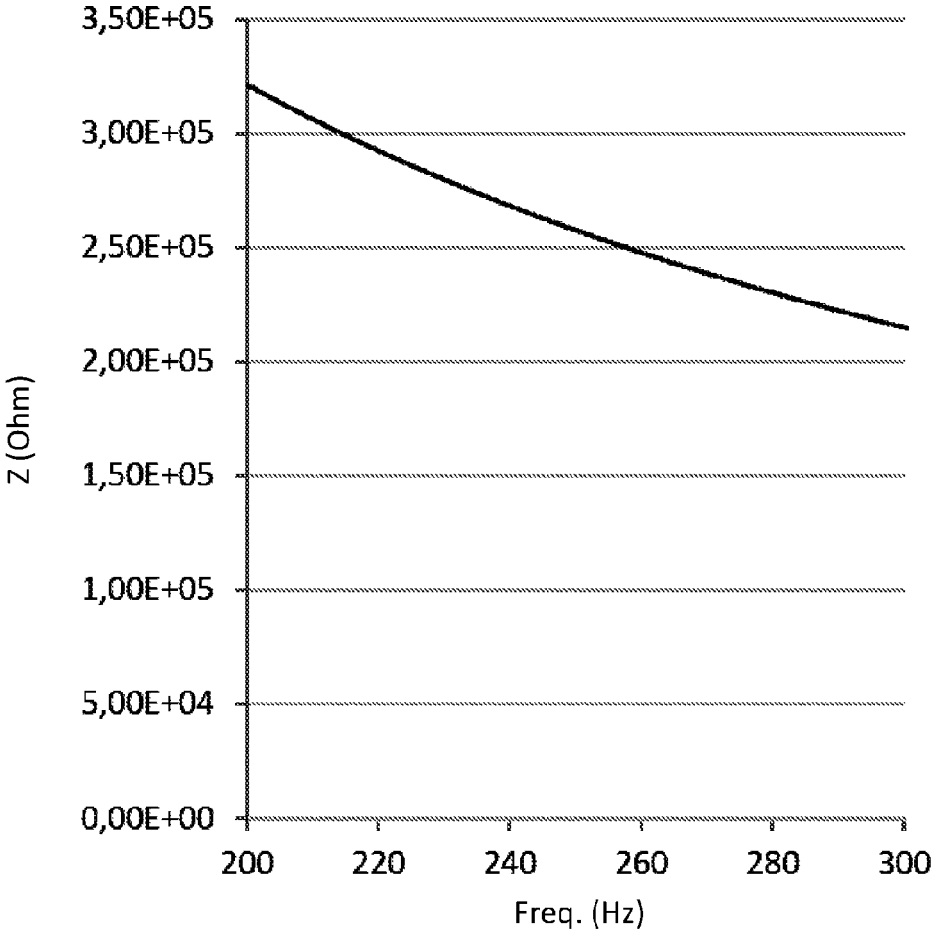

FIGS. 66 and 67 exemplify in graphic form the result of measurements of impedance made using a structure of sensitive element 270' of the type illustrated in FIGS. 63-64, having the preferential characteristics referred to above. The abscissae represent the frequency, in hertz, whereas the ordinates represent the impedance, in ohm. The values given cover a wide range of low frequencies from 200 to 300 Hz.

The graph of FIG. 66 provides the result of detections of quality for the same three liquid substances as those appearing in FIG. 50, namely, water (curve $H_2O$), a commercially available liquid detergent (WD), and a commercially available liquid brightener (WA). As may be noted, the impedance value measured in the three cases makes it possible to distinguish clearly the detergent from the brightener and from the water. On the other hand, the graph of FIG. 67 shows the result of a detection made with the ensemble formed by the piezoelectric element 270*a* and the electrodes 270*b* not immersed in a liquid, i.e., in air: from a comparison between FIGS. 66 and 67 it is hence easy to note how the sensitive element 270' makes it possible to distinguish clearly the presence or absence of liquid, i.e., discriminate whether the liquid substance is above or below a threshold level substantially determined by the position of the piezoelectric element.

Figure 68:
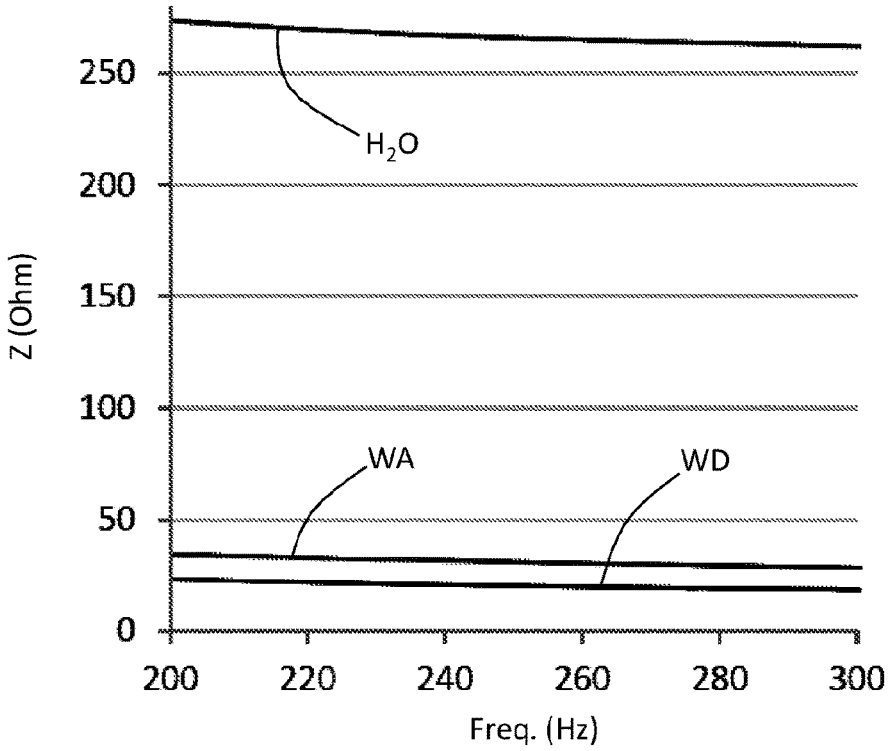
FIGS. 68-69 are graphs that exemplify the results of measurements of an electrical quantity made by a sensor device provided with a part of the type illustrated in FIGS. 63-64, but with an insulating coating removed.
Figure 69:
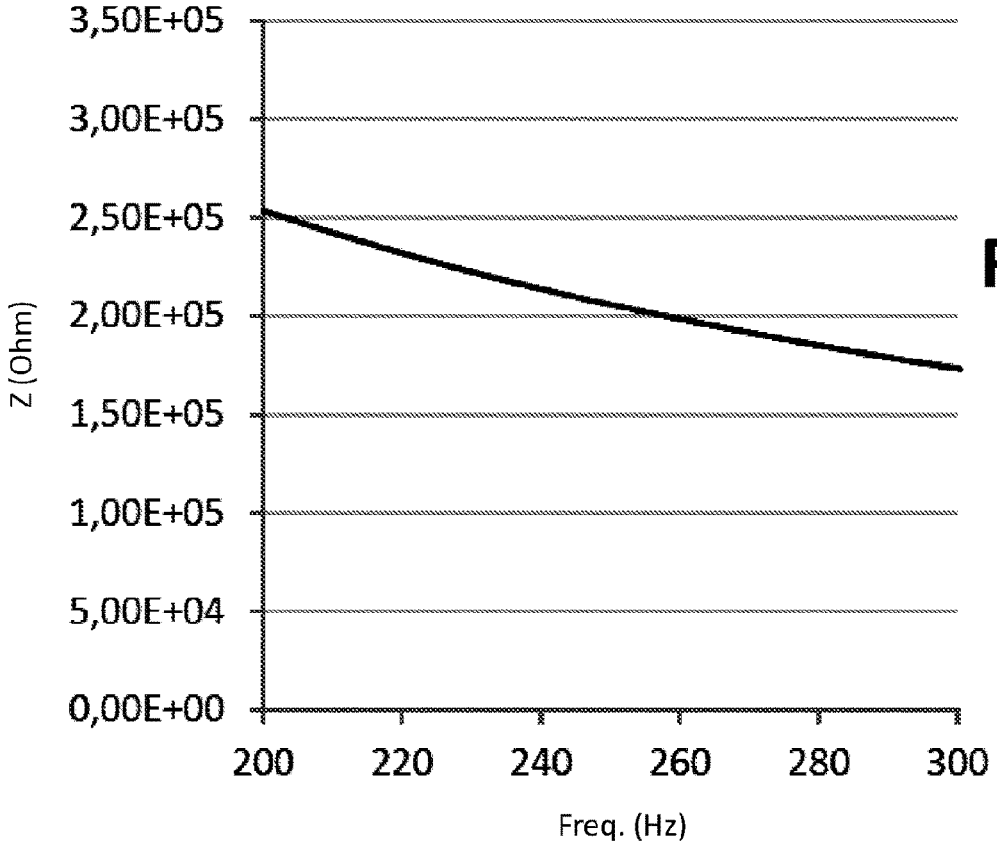

As mentioned previously, provision of the layer of dielectric material 270*c*, albeit preferable, does not constitute an essential characteristic. The graphs of FIGS. 68-69 are similar to those of FIGS. 66-67, but regard detections of impedance made with a sensitive element 270' similar to that of FIGS. 63-64, but without the corresponding layer 270*c*: as may be appreciated, also in these, cases it is possible to discriminate the type of liquid substance and its presence or absence in front of the piezoelectric element.

In possible variant embodiments, a sensor may be provided, the sensing element 270' of which exploits both the forward (direct) piezoelectric effect and the inverse piezoelectric effect. Such a case is illustrated schematically in FIG. 65, where associated to the substrate 270*d* are two piezoelectric elements 270*a'* with corresponding connection electrodes 270*b*: a first of the two elements 270*a* will be supplied with a predefined voltage in order to cause vibration thereof by the inverse piezoelectric effect, whereas the second element 270*a* will be used for generating, exploiting the forward piezoelectric effect, a potential difference the value of which will depend upon the frequency of vibration of the first element 270*a*. Also a sensor of this sort, which can be obtained according to circuit modalities in themselves known, can thus be used for obtaining both level information and information regarding a qualitative characteristic of the washing agent. In the case of FIG. 65, the two sets each formed by the piezoelectric element 270*a* and the corresponding electrodes 270*b* is without the layer 270*c*, but in other versions the layer could be provided.

Use of a piezoelectric sensor may, for example, prove advantageous for the purpose of discriminating the type of washing agent on the basis of its physical characteristics, such as the viscosity or density, which, as has been said, affect the response of the sensor. In this way, for example, it is possible to discriminate whether a detergent WD or additive WA is of a liquid type or semisolid (gel) type. Such information may, for example, be used by the control system CS of the dish-washing machine 1 for adapting a washing program previously started by a user (this applies of course for any characteristic of a qualitative type that can be detected via the other types of sensor described herein).

Of course, a sensor of a piezoelectric type can equip each of the two tanks R1 and R2.

In various embodiments, at least one sensor device that equips the dispenser is a sensor of an optical type, i.e., having a sensitive element that comprises at least one emitter and at least one receiver of electromagnetic radiation.

Figure 70:
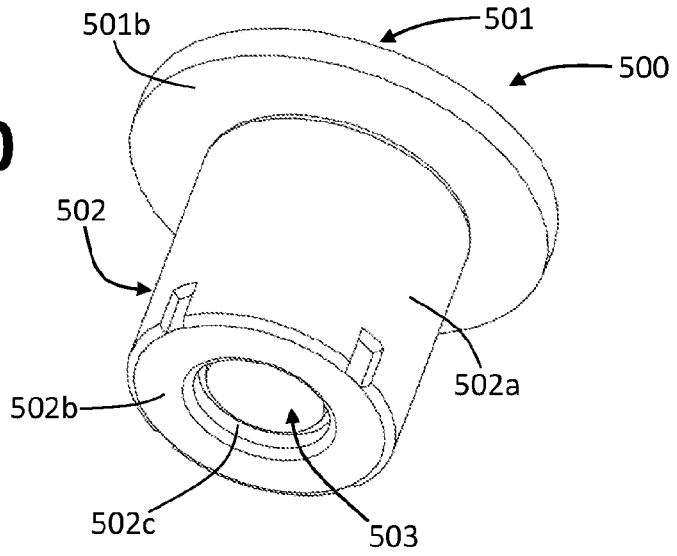
FIG. 70, is a schematic perspective view of a sensor device for a dispenser, according to possible embodiments.
Figure 71:
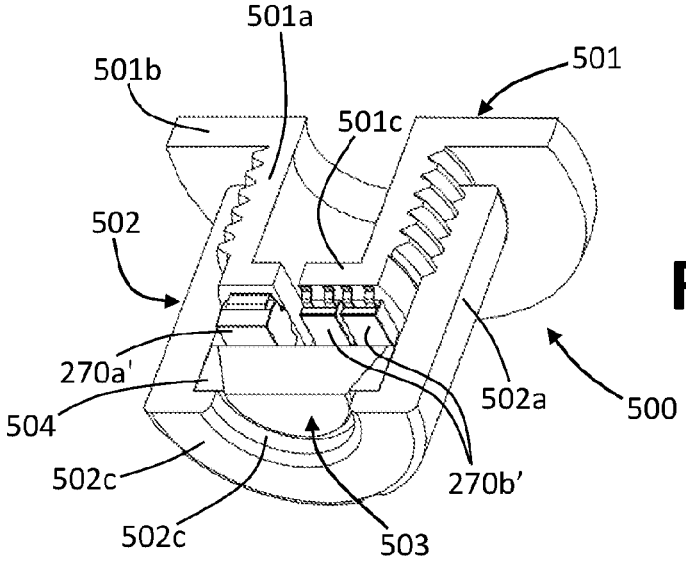
FIGS. 71 and 72 are, respectively, a schematic sectioned perspective view and a schematic exploded view of the sensor device of FIG. 70.
Figure 72:
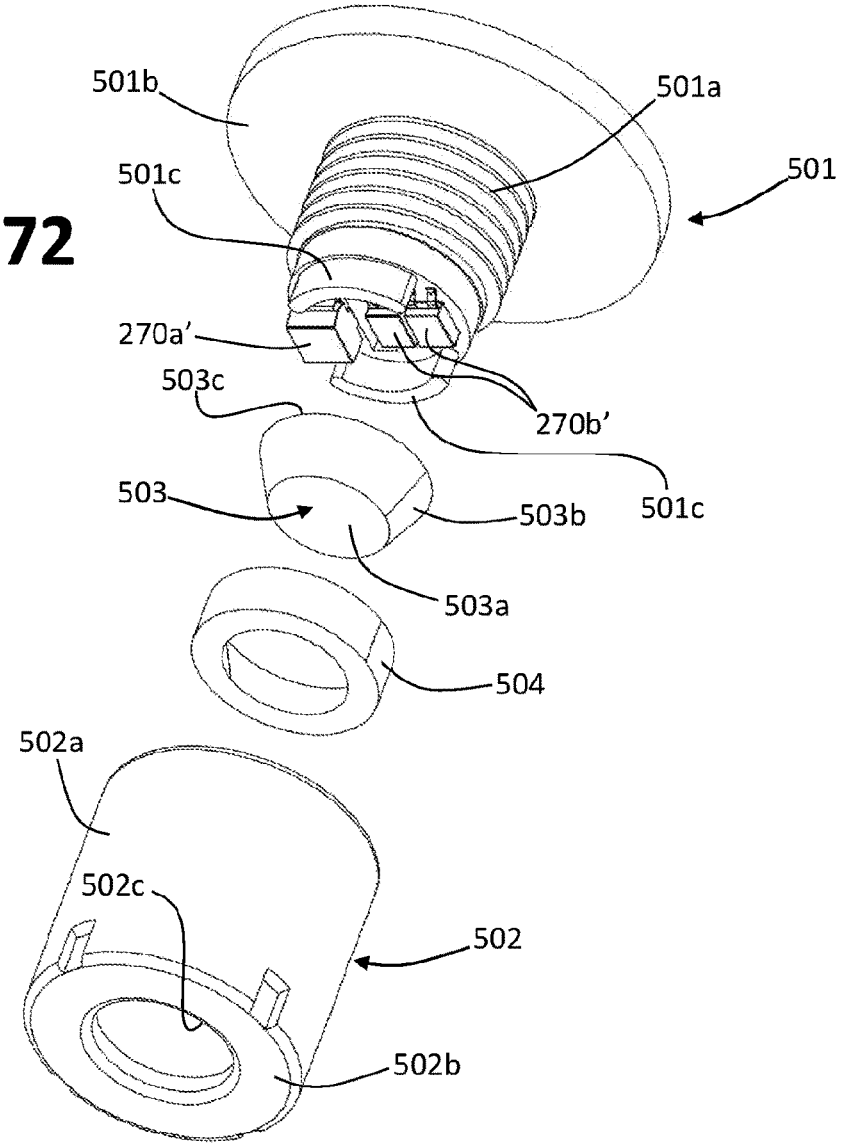

A possible embodiment of this sort is illustrated schematically in FIGS. 70-72. With reference to the case exemplified, the optical sensor, designated as a whole by 500, is preferably configured in the form of module designed to be installed on the fixed dispenser part 200, for example, at one of the inlets 210 or 211 or of a corresponding housing 222, as described previously, preferably with interposition of at least one annular sealing element. In other embodiments, at least part of the sensor body may be integrated or defined by the body of the fixed dispenser part 200.

In the non-limiting example, the sensor body comprises two main parts, designated by 501 and 502, coupled together preferably in a sealed way and made, for instance, of plastic material. In the example, the body part 501 has a generally cylindrical conformation, possibly provided at a distal end with a flange 501*b*. Mounted on the proximal end of the body part 501 is a sensing element, including at least one emitter 270*a*' of electromagnetic radiation, such as radiation in the visible, and at least one receiver of the radiation 270*b*'; the emitter may, for example, be an emitter diode, whereas the at least one receiver may comprise at least two distinct receivers, for example, photodetectors or photodiodes suitable for detecting the light emission generated by the emitter. In alternative embodiments, the receiver 270*b*' may be a single receiver of the CMOS-array type, comprising a linear series or array of independent pixels, each constituted by a photo-detector.

In the example, the body part 502 performs mainly functions of casing, and for this purpose has a hollow cylindrical shape so as to be able to receive inside it the cylindrical portion of the body part 501. The part 502 then has a peripheral wall 502*a* and a bottom wall 502*b*, which is provided with a through opening 502*c*, The two body parts 501 and 502 are coupled together, preferably with interposition of sealing means. In the example, the coupling between the two parts is a threaded coupling, and for this purpose the cylindrical portion of the part 501 is provided on the outside with a male thread, designed for engagement with a corresponding female thread (not visible) provided on the inner side of the peripheral wall 502*a* of the body part 502.

At the top of the body part 501 an optical element 503 is provided, in particular having functions of optical prism. For this purpose, the body part 501 may be shaped so as to define positioning or spacer elements 501*c* for the optical element 503. The optical element 503 may, for example, be made of polycarbonate, or of other material transparent to the light radiation emitted by the emitter 270*a*'. In the example, the element 503 has a front wall 503*a*, a peripheral wall 503*b*, and a rear wall 503*c*, the latter being designed to face the emitter 207*a*' and the receiver 207*b*'. In the example, the optical element has an at least approximately frustoconical shape, but this does not constitute an essential characteristic.

Designated by 504 is a shaped annular sealing element, which is designed to be set between the optical element 503 and the body part 502; the through hole of the sealing element 504 preferably has a profile congruent to that of the peripheral wall 503*b* of the optical element 503, and hence, in the example, a substantially frustoconical profile. As may be appreciated from the figures, in the assembled condition of the sensor 500, the sealing element 504 is arranged in such a way as to provide a seal between the body parts 501 502 and the optical element 503, so that the front surface 503*a* of the element 503 can face a liquid, through the opening 502*c* in the body part 502, without any risks of infiltration towards the inside of the sensor 500.

In various embodiments, operation of the sensor 500 is based upon the optical laws linked to refraction/reflection of optical radiation, and in particular on the principle of the critical angle of total reflection. More in particular, such an operating principle is based on the dependence of the refractive index of the liquid substance upon its composition or concentration: the measurement is hence based on the jump of index between the liquid to be analysed, i.e., the washing agent, and the solid material of the optical element 503, exploiting the principle of total internal reflection at the interface between the two media.

In FIGS. 70-72, the emitter 270*a*' and the receiver 270*b*' are arranged in one and the same plane of lie, also for requirements of representation; in this configuration, the optical element 503 may be suitably shaped to define appropriate angles of reflection/refraction between the emitter 270*a*', the receiver 270*b*', and the interface wall represented by the front surface of the optical element 503.

In various embodiments, the emitter 270*a*' and the receiver 270*b*' have, instead, the respective active parts of emission and reception, respectively, that generally face one another, but are set at an angle with respect to one another, preferably in such a way that the respective axes intersect. The concept is illustrated schematically in FIGS. 73-74, where the emitter 270*a*' and the receiver 270*b*' are arranged according to respective planes of lie that form between them an angle $\alpha$, which is preferably less than 90°; instead, the two planes passing through the axes $\beta$ of the receiver and of the emitter, respectively (meaning thereby two planes orthogonal to the plane of the sheet of FIG. 73-74), form between them an angle that is preferably greater than 90°. The aforesaid angles may be predefined at least on the basis of the plastic material used to obtain the optical element 503 and of the type of emitter, according to a technique in itself known.

Figure 73:
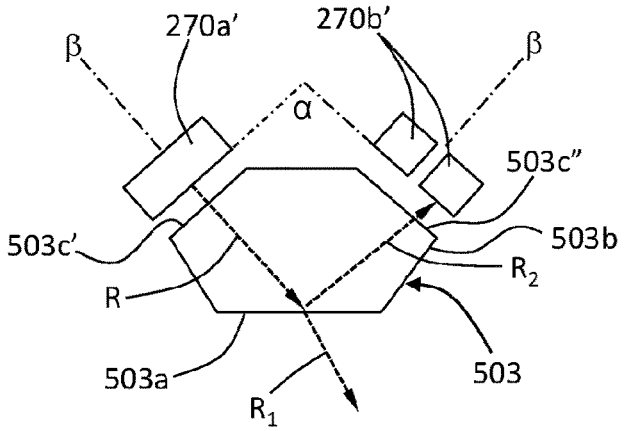
FIGS. 73 and 74 are schematic representations aimed at exemplifying a possible principle of operation of a sensor device of the type illustrated in FIGS. 70-72.
Figure 74:
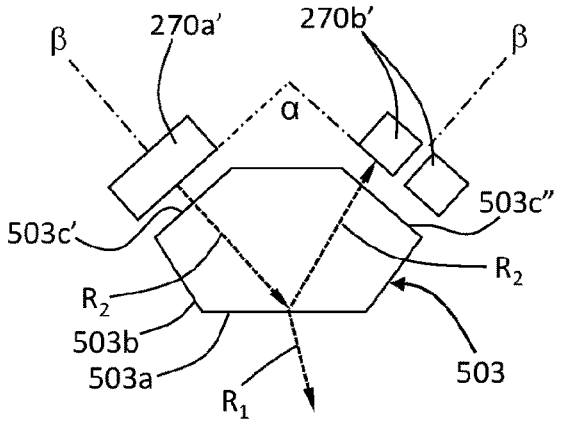

From FIGS. 73-74 it may also be noted how, preferentially, the rear surface of the body of the optical element 503 defines two faces 503*c*', 503*c*" that are inclined with opposed orientations so that the emitter 207*a*', on one side, and the receiver 207*b*', on the other side, face and are generally parallel to a respective said inclined face. The inclination of the faces 503*c*', 503*c*" is preferably calculated in such a way that the optical signal traverses it in a direction that is as orthogonal as possible with respect to the surfaces of entry and exit of the light so as to minimize reflection at the air-solid and solid-air interfaces, respectively.

In operation, the emitter 207*a*' illuminates the interface surface—represented by the front surface 503*a* of the element 503—at the angles of interest around the critical angle, and hence with an incidence greater and smaller than the critical angle. In this way, it is possible to identify two areas: an area affected by the totally reflected rays (linked to those with incidence greater than the critical angle), and an area affected at lower intensity, which is illuminated by the partially reflected rays (linked to those with incidence less than the critical angle). It is thus possible to obtain, at the exit, a field of intensity in which separation between the area markedly illuminated by total internal reflection and the area less illuminated (partial reflection) varies as a function of the concentration of the liquid.

The rays used for the merely explanatory and schematic representation appearing in FIGS. 73-74 form part of an illuminating field that changes its configuration as a function of the variation of the critical angle, i.e., of the refractive index of the liquid substance, namely, of its composition or concentration.

In the presence of a washing agent or other substance having a first composition or concentration, it is possible to have the case represented schematically in FIG. 73: assuming that the rays of the beam R impinge on the surface of interface 503*a* with an angle equal to the critical angle, some of these rays will be obtained as total reflection of the incident rays, whereas other rays will be partially refracted (in $R_1$) and partially reflected, with the "lower" receiver 207*b*' that will be more illuminated by the resulting beam R2. FIG. 74 represents schematically the case of a substance or washing agent having a second composition or concentration (for example, a lower concentration than in the previous case): the rays of the illuminating beam R produced by the emitter 720*a*' always impinge at the same angle, whereas the critical angle varies (decreases) depending upon the composition of the substance. Also in this case, the resulting beam R2 will hence include totally reflected rays and partially reflected rays, but with a greater intensity of illumination on the "upper" receiver 270*b*'.

As may be seen, in practice, the optical element 503 is configured to contribute to propagation of the optical radiation by refraction and/or reflection from the at least one emitter 270*a*' to the at least one receiver 270*b*', in such a way that the radiation is at least in part propagated through the element 503 towards the at least one receiver 270*b*' with an angle and/or with an intensity that varies as a function of a qualitative characteristic of the liquid substance.

Of course, on the basis of the principles set forth above, the optical sensor 500 can also be used as level sensor. In fact, in the absence of liquid at the interface wall 503*a*, the light beam emitted by the emitter 270*a*' will be practically completely reflected towards the receiver 270*b*', whereas, in the presence of liquid at the interface, part of the light beam will be refracted in the liquid, striking the receiver 270*b*' with reduced intensity. In this way, it is possible to discriminate whether the liquid substance is above or below a pre-set threshold level. Of course, the level-detection function could be obtained even without exploiting the principle linked to the critical angle of total reflection; i.e., it could be based upon the simple reflection/refraction of the optical radiation.

In various embodiments described previously, a device for detecting the level and/or at least one qualitative characteristic of a washing agent is set at least in part at an inlet of a dispenser part, or in a corresponding housing connected in fluid communication with the aforesaid inlet. In other embodiments, such a sensor device may, instead, be set at least in part in a corresponding detection chamber, even in a remote position with respect to such an inlet, and not directly connected to a corresponding arrangement for delivery of the washing agent. In embodiments of this sort, a tank has a detection opening, which may be coupled in a separable and fluid-tight way with respect to an inlet opening present in the fixed dispenser part, the inlet opening being in fluid communication with the detection chamber. The detection opening and the inlet opening of the detection chamber are defined in respective walls of the removable and fixed parts of the dispenser, respectively, which are designed to face one another in the operating condition of the dispenser.

Figure 75:
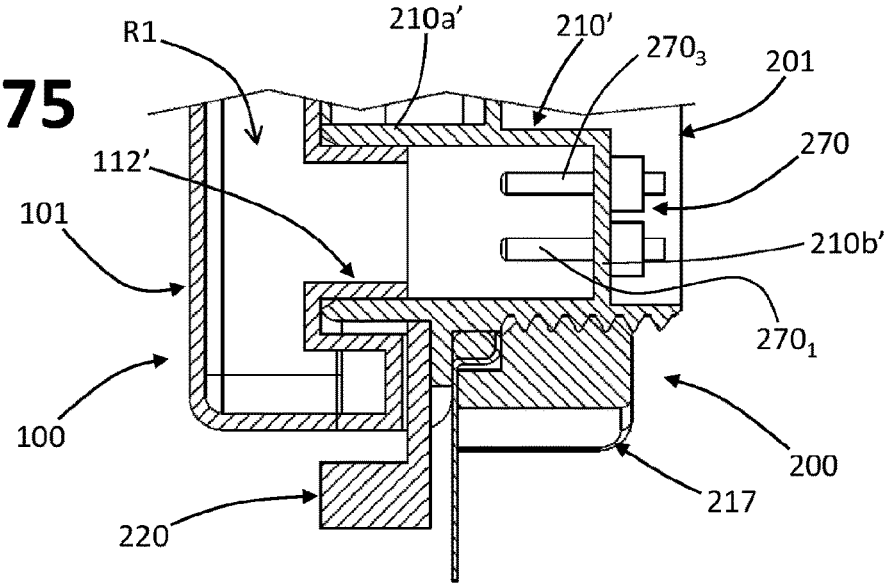
FIGS. 75-77 are schematic cross-sectional views of a bottom area of a dispenser equipped with a sensor device according to further possible embodiments.
Figure 76:
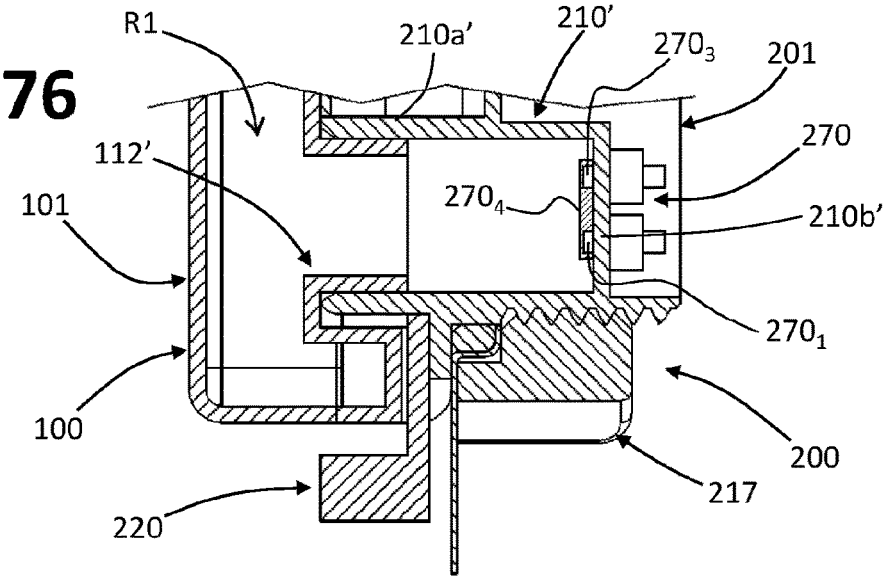

Embodiments of this sort are exemplified in FIGS. 75 and 76, where designated by 112' are the aforesaid detection openings, preferably defined by tubular portions of the hollow body 101 having a structure similar to the one described previously with reference to the outlets 112 and 113. Designated by 210' are, instead, the aforesaid detection chambers, which here are not in fluid communication with inlets of the fixed part 200. Also the chambers 210' are preferably defined by tubular portions of the body 201 having a structure similar to the one described previously with reference to the inlets 210 and 201, with a peripheral wall part 210*a*' and a bottom wall 210*b*', at which the sensing element 270 is mounted: in this case, however, the chambers 210' do not belong, and are not directly connected, to an arrangement for dispensing of the washing agent in question.

In the case of FIG. 75, the sensing component 270 of the sensor device includes electrodes $\mathbf{270}_1$, $\mathbf{270}_3$ (and possibly $\mathbf{270}_2$) of the type already described previously, provided for coming directly into contact with the liquid substance, for example, for measurement of conductivity or impedance, whereas in the case of FIG. 76 the sensitive component 270 includes electrodes $\mathbf{270}_1$, $\mathbf{270}_3$ (and possibly $\mathbf{270}_2$) that are isolated from the liquid substance via an electrically insulating layer $\mathbf{270}_4$, for example, for a measurement of a capacitive type. Also the openings 210 may be provided with automatically driven non-return valves of the type described previously.

Of course, the idea of locating at least part of a sensor device in a detection chamber can be used also in the case of some other types of sensor, such as the piezoelectric sensors or the optical sensors described previously.

In various embodiments, a level-sensor device and/or quality-sensor device has a first part mounted on the removable dispenser part and a second part mounted on the fixed dispenser part, the first part and the second part preferably interacting by means of an electromagnetic or inductive signal or field.

Figure 77:
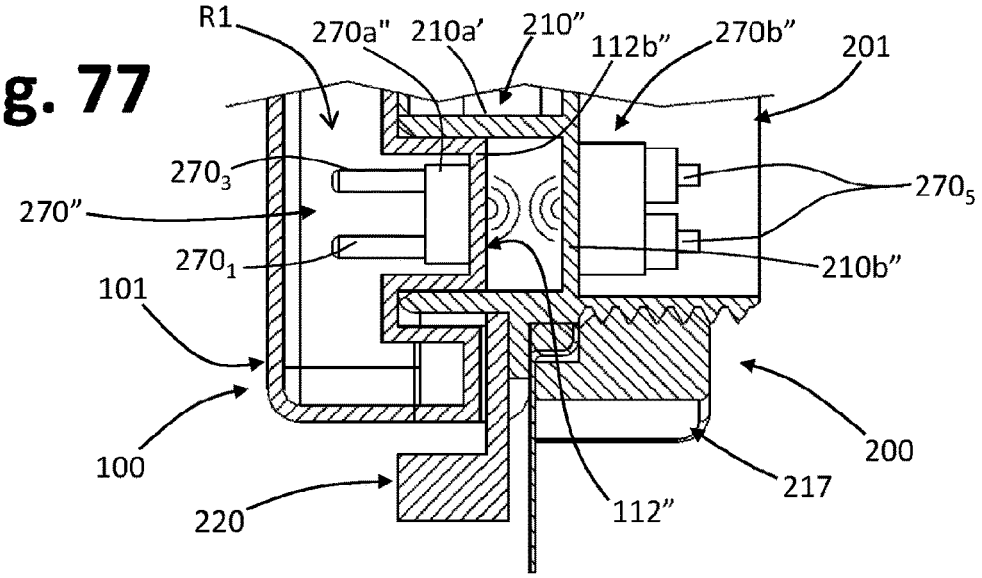

An embodiment of this sort is illustrated schematically in FIG. 77, where the sensor device represented has a sensing element 270" mounted at a housing 112" defined in the hollow body 101, in particular at a closing bottom 112*b*". The element 270" includes, for example, a circuit 270*a*" connected to electrodes $\mathbf{270}_1$, $\mathbf{270}_3$ (and possibly $\mathbf{270}_2$), which extend towards the inside of the tank, here the tank R1. A second communication part of the sensor, designated by 270*b*" is, instead, mounted on the outer side of a closing bottom 210*b*" of a housing 210", defined in the body 201. Also the communication part 270*b*" includes a respective circuit and connection terminals $\mathbf{270}_5$ for electrical connection to a circuit arrangement on board the dispenser or the dish-washer.

The housings 112" and 210" may have a tubular structure similar to the one described previously with reference to the outlets 112, 113 and to the inlets 210, 2011, and can hence be coupled in a releasable way so that—in the condition where the removable dispenser part 101 and the fixed dispenser part 200 are coupled together—the bottom walls 112*b*" and 210*b*" substantially face one another. As may be appreciated, in this case, the housings 112" and 210" are then closed at the rear and, given the presence of the bottom walls 112*b*" and 210*b*", the housings themselves are not connected in fluid communication and do not belong to an arrangement for dispensing of the washing agent contained in the tank R1.

The principle of transmission/reception of data between the sensing element 270", i.e., its circuit 270*a*", and the communication part 270*b*", i.e., its circuit, may be of a type similar to that of passive electrical radio-frequency devices without autonomous supply, for example, RFID devices, which, for this purpose, comprise respective antennas. These radio-frequency devices are in themselves known and do not call for an in-depth description herein.

Here it will suffice to point out that the supply voltage of the circuit 270*a*" is supplied by the circuit of the part 270*b*", which is operative for generating in a known way an electromagnetic field, for example, via a 125-kHz signal; in practice, the electromagnetic field induces a supply voltage, which can in turn transmit data to the circuit of the part 270*b*". On this basis, then, via the sensing element 270" level and/or quality detections similar to the ones described previously may be made and communicated in wireless mode to the reading part 270*b*", which in turn makes them available to the circuit arrangement on board the dispenser or the dish-washing machine 1.

As mentioned previously, in various embodiments, the dispenser includes at least a part that can be operated manually by a user, and a locking/unlocking arrangement, which is controllable to prevent or enable displacement of the operable part between two positions thereof. An embodiment of this sort has been exemplified previously for the hatches $\mathbf{104}_1$, $\mathbf{104}_2$ that equip dispensers according to various embodiments described.

Such a locking/unlocking system can advantageously be used also in order to preventing or enable, according to the cases, removal of the removable part of the dispenser with respect to its fixed part, the removable part providing the part that can be operated by the user. In this case, the locking mechanism of the arrangement includes at least one retaining element mounted on the fixed dispenser part in a displaceable way between a retaining position and a release position with respect to a retaining counter-element present on the removable dispenser part.

A possible implementation in this sense is illustrated schematically in FIGS. 78-82.

Figure 78:
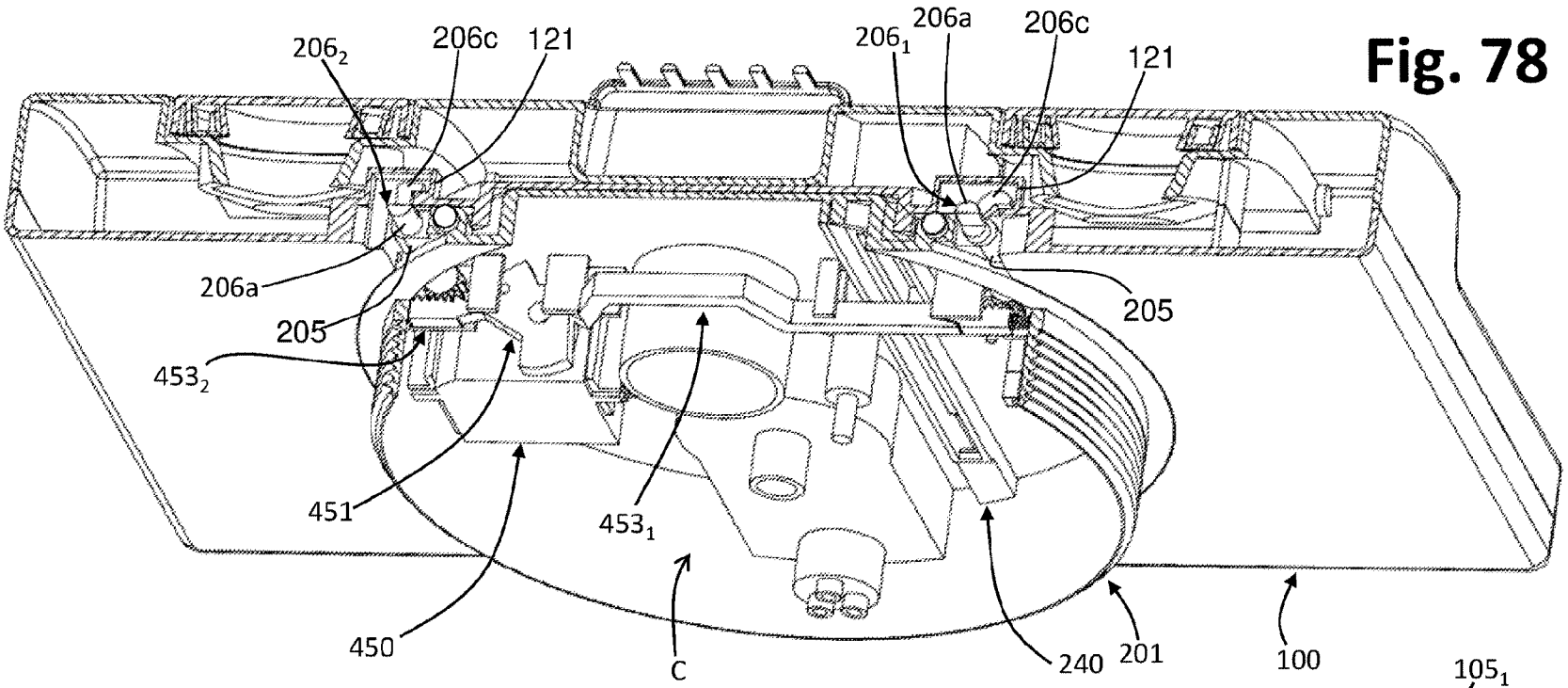
FIG. 78 is a partial schematic perspective view in partial cross section, of a dispenser according to possible embodiments.

With initial reference to FIG. 78, the arrangement exemplified includes a locking mechanism that is fundamentally similar to the one already described previously with reference to FIGS. 31-36. In this case, each element $\mathbf{206}_1$ and $\mathbf{206}_2$ has associated or defines a corresponding retaining element 206*c*, here exemplified in the form of a hook, which projects at the front (along the dimension Z) beyond the front side of the positioning and/or guiding formations 205. On the other hand, defined at the back of the hollow body 101 are corresponding housings or seats 121, which function as retaining counter-elements, with respect to which the elements 206*c* are able to assume at least a retaining position and a releasing position.

The seats 121 are configured and positioned in such a way that, when the movable dispenser part 100 is coupled on the fixed dispenser part 200, at least part of each retaining element 206*c* can project into the corresponding seat 121, with the possibility of angular movement between the retaining position and the releasing position. This angular movement is obtained through the corresponding angular movement of the locking elements $\mathbf{206}_1$, $\mathbf{206}_2$, to which the retaining elements are fixed in rotation. In the example, an element 206*c* and the corresponding seat 121, on one side, and the other element 206*c*, and the corresponding seat 121, on the other side, are shaped in a different way, considering that the angular positions of retaining and releasing of the two elements 206*c* are different. However, in possible variant embodiments, the retaining elements, on one side, and the corresponding retaining counter-elements, on the other side, could be the same as one another.

As may be appreciated also from FIGS. 79-82, in this case the cam member 451 defines a more complex cam profile as compared to the case of FIGS. 31-36. In the schematic example, such a profile includes two opposite stretches 452*a* and 452*b* that extend each according to a respective arc of circumference, the two circumferences being preferably one greater than the other, and two intermediate connection stretches 452*c* and 452*d*, which are longer, of which one (452*c*) is distinguished by a recess, and the other (452*d*) is distinguished by a projection.

Figure 79:
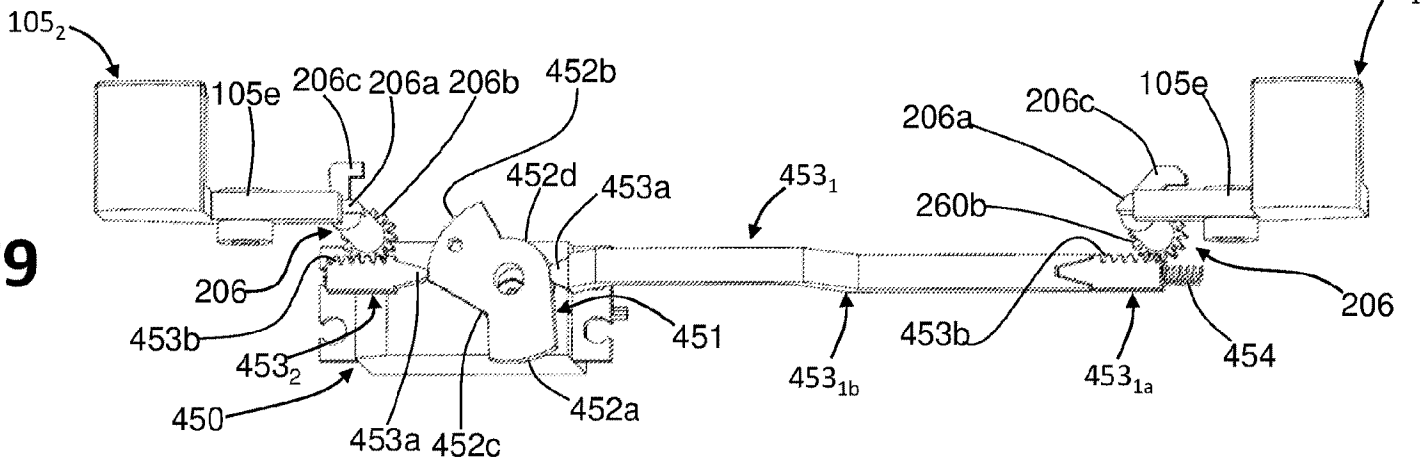
FIGS. 79-82 are schematic top plan views of some components of a blocking/unblocking arrangement that equips the dispenser of FIG. 71, in as many different conditions.

FIG. 79 exemplifies a condition corresponding to that of FIGS. 31-32, with the cam member 451 that is in an angular position such that the locking members $\mathbf{206}_1$ and $\mathbf{206}_2$ do not enable operation of the latching/releasing devices $\mathbf{105}_1$ and $\mathbf{105}_2$. In this condition, both of the retaining elements 206*c* are in an angular position of engagement with respect to the retaining counter-elements represented by the seats 121. In this condition, the removable dispenser part 100 cannot consequently be removed from the fixed dispenser part 200.

Figure 80:
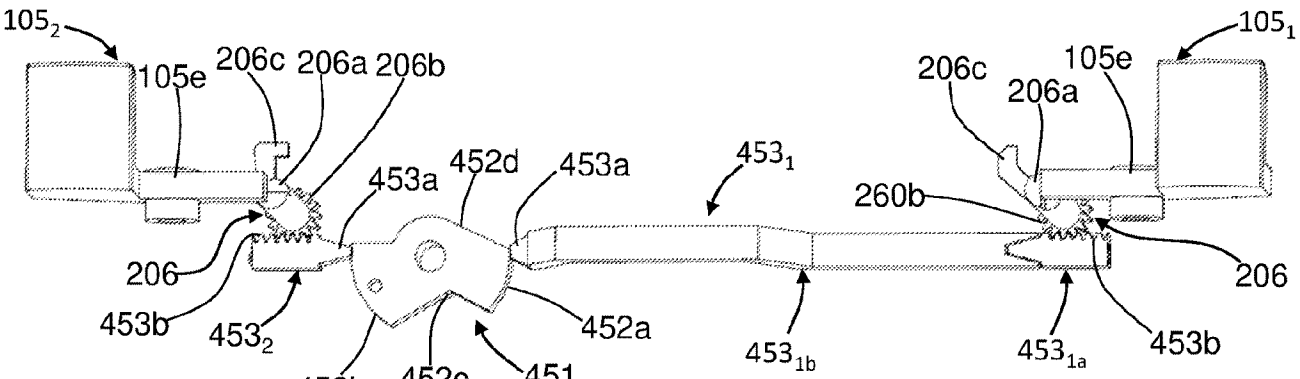

FIG. 80 exemplifies a condition corresponding to that of FIGS. 33-34, with the cam member 451 that is in an angular position such that the locking members $\mathbf{206}_1$ and $\mathbf{206}_2$ prevent operation of the latching/releasing device $\mathbf{105}_2$ and enable, instead, operation of the latching/releasing device $\mathbf{105}_1$, respectively. In this condition, the retaining element 206*c* on the left is in an angular position of engagement with respect to the corresponding seat 121, whereas the retaining element 206*c* on the right is in an angular position of release with respect to the corresponding seat 121: consequently, also in this condition, the removable dispenser part 100 cannot be removed from the fixed dispenser part 200.

Figure 35:
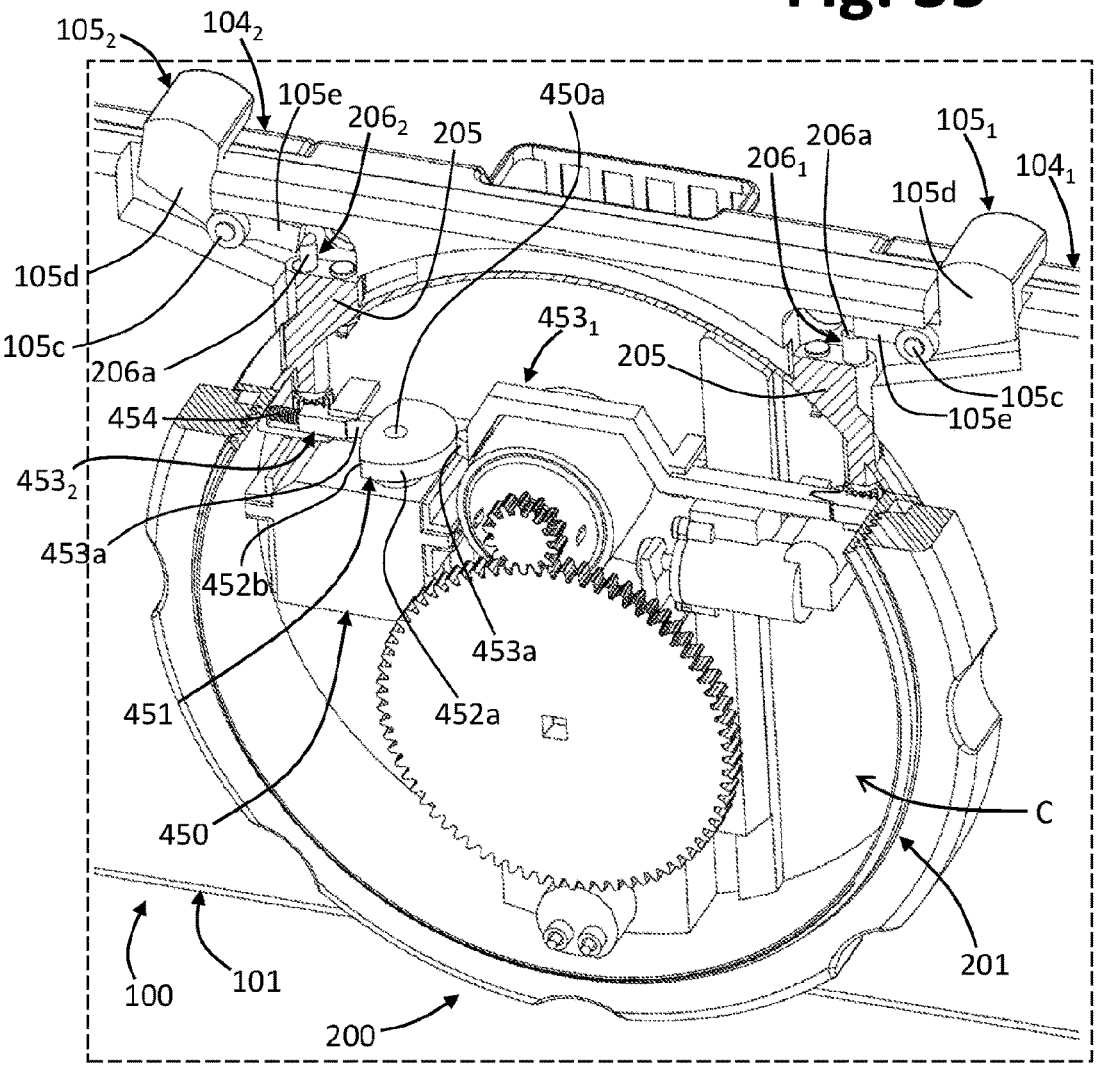
Figure 36:
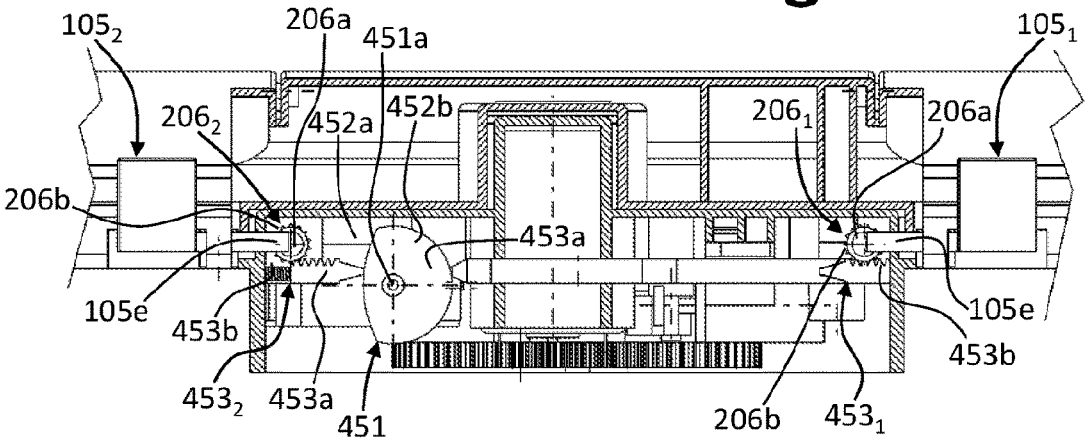
Figure 81:
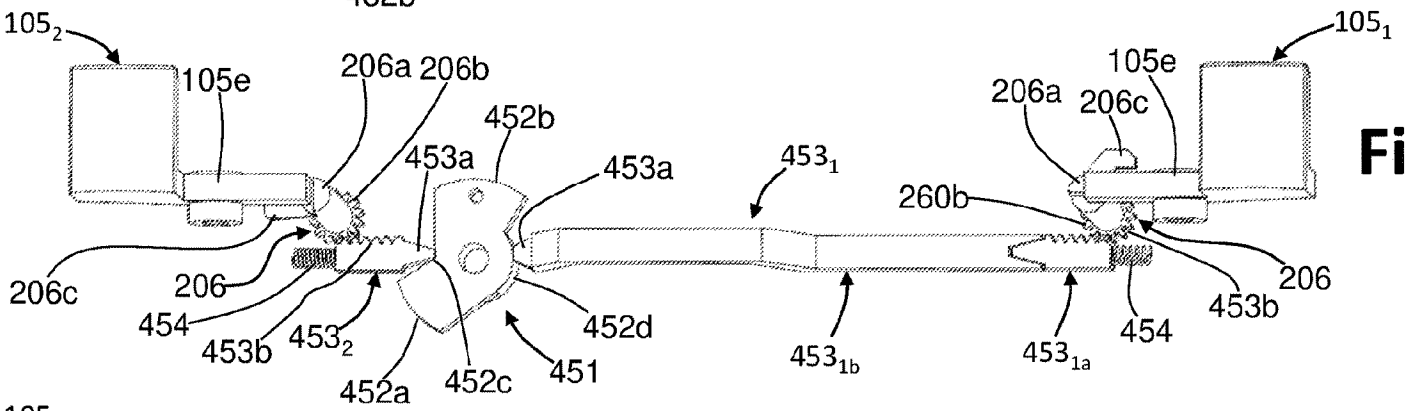

FIG. 81 exemplifies a condition corresponding to that of FIGS. 35-36, with the cam member 451 that is in an angular position such that the locking members $\mathbf{206}_1$ and $\mathbf{206}_2$ prevent operation of the latching/releasing device $\mathbf{105}_1$ and enable, instead, operation of the latching/releasing device $\mathbf{105}_2$, respectively. In this condition, the retaining element 206*c* on the right is in an angular position of release with respect to the corresponding seat 121, whereas the retaining element 206*c* on the left is in an angular position of engagement with respect to the corresponding seat 121: consequently, also in this condition, the removable dispenser part 100 cannot be removed from the fixed dispenser part 200.

Figure 82:
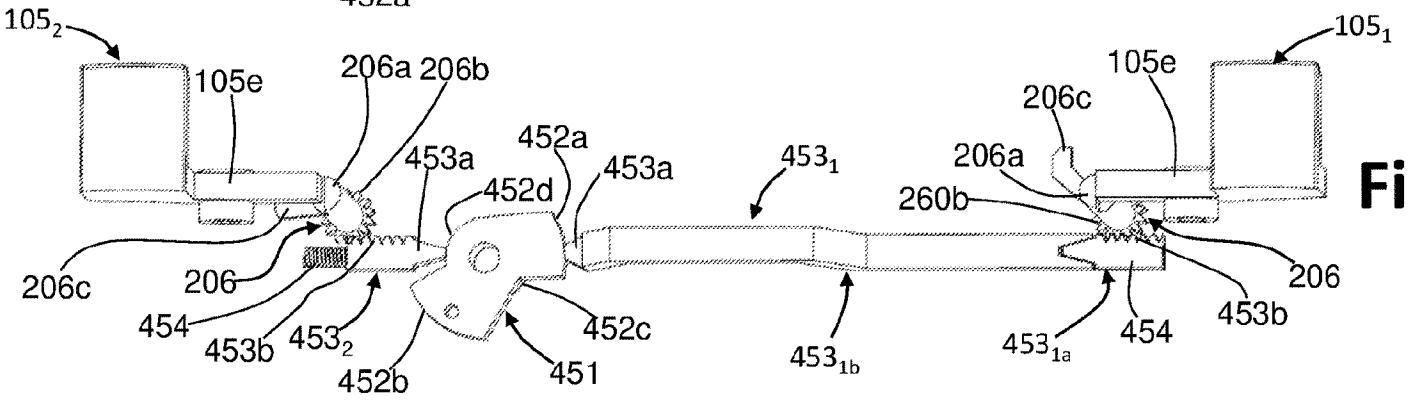

Finally, FIG. 82 exemplifies a condition where the cam member 451 is in an angular position such that the locking members $\mathbf{206}_1$ and $\mathbf{206}_2$ enable operation of both of the latching/releasing devices $\mathbf{105}_1$ and $\mathbf{105}_2$. In this condition, both of the retaining elements 206*c* are in an angular position of release with respect to the corresponding counter-elements represented by the seats 121. Consequently, in this condition, the removable dispenser part 100 can be removed from the fixed dispenser part 200.

Control of the actuator 450 for the purposes of the obtaining the positions of FIGS. 79, 80, and 81 can be carried out according to modalities substantially similar to those described previously with reference to FIGS. 31-36, and hence, for example, as a function of level information obtained by sensor devices that equip the dispenser and/or as a function of signals supplied by the control system CS of the dish-washing machine 1. Reaching of the position of FIG. 82 may, for example, be determined when there arises the condition (which on the other hand is statistically rare) where inside both of the tanks R1 and R2 an amount of washing agent is present lower than a corresponding pre-set minimum level, indicative of the need for topping-up. Another condition that can determine reaching of the position of FIG. 82 is, for example, detection, by a quality sensor of the dispenser, of an anomalous condition regarding the contents of any of the two tanks, for example, in the case where in the tank R1 for the washing detergent WD there is detected the presence of a rinsing additive WA. In this case, irrespective of the level of filling of the tanks R1, R2, it is expedient to enable removal of the removable dispenser part 100 in order to enable washing of the tank that has been inadvertently contaminated. Of course, the position of FIG. 82 could also be obtained following upon a command imparted by the user, for example, using a key purposely provided in the control panel of the machine 1.

The operating condition of the locking/unlocking arrangement of FIGS. 78-82 (as likewise that of FIGS. 31-36) could also be notified to the user via any one of the indication arrangements, for example, one of those described previously.

In the example of FIGS. 78-82 the locking/unlocking arrangement is devised to carry out a dual function, corresponding to the possibility of opening of the hatches $\mathbf{104}_1$, $\mathbf{104}_2$a and to the possibility of removal of the removable dispenser part 100, preferably in order to use a single electric actuator 450 to obtain both functions. It is, however, clear that the two functions could be separate from one another, for example, using respective electric actuators, or the dispenser could include just the function of blocking/unblocking of the removable dispenser part.

It should also be noted that, in possible variant embodiments, the locking/unlocking arrangement could be devised to interact with the coupling/uncoupling arrangement operating between the removable dispenser part and the fixed dispenser part (see, for example, what is described with reference to FIGS. 13-14), which as has been said can be switched manually at least from a position of engagement to a position of release, to prevent or enable removal of the removable dispenser part. For such a case, the locking/unlocking arrangement may, for example, be configured in such a way that, in its operative and inoperative conditions, the locking mechanism will prevent and enable, respectively, switching of the coupling/uncoupling arrangement from its position of engagement to its position of release.

For instance, with reference to FIG. 78, retaining elements similar to those designated by 206*c* could be arranged further down with respect to the case exemplified in the figure and mounted movable to assume a first angular blocking position, in which they interfere mechanically with the rotation of the coupling/uncoupling member 220 (see FIGS. 9-11), for example, at the corresponding recesses 220*e*, and a second angular unblocking position, where their angular position is such as not to constitute a hindrance to rotation of the member 220.

From the foregoing description the characteristics and advantages of the dispenser of washing agents according to the embodiments proposed emerge clearly, amongst which the following should be emphasized:

i) the solution of providing a reversible peristaltic pump, with a command arrangement associated thereto, makes it possible to use the pump itself for the purposes of delivery of two different washing agents, via two different dispensing arrangements;

ii) the solution of providing a removable dispenser part defining at least one tank, the outlet of which is provided with an automatically driven non-return valve, makes it possible to prevent risks of dispersion in the environment of the corresponding washing agent, when the removable dispenser part is removed from a fixed dispenser part;

iii) the solution of providing on the front of the dispenser a purposely designed housing for a tablet of washing agent that is directly exposed simplifies production of the dispenser as compared to the prior art and at the same time simplifies the activity of loading-in of the tablet by the user;

iv) the solution of providing a signalling system, with a light-generation element on a fixed dispenser part, and one or more light-transmission elements on a removable dispenser part, makes it possible to transfer effectively information of an optical type at the front of the dispenser, to the benefit of the user, and at the same time enables positioning of the components subject to electric voltage in a protected area of the dispenser;

v) the solution of providing a locking/unlocking arrangement for a part of the dispenser which is operable by a user, with the arrangement that is managed by a corresponding logic implemented in a control circuit, makes it possible to reduce the risks of error by a user in the use of the dispenser, in particular as regards topping-up with washing agents or else removal of a dispenser part to enable interventions thereon only when actually necessary;

vi) the solution of providing at least part of a sensor device on a fixed dispenser part, in particular at an inlet thereof for a washing agent, makes it possible to make detections of a quantitative type and/or of a qualitative type as regards the contents of a tank defined in a removable dispenser part, and at the same time makes it possible to simplify the electrical connections, as well as positioning of the connections in a protected area of the dispenser;

vii) the solution of equipping the dispenser with a sensor device pre-arranged for detecting one or more qualitative characteristics of a washing agent makes it possible to provide information concerning the type or quality of a washing agent contained in a corresponding tank, which are, for example, useful in order to prevent or correct any possible malfunctioning due to errors of a user in relation to the type of washing agent or a degradation of the latter, or in order to enable a more efficient control of a treatment program carried out by the dish-washer on which the dispenser is installed.

It should again pointed out that the technical solutions of points i), ii) and vii) can be implemented also in dispensers that do not include removable parts, i.e., ones that have a dispenser body that is as a whole designed to be installed in a fixed position.

It is clear that numerous variations may be made by the person skilled in the branch to the dispenser described by way of example, without thereby departing from the scope of the invention.

Previously, reference has been made to a system for dispensing of a washing agent, in particular the washing agent contained in the tank R2, operation of which is in part based upon displacement of the mounting wall of the dispenser 10 between a substantially vertical position and a substantially horizontal position (see in particular what is described with reference to FIGS. 6-8). However, it is clear that this does not constitute an essential characteristic, in so far as the dispenser 10 could be devised for being mounted on a fixed wall of the tub, such as the wall designated by 6 in FIG. 1. For these cases, the aforesaid delivery system will be modified accordingly, for example, using any of the techniques described in WO02069779A1, US2002153029A1, and WO0173182A2 filed in the name of the present Applicant.

A number of sensing elements described previously with reference to different types of sensor may be combined in single sensor device. In this perspective, for example, one and the same sensor device could include both electrodes for detection of an electrical quantity and a piezoelectric element for detection of a physical characteristic (viscosity or density), or else at least one light emitter and at least one light receiver for a detection of an optical type.

The invention claimed is:

1. A washing agent dispenser for washing machines, for dispensing washing agents into a washing machine wash-chamber, the dispenser having a dispenser body designed for mounting on a wall delimiting the washing machine wash-chamber, the dispenser having a first tank, suitable to contain a first washing agent in liquid or semi-solid form, and a first dispensing arrangement which is configured for dispensing first dosed amounts of the first washing agent and which comprises a first duct between a first outlet of the first tank and a first dispensing outlet of the first dosed amounts of the first washing agent, wherein the first dispensing arrangement comprises a peristaltic pump which includes an actuator and a rotating assembly having at least one compression element, at least one part of the first duct being deformable and in deforming contact with the at least one compression element of the rotating assembly, the peristaltic pump being configured to operate in a first direction of rotation, to cause delivery of the first dosed amounts of the first washing agent, wherein the dispenser moreover comprises a second tank, suitable to contain a second washing agent, and a second dispensing arrangement which is configured for dispensing second dosed amounts of the second washing agent and which comprises a second duct between an outlet of the second tank and a second dispensing outlet of the second dosed amounts of the second washing agent, and wherein the peristaltic pump has associated thereto a command arrangement of the second dispensing arrangement, the peristaltic pump being configured to operate in a second direction of rotation, to drive the command arrangement so as to cause delivery of the second dosed amounts of the second washing agent.

2. The dispenser according to claim 1, wherein the command arrangement comprise a transmission lever which is mounted to rotate about an axis and is operatively associated to a valve member of a dosing valve being part of the second dispensing arrangement, the transmission lever being configured in such a way:

an angular movement in a first direction of the transmission lever, induced by operation of the peristaltic pump in the first direction of rotation, does not cause a displacement of the valve member able to determine delivery of a second dosed amount of the second washing agent, and an angular movement in a second direction of the transmission lever, induced by operation of the peristaltic pump in the second direction of rotation, causes a displacement of the valve member able to determine delivery of least one second dosed amount of the second washing agent.

3. The dispenser according to claim 1, wherein the command arrangement comprises a cam member that defines a cam profile and is susceptible to be set in rotation by means of the actuator of the peristaltic pump.

4. The dispenser according to claim 3, wherein the cam profile of the cam member is a multi-lobed profile.

5. The dispenser according to claim 2, wherein:

the command arrangement comprises a cam member that defines a cam profile and is susceptible to be set in rotation by means of the actuator of the peristaltic pump, and the transmission lever has a first portion, which defines a cam follower configured to interact with the cam profile of the cam member, and a second portion which is associated with the valve member of the dosing valve.

6. The dispenser according to claim 5, wherein the transmission lever comprises a first arm and a second arm which extend in generally opposite directions relative to the axis of rotation of the transmission lever and to which the first portion and the second portion belong, respectively.

7. The dispenser according to claim 2, wherein the dosing valve comprises a dosing chamber which is defined along the second duct and which partially houses the valve member, the dosing chamber having a respective inlet and a respective outlet.

8. The dispenser according to claim 1, wherein the peristaltic pump is drivable in the second direction of rotation to cause air to enter the first tank, for compensating for a volume of a first dose of the first washing agent previously dispensed, and/or or causing at least a partial emptying of the first duct.

9. The dispenser according to claim 1, wherein the first dispensing outlet is at a lower height than the rotating assembly of the peristaltic pump, with reference to a height dimension of the dispenser in the operating condition thereof.

10. The dispenser according to claim 1, wherein the peristaltic pump comprises one or more transmission members between a drive shaft of the actuator and the rotating assembly, the drive shaft being rotatable about an axis which is substantially parallel to an axis of rotation of the rotating assembly.

11. The dispenser according to claim 1, wherein the dispenser body comprises a dispenser part designed for mounting in a fixed position on one said wall delimiting the washing machine wash-chamber and having a front portion at which at least part of the peristaltic pump is mounted or accessible.

12. The dispenser according to claim 1, where the dispenser body comprises a fixed dispenser part, designed for mounting in a fixed position on one said wall delimiting the washing machine wash-chamber, and a removable dispenser part, which is couplable in a removable way to the fixed dispenser part, wherein the removable dispenser part comprises a hollow body defining at least one of the first tank and the second tank, and wherein the peristaltic pump, at least part of the first dispensing arrangement, at least part of the second dispensing arrangement and the command arrangement are on the fixed dispenser part.

13. The dispenser according to claim 12, wherein at least one of the first tank and the second tank is defined in the hollow body and the outlet of the first tank, respectively the outlet of the second tank, is defined in a rear wall of the hollow body which is designed to face a front of the fixed dispenser part, the outlet of the first tank, respectively the outlet of the second tank, being couplable in a separable way to an inlet of the first duct, respectively an inlet of the second duct, which is at the front of the fixed dispenser part.

14. The dispenser according to claim 12, wherein at least one retention valve is mounted on the hollow body in a position corresponding to at least one of the inlet of the first tank and the inlet of the second tank, the at least one retention valve being configured to assume a respective open position following upon coupling between the outlet of the first tank, respectively the outlet of the second tank, and the inlet of the first duct, respectively the inlet of the second duct, and to assume a respective closed position following upon decoupling between the outlet of the first tank, respectively the outlet of the second tank, and the inlet of the first duct, respectively the inlet of the second duct.

15. A household washing machine, comprising a washing agent dispenser according to claim 1.

16. The dispenser according to claim 7, wherein the valve member is displaceable from a first position, in which the valve member prevents the second washing agent from entering the dosing chamber via the respective inlet and enables the second washing agent to flow out of the dosing chamber via the respective outlet, and a second position, in which the valve member enables the second washing agent to enter the dosing chamber via the respective inlet and prevents the second washing agent from flowing out of the dosing chamber via the respective outlet.

17. The dispenser according to claim 3, wherein the cam member is coaxial and fixed in rotation with the rotating assembly of the peristaltic pump, and/or the cam profile of the cam member is a tri-lobed profile.

18. The dispenser according to claim 12, wherein at least part of the peristaltic pump is in a front portion of the fixed dispenser part that is receivable in, or is couplable with, a corresponding seat or portion of the removable dispenser part.

19. A washing agent dispenser for washing machines, for dispensing washing agents into a washing machine wash-chamber, the dispenser having a dispenser body comprising at least one fixed dispenser part, designed for mounting on a wall delimiting the washing machine wash-chamber, where the dispenser body defines at least one containment volume for at least one washing agent, the dispenser also comprising at least one dispensing arrangement that is configured to dispense dosed amounts of the at least one washing agent, and that comprises a duct between an outlet of at least one tank and a dispensing outlet of dosed amounts of the at least one washing agent, where the at least one dispensing arrangement comprises a peristaltic pump which includes an actuator and a rotating assembly having at least one compression element, at least one part of said duct being deformable and in deforming contact with the at least one compression element of the rotating assembly, and wherein the at least one fixed dispenser part has a front portion at which at least part of the peristaltic pump is accessible, in the front portion there extending at least part of a pump housing.

20. The dispenser according to claim 19, wherein the pump housing is fitted with a removable cover.

* * * * *